US009542874B2

(12) United States Patent
Park et al.

(10) Patent No.: US 9,542,874 B2
(45) Date of Patent: Jan. 10, 2017

(54) DISPLAY APPARATUS

(71) Applicant: SAMSUNG DISPLAY CO., LTD., Yongin, Gyeonggi-Do (KR)

(72) Inventors: Suhyeong Park, Gyeongju-si (KR); Unggyu Min, Seoul (KR); Young-Soo Yoon, Seoul (KR); Sangik Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 22 days.

(21) Appl. No.: 14/280,529

(22) Filed: May 16, 2014

(65) Prior Publication Data

US 2015/0145843 A1 May 28, 2015

(30) Foreign Application Priority Data

Nov. 26, 2013 (KR) ..... 10-2013-0144702

(51) Int. Cl.

| | |
|---|---|
| ***G06F 3/038*** | (2013.01) |
| ***G09G 3/20*** | (2006.01) |
| *G09G 3/36* | (2006.01) |

(52) U.S. Cl.

CPC ..... *G09G 3/20* (2013.01); *G09G 3/3614* (2013.01); *G09G 3/3688* (2013.01);
(Continued)

(58) Field of Classification Search

CPC combination set(s) only.
See application file for complete search history.

(56) References Cited

U.S. PATENT DOCUMENTS 5,479,188 A * 12/1995 Moriyama ..... 345/89
6,157,358 A * 12/2000 Nakajima et al. ..... 345/96
(Continued)

FOREIGN PATENT DOCUMENTS

KR 10-2001-0017524 A 3/2001
KR 10-0293983 B1 4/2001
(Continued)

OTHER PUBLICATIONS

English Abstract, for Korean Application No. 1019980023609, dated Jun. 23, 1998, for corresponding Korean Patent No. KR 10-0293983 B1 listed above, 2 pages.
(Continued)

*Primary Examiner* — Jason Olson
*Assistant Examiner* — Sosina Abebe
(74) *Attorney, Agent, or Firm* — Lewis Roca Rothgerber Christie LLP

(57) ABSTRACT

A display apparatus includes: a plurality of pixels coupled to gate lines and to data lines configured to cross the gate lines, a gate driver configured to apply gate signals to the gate lines, a first data driver configured to apply first data voltages to first signal lines, a first DEMUX part configured to selectively couple the first signal lines to the data lines, a second data driver configured to apply second data voltages to second signal lines positioned to correspond to the first signal lines, and a second DEMUX part positioned to face the first DEMUX part such that the pixels are positioned between the first and second DEMUX parts, the second DEMUX part configured to couple the second signal lines to the data lines, which are not coupled to the first signal lines. Each of the first data voltages has a polarity opposite to a polarity of a corresponding second data voltage of the second data voltages.

25 Claims, 32 Drawing Sheets

(52) U.S. Cl.
CPC ..... *G09G 2310/0254* (2013.01); *G09G 2310/0275* (2013.01); *G09G 2310/0281* (2013.01); *G09G 2310/0297* (2013.01); *G09G 2320/0223* (2013.01); *G09G 2330/08* (2013.01)

(56) References Cited

U.S. PATENT DOCUMENTS

| | | | | |
|---|---|---|---|---|
| 6,924,786 | B2 | 8/2005 | Hebiguchi | |
| 7,245,283 | B2 | 7/2007 | Kim et al. | |
| 7,502,008 | B2 | 3/2009 | Jeoung et al. | |
| 7,773,181 | B2 | 8/2010 | Ko et al. | |
| 8,031,155 | B2 | 10/2011 | Jeoung et al. | |
| 2001/0052888 | A1* | 12/2001 | Hebiguchi | 345/87 |
| 2004/0164941 | A1 | 8/2004 | Kim et al. | |
| 2007/0176876 | A1* | 8/2007 | Lee | 345/96 |
| 2008/0278466 | A1* | 11/2008 | Joo | 345/205 |
| 2009/0289878 | A1 | 11/2009 | Chen | |
| 2010/0117939 | A1* | 5/2010 | Lee | G09G 3/3275 345/76 |
| 2011/0102471 | A1 | 5/2011 | Hsu et al. | |
| 2011/0148852 | A1 | 6/2011 | Kim | |
| 2013/0088479 | A1* | 4/2013 | Kim | G09G 3/3614 345/212 |

FOREIGN PATENT DOCUMENTS

| | | | |
|---|---|---|---|
| KR | 10-0756666 | B1 | 9/2007 |
| KR | 10-2012-0130901 | A | 12/2012 |

OTHER PUBLICATIONS

Korean Patent Abstracts, Publication No. KR 1020020058796 A, dated Jul. 12, 2002, for corresponding Korean Patent No. KR 10-0756666 B1 listed above, 1 page.

* cited by examiner

DISPLAY APPARATUS

CROSS-REFERENCE TO RELATED APPLICATION

This application claims priority to and the benefit of Korean Patent Application No. 10-2013-0144702, filed in the Korean Intellectual Property Office on Nov. 26, 2013, the entire content of which is incorporated herein by reference.

BACKGROUND

1. Field

An aspect of an embodiment of the present invention relates to a display apparatus.

2. Description of the Related Art

In general, a display apparatus includes a display panel including a plurality of pixels to display an image, a gate driver to apply gate signals to the pixels, and a data driver to apply data signals to the pixels. The pixels receive the gate signals through gate lines. The pixels receive the data signals through data lines in response to the gate signals. The pixels display gray scales corresponding to the data signals.

In recent years, with the demand for high-resolution display apparatus and large-sized display apparatus, the display panel has increased in size. Because the data line has a resistance component, a load capacitance of the data line may increase as the size of the display panel increases. Accordingly, a difference between the data signals due to a signal delay in data lines may occur as the data signals travel towards the end of the data lines.

SUMMARY

An aspect of an embodiment of the present disclosure is directed toward a display apparatus capable of substantially preventing a vertical line from occurring therein.

According to an embodiment of the present invention, a display apparatus including: a plurality of pixels coupled to (e.g., connected to) gate lines and to data lines configured to cross the gate lines, a gate driver configured to apply gate signals to the gate lines, a first data driver configured to apply first data voltages to first signal lines, a first DEMUX part configured to selectively couple the first signal lines to the data lines, a second data driver configured to apply second data voltages to second signal lines positioned to correspond to the first signal lines, and a second DEMUX part positioned to face the first DEMUX part such that the pixels are positioned between the first and second DEMUX parts, the second DEMUX part configured to couple the second signal lines to the data lines, which are not coupled to the first signal lines. Each of the first data voltages has a polarity opposite to a polarity of a corresponding second data voltage of the second data voltages.

The pixels may be coupled to the gate lines, and alternately coupled to the data lines in a unit of a row.

The data lines may include first data lines corresponding to odd-numbered data lines of the data lines, and second data lines corresponding to even-numbered data lines of the data lines. The first DEMUX part may include a plurality of first DEMUX units configured to selectively couple the first signal lines to the first and second data lines in response to first and second DEMUX signals, and the second DEMUX part may include a plurality of second DEMUX units configured to couple the second signal lines to the first and second data lines, which are not coupled to the first signal lines, in response to the first and second DEMUX signals.

The first DEMUX units may include first switching devices configured to couple the first signal lines to the first data lines in response to the first DEMUX signal, and second switching devices configured to couple the first signal lines to the second data lines in response to the second DEMUX signal.

The second DEMUX units may include third switching devices configured to couple the second signal lines to the first data lines in response to the second DEMUX signal, and fourth switching devices configured to couple the second signal lines to the second data lines in response to the first DEMUX signal.

The first DEMUX signal may have a period corresponding to 4N times of one frame, may be activated during a period corresponding to 2N times of the one frame to switch the first and fourth switching devices, and may have a phase opposite to a phase of the second DEMUX signal, where N is an integer number greater than 0.

First, second, third, and fourth frames may be sequentially repeated. The first data voltages applied to odd-numbered first signal lines in the first and fourth frames may have a polarity opposite to a polarity of the first data voltages applied to the odd-numbered first signal lines in the second and third frames. The first data voltages applied to the odd-numbered first signal lines may have a polarity opposite to a polarity of the first data voltages applied to even-numbered first signal lines.

The first DEMUX units may include first switching devices configured to alternately couple the first signal lines to odd-numbered first data lines and even-numbered second data lines in response to the first DEMUX signal, and second switching devices configured to alternately couple the first signal lines to odd-numbered second data lines and even-numbered first data lines in response to the second DEMUX signal.

The first switching devices of odd-numbered first DEMUX units may be configured to couple odd-numbered first signal lines to the odd-numbered first data lines in response to the first DEMUX signal, and the first switching devices of even-numbered first DEMUX units may be configured to couple even-numbered first signal lines to the even-numbered second data lines in response to the first DEMUX signal.

The second switching devices of odd-numbered first DEMUX units may be configured to couple odd-numbered first signal lines to the odd-numbered second data lines in response to the second DEMUX signal, and the second switching devices of even-numbered second DEMUX units may be configured to couple even-numbered first signal lines to the even-numbered first data lines in response to the second DEMUX signal.

The second DEMUX units may include: third switching devices configured to alternately couple the second signal lines to the odd-numbered first data lines and the even-numbered second data lines in response to the second DEMUX signal, and fourth switching devices configured to alternately couple the second signal lines to the odd-numbered second data lines and the even-numbered first data lines in response to the first DEMUX signal.

The third switching devices of odd-numbered second DEMUX units may be configured to couple odd-numbered second signal lines to the odd-numbered first data lines in response to the second DEMUX signal, and the third switching devices of even-numbered second DEMUX units may be configured to couple even-numbered second signal lines to the even-numbered second data lines in response to the second DEMUX signal.

The fourth switching devices of odd-numbered second DEMUX units may be configured to couple odd-numbered second signal lines to the odd-numbered second data lines in response to the first DEMUX signal, and the fourth switching devices of even-numbered second DEMUX units may be configured to couple even-numbered second signal lines to the even-numbered first data lines in response to the first DEMUX signal.

The first DEMUX signal may have a period corresponding to 4N times of one frame, may be activated during a period corresponding to 2N times of the one frame to switch the first and fourth switching devices, and may have a phase opposite to a phase of the second DEMUX signal, where N is an integer number greater than 0.

First, second, third, and fourth frames may be sequentially repeated. The first data voltages applied to odd-numbered first signal lines in the first and fourth frames may have a polarity opposite to a polarity of the first data voltages applied to the odd-numbered first signal lines in the second and third frames. The first data voltages applied to the odd-numbered first signal lines may have a polarity opposite to a polarity of the first data voltages applied to even-numbered first signal lines.

The gate signals may be sequentially applied to the gate lines. Each of the gate signals may have an activation period corresponding to one period. The first DEMUX signal may have a period corresponding to 4M times of one period, may be activated during a period corresponding to 2M times of the one period to switch the first and fourth switching devices, and may have a phase opposite to a phase of the second DEMUX signal, where M is an integer number greater than 0.

The first data voltages applied to odd-numbered first signal lines may have a polarity opposite to a polarity of the first data voltages applied to even-numbered first signal lines, and the polarity of the first data voltages may be inverted every 2M time period.

The first DEMUX units may include first, second, third, and fourth sub-DEMUX units sequentially and repeatedly positioned. The second DEMUX units may include fifth, sixth, seventh, and eighth sub-DEMUX units sequentially and repeatedly positioned. The first signal lines may include first, second, third, and fourth sub-signal lines sequentially and repeatedly positioned and may be coupled to corresponding first, second, third, and fourth sub-DEMUX units. The second signal lines may include fifth, sixth, seventh, and eighth sub-signal lines sequentially and repeatedly positioned and may be coupled to corresponding fifth, sixth, seventh, and eighth sub-DEMUX units.

The first to fourth sub-DEMUX units may include: first switching devices configured to alternately couple the first to fourth sub-signal lines to second and first data lines, which may be adjacent to each other, and first and second data lines, which may not be adjacent to each other, in a unit of two lines in response to the first DEMUX signal; and second switching devices configured to alternately couple the first to fourth sub-signal lines to first and second data lines, which may not be adjacent to each other, and second and first data lines, which may be adjacent to each other, in a unit of two lines in response to the second DEMUX signal.

The fifth to eighth sub-DEMUX units may include: third switching devices configured to alternately couple the fifth to eighth sub-signal lines to second and first data lines, which may be adjacent to each other, and first and second data lines, which may not be adjacent to each other, in the unit of two lines in response to the second DEMUX signal; and fourth switching devices configured to alternately couple the fifth to eighth sub-signal lines to first and second data lines, which may not be adjacent to each other, and second and first data lines, which may be adjacent to each other, in the unit of two lines in response to the first DEMUX signal.

The first DEMUX signal may have a period corresponding to 4N times of one frame, may be activated during a period corresponding to 2N times of the one frame to switch the first and fourth switching devices, and may have a phase opposite to a phase of the second DEMUX signal, where N is an integer number greater than 0.

First, second, third, and fourth frames may be sequentially repeated. The first data voltages applied to the first and fourth sub-signal lines in the first and fourth frames may have a polarity opposite to a polarity of the first data voltages applied to the first and fourth sub-signal lines in the second and third frames. The first data voltages applied to the first and fourth sub-signal lines may have a polarity opposite to a polarity of the first data voltages applied to the second and third sub-signal lines. The second data voltages applied to the fifth to eighth sub-signal lines may have a polarity of the first data voltages applied to the first to fourth sub-signal lines corresponding to the fifth to eighth sub-signal lines.

The gate signals may be sequentially applied to the gate lines. Each of the gate signals may have an activation period corresponding to one period. The first DEMUX signal may have a period corresponding to 4M times of one period, may be activated during a period corresponding to 2M times of the one period to switch the first and fourth switching devices, and may have a phase opposite to a phase of the second DEMUX signal, where M is an integer number greater than 0.

The first data voltages applied to the first and fourth sub-signal lines may have a polarity opposite to a polarity of the first data voltages applied to the second and third sub-signal lines. The polarity of the first data voltages may be inverted every 2M time period. The second data voltages applied to the fifth to eighth sub-signal lines may have a polarity opposite to a polarity of the first data voltages applied to the first to fourth sub-signal lines corresponding to the fifth to eighth sub-signal lines.

The pixels may be coupled to corresponding gate lines of the gate lines and corresponding data lines of the data lines.

The pixels may be coupled to corresponding gate lines of the gate lines and alternately coupled to corresponding gate lines of the data lines in a unit of two rows.

BRIEF DESCRIPTION OF THE DRAWINGS

Aspects of the embodiments of the present invention will become apparent to those skilled in the art by reference to the following description when considered in conjunction with the accompanying drawings, wherein.

DETAILED DESCRIPTION

Figure 1:
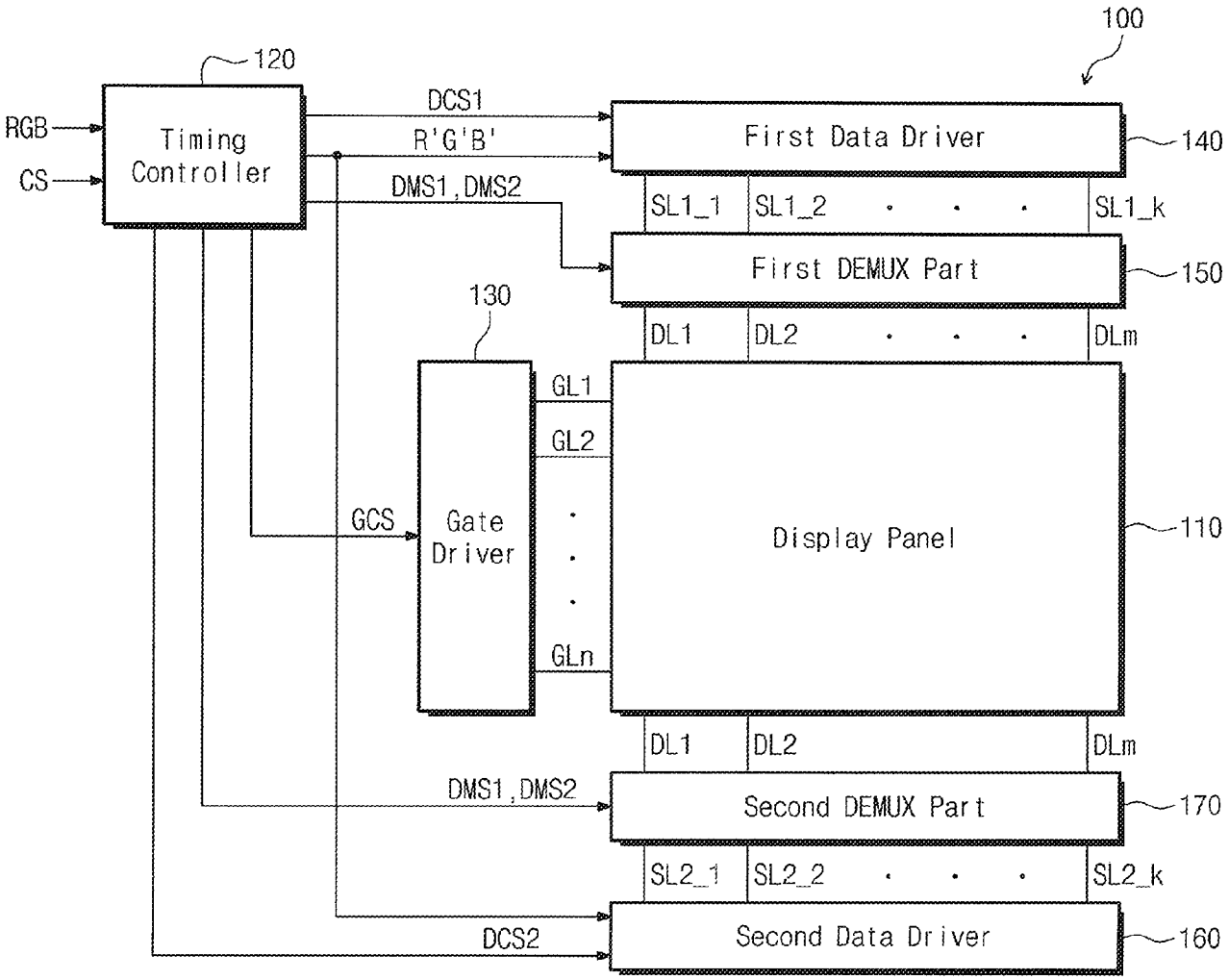
FIG. 1 is a block diagram showing a display apparatus according to a first embodiment of the present disclosure.

As those skilled in the art would realize, the described embodiments hereinafter may be modified in various different ways, all without departing from the spirit or scope of the present invention. When an element or layer is referred to as being "on", "connected to" or "coupled to" another element or layer, it can be directly on, connected to or coupled to the other element or layer, or one or more intervening elements or layers may be present. In contrast, when an element or layer is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

Although the terms first, second, etc. may be used herein to describe various elements, components, regions, layers and/or sections, these elements, components, regions, layers and/or sections should not be limited by these terms. Instead, these terms are only used to distinguish one element, component, region, layer or section from another region, layer or section. Thus, a first element, component, region, layer or section described below could be termed a second element, component, region, layer or section, without departing from the spirit or scope of the present invention.

Spatially relative terms, such as "beneath", "below", "lower", "above", "upper" and the like, may be used herein for ease of description to describe one element or feature's relationship to another element(s) or feature(s) as illustrated in the figures. However, a person of skill in the art will understand that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein should be interpreted accordingly.

The terminology used herein is for the purpose of describing aspects of the embodiments only and is not intended to be limited thereto. As used herein, the singular forms, "a", "an" and "the" are intended to include the plural forms as well, unless the context clearly indicates otherwise. It will be further understood to those skilled in the art that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same and ordinary meaning as commonly understood by one of ordinary skill in the art to which this invention belongs. It will be further understood that terms, such as those defined in commonly used dictionaries, should be interpreted as having a meaning that is consistent with their meaning in the context of the relevant art, and will not be interpreted in an idealized or overly formal sense, unless expressly so defined herein.

Hereinafter, embodiments of the present invention will be described with reference to the accompanying drawings.

FIG. 1 is a block diagram showing a display apparatus according to a first embodiment of the present disclosure.

Referring to FIG. 1, a display apparatus 100 includes a display panel 110, a timing controller 120, a gate driver 130, a first data driver 140, a first DEMUX part 150, a second data driver 160, a second DEMUX part 170, a plurality of gate lines GL1 to GLn, a plurality of data lines DL1 to DLm, a plurality of first signal lines SL1_1 to SL1_k, and a plurality of second signals lines SL2_1 to SL2_k.

The display panel 110 includes a plurality of pixels arranged in a matrix form. The gate lines GL1 to GLn may extend in a row direction, and are coupled to (e.g., connected to) the gate driver 130 and the display panel 110. Here, "n" is an integer number greater than zero (0).

The data lines DL1 to DLm may extend in a column direction, and are coupled to the first DEMUX part 150, which may be positioned (e.g., disposed) adjacent to an upper portion of the display panel 110 and the pixels of the display panel 110. In addition, the data lines DL1 to DLm are coupled to the second DEMUX part 170, which may be positioned adjacent to a lower portion of the display panel 110 and the pixels of the display panel 110. Here, "m" is an integer number greater than zero (0).

The arrangement of the pixels of the display panel 110, and the connection of the gate lines GL1 to GLn and the data lines DL1 to DLm to the pixels, will be described below with reference to FIG. 2.

The timing controller 120 may receive image signals RGB and control signals CS from an external source (e.g., a system board). The timing controller 120 converts a data format of the image signals RGB to a data format appropriate to interface between the timing controller 120 and the first and second data drivers 140 and 160, and generates image signals R'G'B'. The timing controller 120 applies the generated image signals R'G'B' to the first and second data drivers 140 and 160.

The timing controller 120 generates a gate control signal GCS, a first data control signal DCS1, a second data control signal DCS2, a first DEMUX signal DMS1, and a second DEMUX signal DMS2.

The gate control signal GCS is a control signal to control an operation timing of the gate driver 130. The timing controller 120 applies the gate control signal GCS to the gate driver 130.

The first data control signal DCS1 is a control signal to control an operation timing of the first data driver 140. The second data control signal DCS2 is a control signal to control an operation timing of the second data driver 160. The timing controller 120 applies the first data control signal DCS1 to the first data driver 140, and the second data control signal DCS2 to the second data driver 160.

The first and second DEMUX signals DMS1 and DMS2 are control signals to control the first and second DEMUX parts 150 and 170. The timing controller 120 applies the first and second DEMUX signals DMS1 and DMS2 to the first and second DEMUX parts 150 and 170.

The gate driver 130 outputs gate signals in response to the gate control signal GCS. The gate lines GL1 to GLn receive the gate signals from the gate driver 130. The gate signals may be sequentially applied to the pixels of the display panel 110 through the gate lines GL1 to GLn in the unit of a row.

The first and second data drivers 140 and 160 generate data voltages. The data voltages may include first data voltages and second data voltages.

The first data driver 140 converts the image signals R'G'B' to the first data voltages in response to the first data control signal DCS1, and outputs the first data voltages. The second data driver 160 converts the image signals R'G'B' to the second data voltages in response to the second data control signal DCS2, and outputs the second data voltages.

The first signal lines SL1_1 to SL1_k may extend in the column direction and are coupled to (e.g., connected to) the first data driver 140 and the first DEMUX part 150. Here, "k" is an integer number greater than "0" and less than "m." The first signal lines SL1_1 to SL1_k receive the first data voltages from the first data driver 140. The first data voltages are applied to the first DEMUX part 150 through the first signal lines SL1_1 to SL1_k.

The second signal lines SL2_1 to SL2_k may extend in the column direction and are coupled to the second data driver 160 and the second DEMUX part 170. The second signal lines SL2_1 to SL2_k receive the second data voltages from the second data driver 160. The second data voltages are applied to the second DEMUX part 170 through the second signal lines SL2_1 to SL2_k.

The first signal lines SL1_1 to SL1_k and the second signal lines SL2_1 to SL2_k are positioned (e.g., disposed) to correspond to each other. The first data voltages provided through the first signal lines SL1_1 to SL1_k may have polarities opposite to those of the second data voltages provided through the second signal lines SL2_1 to SL2_k. That is, each of the first data voltages may have an opposite polarity to that of a corresponding second data voltage of the second data voltages.

The first DEMUX part 150 may be positioned (e.g., disposed) between the display panel 110 and the first data driver 140. The first DEMUX part 150 selectively couples (e.g., connects) the first signal lines SL1_1 to SL1_k to the data lines DL1 to DLm in response to the first and second DEMUX signals DMS1 and DMS2. The first data voltages are applied to the pixels of the display panel 110 through the data lines DL1 to DLm coupled to the first signal lines SL1_1 to SL1_k.

The second DEMUX part 170 may be positioned between the display panel 110 and the second data driver 160. The second DEMUX part 170 couples the second signal lines SL2_1 to SL2_k to the data lines DL1 to DLm that are not coupled to the first signal lines SL1_1 to SL1_k in response to the first and second DEMUX signals DMS1 and DMS2. The second data voltages are applied to the pixels of the display panel 110 through the data lines DL1 to DLm coupled to the second signal lines SL2_1 to SL2_k.

Figure 2:
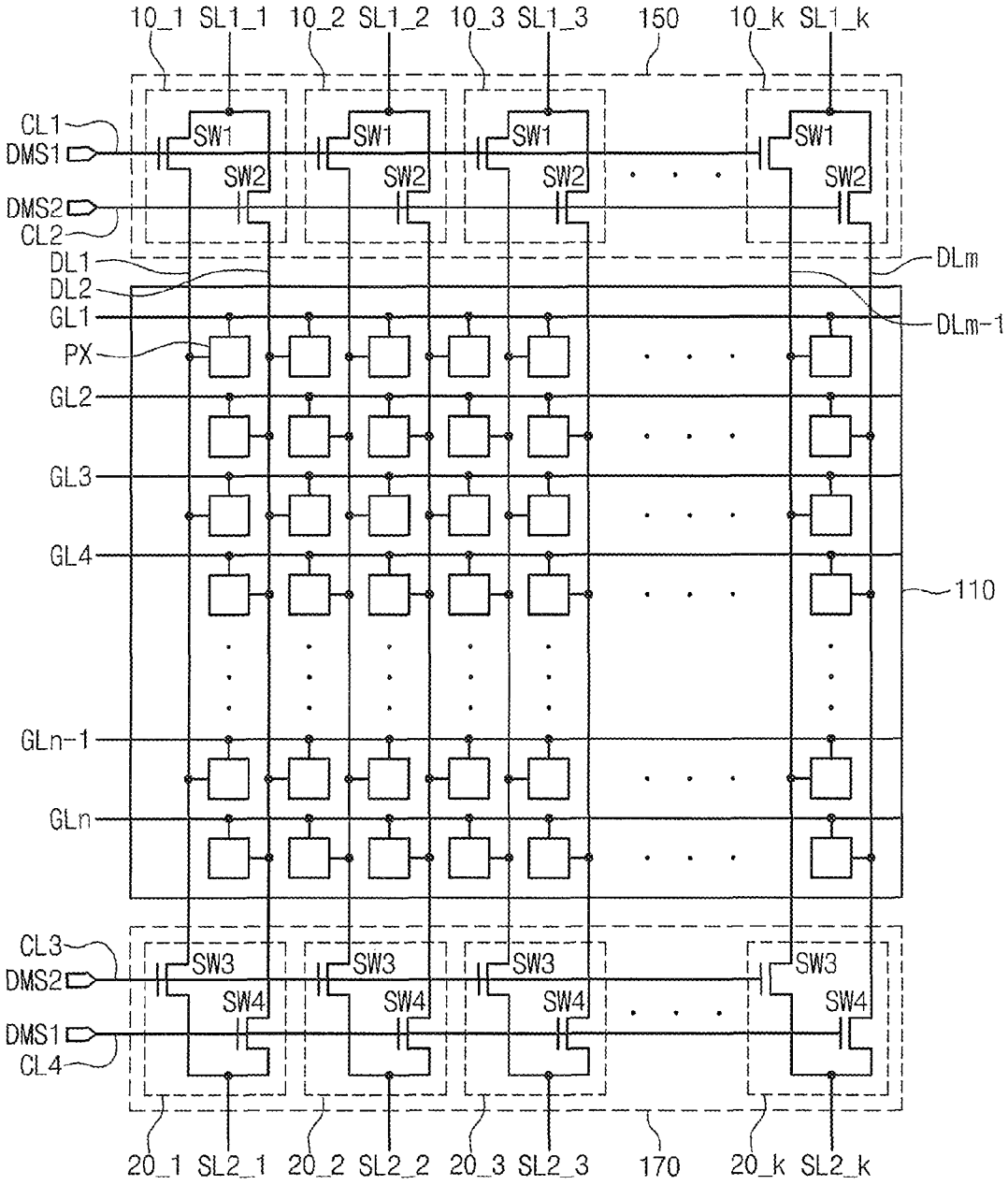
FIG. 2 is a circuit diagram showing first and second DEMUX units and a display panel according to the embodiment shown in FIG. 1.

FIG. 2 is a circuit diagram showing the first and second DEMUX units and the display panel according to the embodiment shown in FIG. 1.

Referring to FIG. 2, the display panel 110 includes the pixels PX arranged in a matrix form, the gate lines GL1 to GLn coupled to the pixels PX, and the data lines DL1 to DLm coupled to the pixels PX.

The gate lines GL1 to GLn may extend in a row direction and are coupled to the pixels PX arranged in the unit of a row. The gate lines GL1 to GLn include first gate lines GL1, GL3, . . . , GLn−1 corresponding to odd-numbered gate lines GL1, GL3, . . . , GLn−1, and second gate lines GL2, GL4, . . . , GLn corresponding to even-numbered gate lines GL2, GL4, . . . , GLn. The data lines DL1 to DLm are positioned to cross the gate lines GL1 to GLn.

Each of the pixels PX is coupled (e.g., connected) to a respective gate line of the gate lines GL1 to GLn and a respective data line of the data lines DL1 to DLm. The pixels PX are alternately coupled to the data lines DL1 to DLm in the unit of a row.

For example, the pixels PX coupled to the first gate lines GL1, GL3, . . . , GLn−1 are coupled to the data lines of the data lines DL1 to DLm that are positioned adjacent to a left side of the respective pixels. The pixels PX connected to the second gate lines GL2, GL4, . . . , GLn are connected to the data lines of the data lines DL1 to DLm that are disposed adjacent to a right side of the respective pixels.

The pixels PX receive the first and second data voltages through the data lines DL1 to DLm in response to the gate signals provided through the gate lines GL1 to GLn. The pixels PX display gray scales according to (e.g., corresponding to) the received first and second data voltages.

The data lines DL1 to DLm include first data lines DL1, DL3, . . . , DLm−1 corresponding to odd-numbered data lines DL1, DL3, . . . , DLm−1, and second data lines DL2, DL4, . . . , DLm corresponding to even-numbered data lines DL2, DL4, . . . , DLm.

The first DEMUX part 150 includes a plurality of first DEMUX units 10_1 to 10_*k*, each of the first DEMUX units coupled to a respective first signal line of the first signals lines SL1_1 to SL1_*k*, and a pair of first and second data lines DL1 to DLm.

The first DEMUX units 10_1 to 10_*k* selectively couple the first signal lines SL1_1 to SL1_*k* to the first data lines DL1, DL3, . . . , DLm−1 and the second data lines DL2, DL4, . . . , DLm, in response to the first and second DEMUX signals DMS1 and DMS2.

The second DEMUX part 170 may be positioned to face the first DEMUX part 150, with the pixels PX positioned between the first and second DEMUX parts 150 and 170. The second DEMUX part 170 includes a plurality of second DEMUX units 20_1 to 20_*k*, each of the second DEMUX units coupled to a respective second signal line of the second signal lines SL2_1 to SL2_*k*, and a pair of first and second data lines DL1 to DLm. The second DEMUX units 20_1 to 20_*k* are positioned to respectively correspond to the first DEMUX units 10_1 to 10_*k*.

The second DEMUX units 20_1 to 20_*k* selectively couple the second signal lines SL2_1 to SL2_*k* to the first data lines DL1, DL3, . . . , DLm−1 and the second data lines DL2, DL4, . . . , DLm, in response to the first and second DEMUX signals DMS1 and DMS2.

In addition, the second DEMUX units 20_1 to 20_*k* couple the second signal lines SL2_1 to SL2_*k* to the first and second data lines DL1 to DLm not coupled to the first signal lines SL1_1 to SL1_*k*. For example, when the first signal line SL1_1 is coupled to the first data line DL1 by the first DEMUX unit 10_1, the second signal line SL2_1 is coupled to the second data line DL2 by the second DEMUX unit 20_1 corresponding to the first DEMUX unit 10_1.

Each of the first DEMUX units 10_1 to 10_*k* includes a first switching device SW1 coupled to (e.g., connected to) a first control line CL1, and a second switching device SW2 coupled to a second control line CL2.

The first switching devices SW1 are switched in response to the first DEMUX signal DMS1 provided through the first control line CL1. The second switching devices SW2 are switched in response to the second DEMUX signal DMS2 provided through the second control line CL2.

The first switching devices SW1 may be configured to couple the first signal lines SL1_1 to SL1_*k* to the first data lines DL1, DL3, . . . , DLm−1, respectively, in response to the first DEMUX signal DMS1. The first data voltages are applied to the pixels PX coupled to the first data lines DL1, DL3, . . . , DLm−1 through the first signal lines SL1_1 to SL1_*k* and the first data lines DL1, DL3, . . . , DLm−1 coupled to the first signal lines SL1_1 to SL1_*k*.

The second switching devices SW2 may be configured to couple the first signal lines SL1_1 to SL1_*k* to the second data lines DL2, DL4, . . . , DLm, respectively, in response to the second DEMUX signal DMS2. The first data voltages are applied to the pixels PX coupled to the second data lines DL2, DL4, . . . , DLm through the first signal lines SL1_1 to SL1_*k* and the second data lines DL2, DL4, . . . , DLm coupled to the first signal lines SL1_1 to SL1_*k*.

Each of the second DEMUX units 20_1 to 20_*k* includes a third switching device SW3 coupled to a third control line CL3, and a fourth switching device SW4 coupled to a fourth control line CL4.

The third switching devices SW2 are switched in response to the second DEMUX signal DMS2 provided through the third control line CL3. The fourth switching devices SW4 are switched in response to the first DEMUX signal DMS1 provided through the fourth control line CL4.

The third switching devices SW3 may be configured to couple the second signal lines SL2_1 to SL2_*k* to the first data lines DL1, DL3, . . . , DLm−1, respectively, in response to the second DEMUX signal DMS2. The second data voltages are applied to the pixels PX coupled to the first data lines DL1, DL3, . . . , DLm−1 through the second signal lines SL2_1 to SL2_*k* and the first data lines DL1, DL3, . . . , DLm−1 coupled to the second signal lines SL2_1 to SL2_*k*.

The fourth switching devices SW4 may be configured to couple the second signal lines SL2_1 to SL2_*k* to the second data lines DL2, DL4, . . . , DLm, respectively, in response to the first DEMUX signal DMS1. The second data voltages are applied to the pixels PX coupled to the second data lines DL2, DL4, . . . , DLm through the second signal lines SL2_1 to SL2_*k* and the second data lines DL2, DL4, . . . , DLm coupled to the second signal lines SL2_1 to SL2_*k*.

Figure 3:
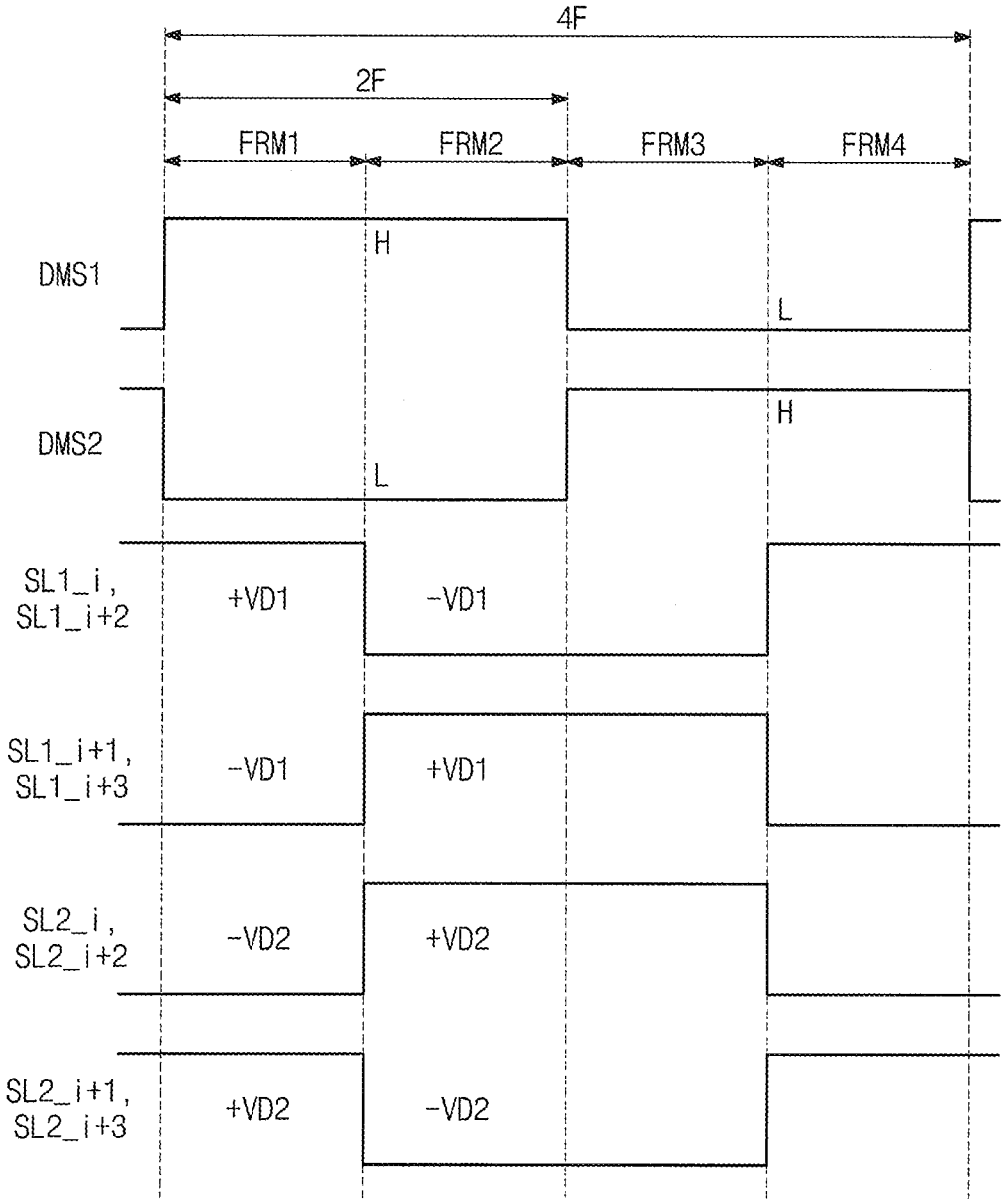
FIG. 3 is a signal timing diagram showing an operation of pixels shown in FIG. 2.

FIG. 3 is a signal timing diagram showing the operation of the pixels shown in FIG. 2.

For convenience of explanation, FIG. 3 shows signal timings of the first and second DEMUX signals DMS1 and DMS2 and the first and second data voltages VD1 and VD2 in first to fourth frames FRM1 to FRM4. However, signals of the first to fourth frames FRM1 to FRM4 may be sequentially and repeatedly applied to the first and second DEMUX parts 150 and 170 and the pixels PX. One frame corresponds to a time period in which the pixels PX of the display panel 110 display one image.

Referring to FIG. 3, the first DEMUX signal DMS1 has a period corresponding to 4N times of one frame and is activated during a period 2N times greater than the one frame. Here, "N" is an integer greater than zero (0). For example, the first DEMUX signal DMS1 has a period corresponding to four frame periods 4F and is activated during two frame periods 2F.

For example, the first DEMUX signal DMS1 has an activated high level H in the first and second frames FRM1 and FRM2, and a low level L in the third and fourth frames FRM3 and FRM4. The second DEMUX signal DMS2 has the same period as the first DEMUX signal DMS1, but with an opposite phase to that of the first DEMUX signal DMS1.

The first data voltage VD1 includes a positive first data voltage +VD1 and a negative first data voltage −VD1. The second data voltage VD2 includes a positive second data voltage +VD2 and a negative second data voltage −VD2.

The first signal lines SL1_*i* to SL1_*i*+3 receive the positive and negative first data voltages +VD1 and −VD1 in each of the first to fourth frames FRM1 to FRM4. The second signal lines SL2_*i* to SL2_*i*+3 receive the positive and negative second data voltages +VD2 and −VD2 in each of the first to fourth frames FRM1 to FRM4. Here, "i" is an integer number greater than "0" and less than "k−3."

Hereinafter, among the first signal lines SL1_*i* to SL1_*i*+3, first i-th and first (i+2)th signal lines SL1_*i* and SL1_*i*+2, are referred to as odd-numbered first signals lines SL1_*i* and SL1_*i*+2, and first (i+1)th and first (i+3)th signal lines SL1_i+1 and SL1_i+3, are referred to as even-numbered first signal lines SL1_i and SL1_i+3.

Among the second signal lines SL2_i to SL2_i+3, second i-th and second (i+2)th signal lines SL2_i and SL2_i+2, are referred to as odd-numbered second signals lines SL2_i and SL2_i+2, and second (i+1)th and second (i+3)th signal lines SL2_i+1 and SL2_i+3, are referred to as even-numbered second signal lines SL2_i+1 and SL2_i+3.

The first data voltages VD1 applied to the odd-numbered first signal lines SL1_i and SL1_i+2 in the first and fourth frames FRM1 and FRM4 may have the same polarity. The first data voltages VD1 applied to the odd-numbered first signal lines SL1_i and SL1_i+2 in the first and fourth frames FRM1 and FRM4 may have the opposite polarity to that of the first data voltages VD1 applied to the odd-numbered first signal lines SL1_i and SL1_i+2 in the second and third frames FRM2 and FRM3.

For example, the positive first data voltages +VD1 are applied to the odd-numbered first signal lines SL1_i and SL1_i+2 in the first and fourth frames FRM1 and FRM4, and the negative first data voltages −VD1 are applied to the odd-numbered first signal lines SL1_i and SL1_i+2 in the second and third frames FRM2 and FRM3.

In each of the first to fourth frames FRM1 to FRM4, the first data voltages VD1 applied to the odd-numbered first signal lines SL1_i and SL1_i+2 may have the opposite polarity to that of the first data voltages VD1 applied to the even-numbered first signal lines SL1_i+1 and SL1_i+3. For example, during the first frame FRM1, the positive first data voltages +VD1 are applied to the odd-numbered first signal lines SL1_i and SL1_i+2 and the negative data voltages −VD1 are applied to the even-numbered first signal lines SL1_i+1 and SL1_i+3.

In each of the first to fourth frames FRM1 to FRM4, the first data voltages VD1 applied to the first signals lines SL1_i to SL1_i+3 may have the opposite polarity to that of the second data voltages VD2 applied to the second signal lines SL2_i to SL2_i+3 corresponding to the first signal lines SL1_i to SL1_i+3.

Figure 4A:
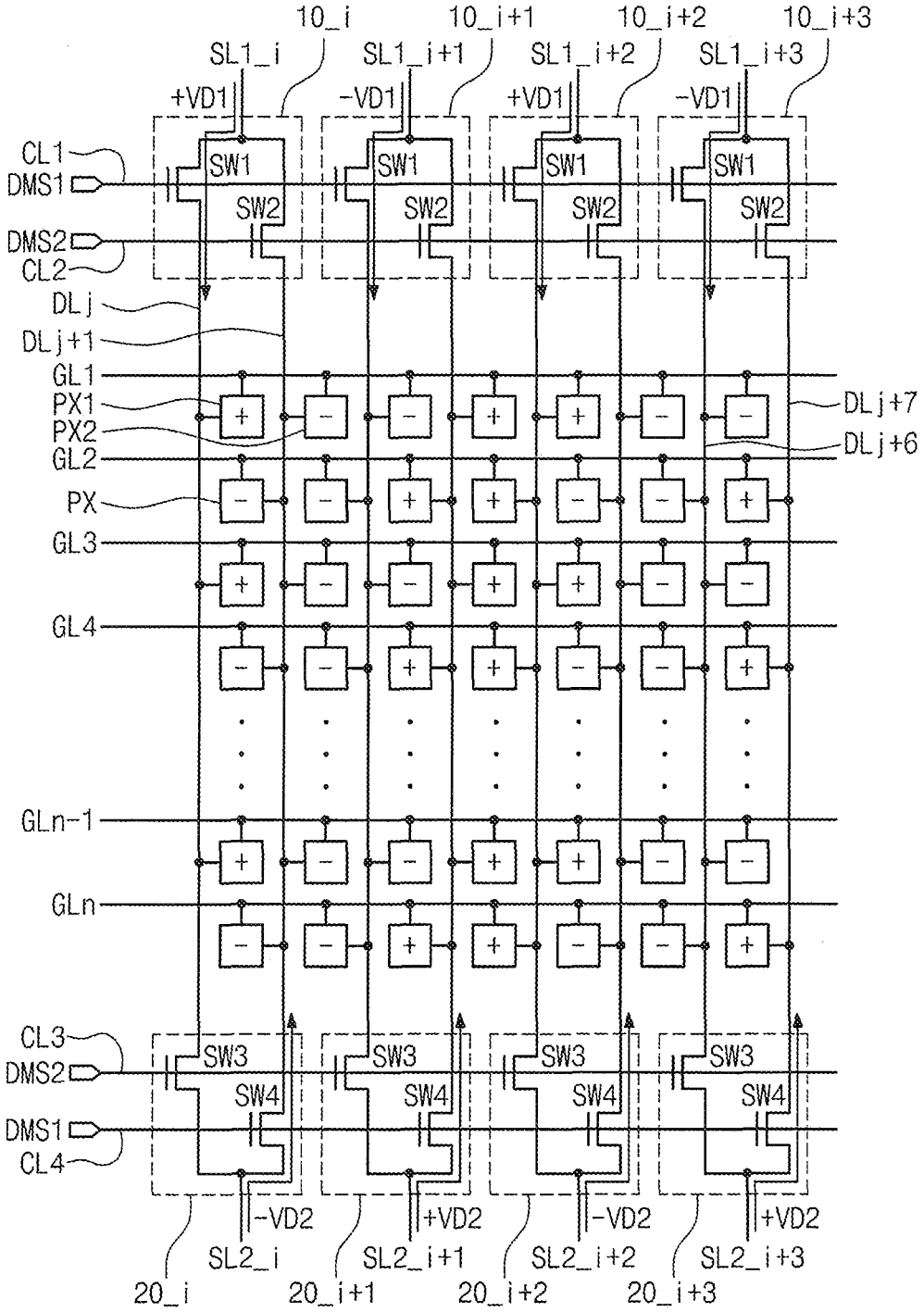
FIG. 4A is a circuit diagram showing an operation state of the pixels in a first frame shown in FIG. 3.
Figure 4B:
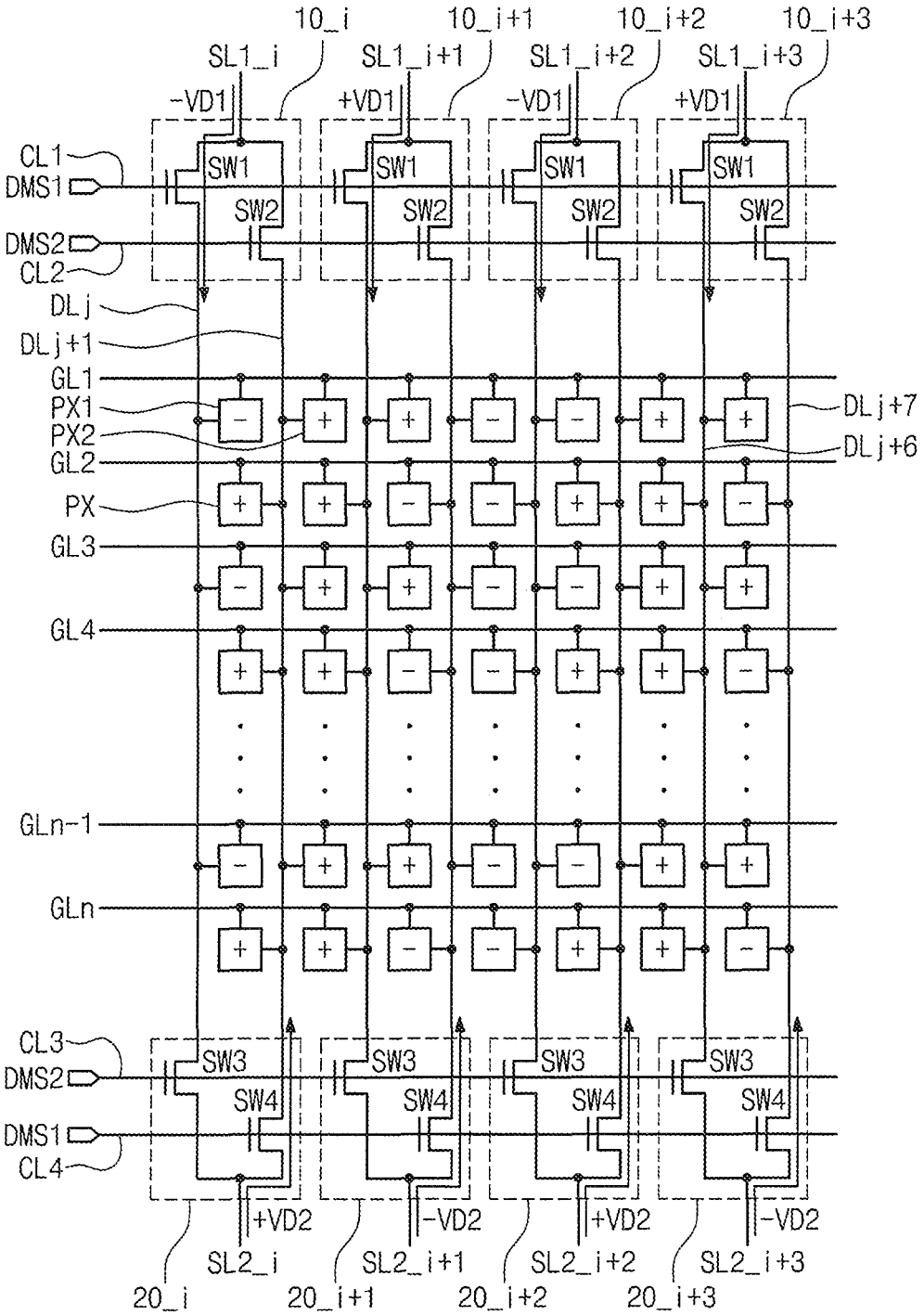
FIG. 4B is a circuit diagram showing an operation state of the pixels in a second frame shown in FIG. 3.
Figure 4C:
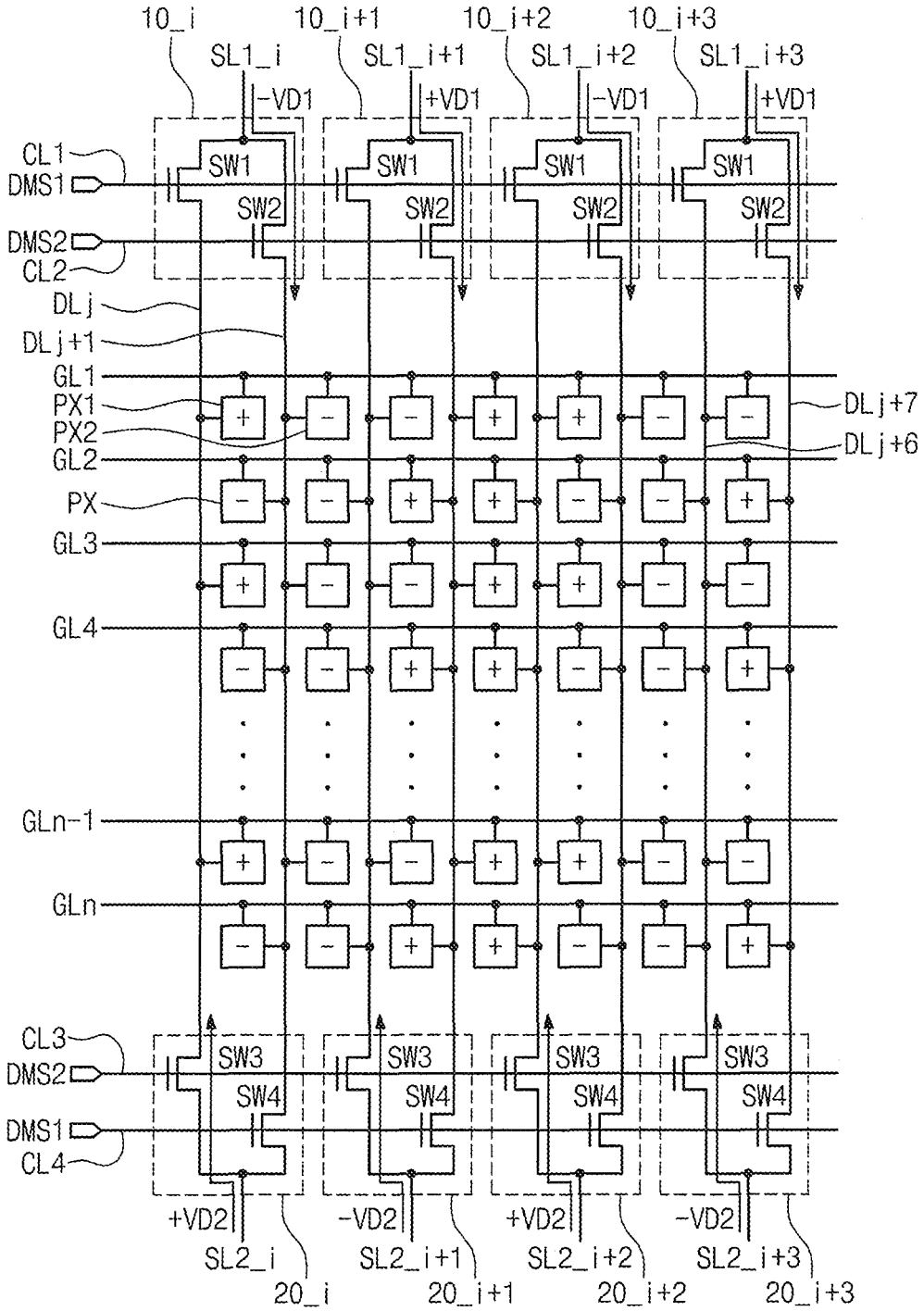
FIG. 4C is a circuit diagram showing an operation state of the pixels in a third frame shown in FIG. 3.
Figure 4D:
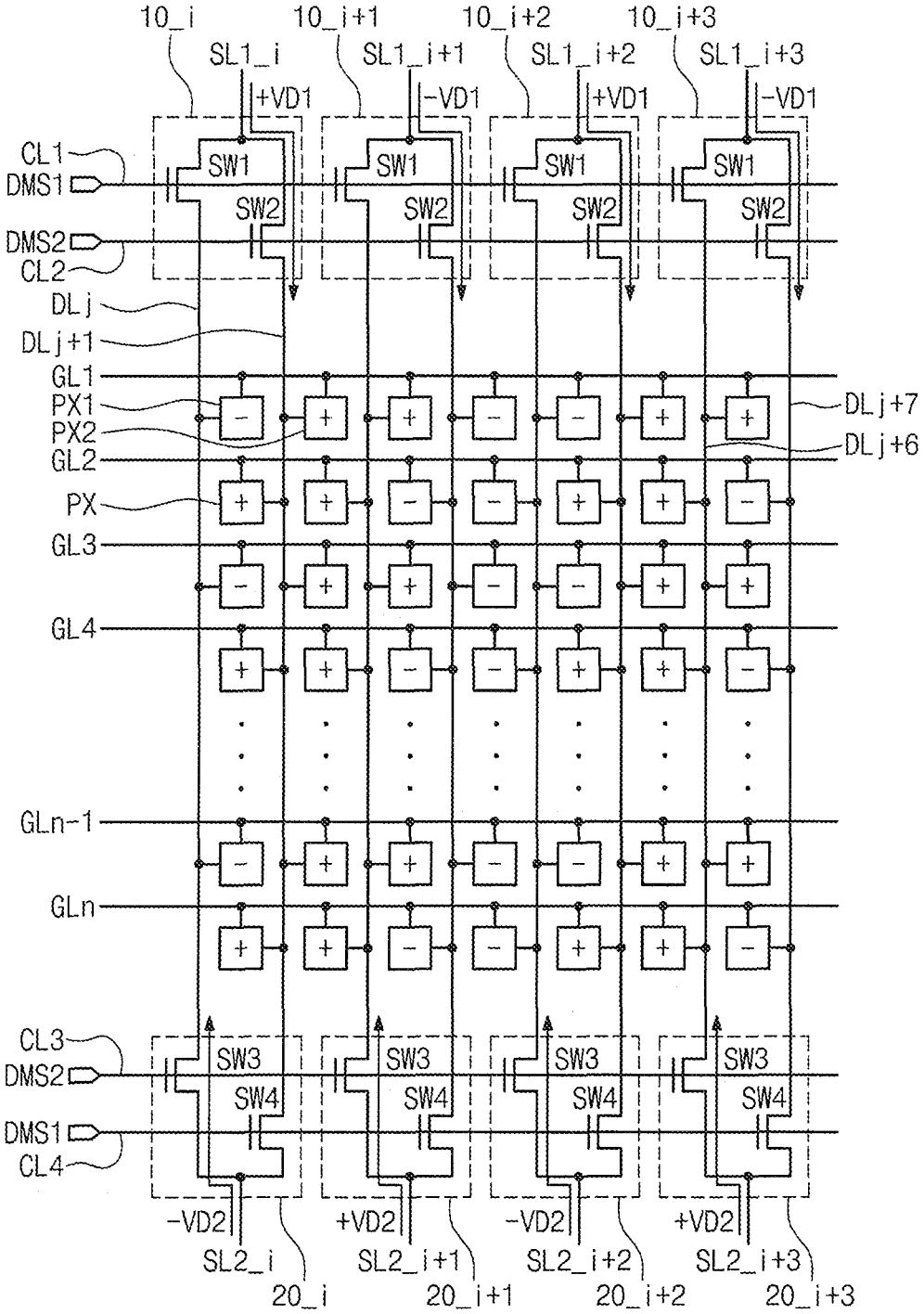
FIG. 4D is a circuit diagram showing an operation state of the pixels in a fourth frame shown in FIG. 3.

FIG. 4A is a circuit diagram showing the operation state of the pixels in the first frame shown in FIG. 3, FIG. 4B is a circuit diagram showing the operation state of the pixels in the second frame shown in FIG. 3, FIG. 4C is a circuit diagram showing the operation state of the pixels in the third frame shown in FIG. 3, and FIG. 4D is a circuit diagram showing the operation state of the pixels in the fourth frame shown in FIG. 3.

For convenience of explanation, pixels PX arranged in seven columns have been shown in FIGS. 4A to 4D. That is, the pixels PX shown in FIGS. 4A to 4D are coupled to (e.g., connected to) the gate lines GL1 to GLn and eight data lines DLj to DLj+7. Here, "j" is an odd integer greater than "0" and less than "m−7." However, embodiments of the present invention are not limited thereto, for example, there may be more or less pixel columns and data lines.

In addition, among the data lines DLj to DLj+7 shown in FIGS. 4A to 4D, odd-numbered data lines DLj, DLj+2, DLj+4, and DLj+6 are referred to as first data lines DLj, DLj+2, DLj+4, and DLj+6, and even-numbered data lines DLj+1, DLj+3, DLj+5, and DLj+7 are referred to as second data lines DLj+1, DLj+3, DLj+5, and DLj+7.

Referring to FIG. 4A, the odd-numbered first signal lines SL1_i and SL1_i+2 receive the positive first data voltages +VD1 during the first frame FRM1, and the even-numbered first signal lines SL1_i+1 and SL1_i+3 receive the negative first data voltages −VD1 during the first frame FRM1.

During the first frame FRM1, the odd-numbered second signal lines SL2_i and SL2_i+2 receive the negative second data voltages −VD2, and the even-numbered second signal lines SL2_i+1 and SL2_i+3 receive the positive second data voltages +VD2.

The first switching devices SW1 may be configured to receive the first data voltages VD1 in response to the first DEMUX signal DMS1, to apply the first data voltages VD1 to the pixels PX coupled to the first data lines DLj, DLj+2, DLj+4, and DLj+6.

For example, the first switching devices SW1 of the first DEMUX units 10_i to 10_i+3 couple the first signal lines SL1_i to SL1_i+3 to the first data lines DLj, DLj+2, DLj+4, and DLj+6, in response to the first DEMUX signal DMS1 having a high level H. Accordingly, the positive and negative first data voltages +VD1 and −VD1 are applied to the pixels PX coupled to the first data lines DLj, DLj+2, DLj+4, and DLj+6.

The fourth switching devices SW4 may be configured to receive the second data voltages VD2 in response to the first DEMUX signal DMS1, to apply the second data voltages VD2 to the pixels PX coupled to the second data lines DLj+1, DLj+3, DLj+5, and DLj+7.

For example, the fourth switching devices SW4 of the second DEMUX units 20_i to 20_i+3 couple the second signal lines SL2_i to SL2_i+3 to the second data lines DLj+1, DLj+3, DLj+5, and DLj+7, in response to the first DEMUX signal DMS1 having the high level H. That is, the second signal lines SL2_i to SL2_i+3 are coupled to the second data lines DLj+1, DLj+3, DLj+5, and DLj+7 that are not coupled to the first signal lines SL1_i to SL1_i+3. Therefore, the negative and positive second data voltages −VD2 and +VD2 are applied to the pixels PX coupled to the second data lines DLj+1, DLj+3, DLj+5, and DLj+7.

The pixels PX are charged with positive (+) and negative (−) voltages according to the polarity of the first and second data voltages VD1 and VD2 as shown in the embodiment of FIG. 4A.

The pixels PX positioned (e.g., arranged) in the row direction may be driven by a two-dot inversion driving method (e.g., +, −, −, +, +). In addition, the pixels PX positioned in the odd-numbered columns may be driven by a one-dot inversion driving method (e.g., +, −, +, −,) along the column direction, and the polarity of the pixels PX may be inverted in each odd-numbered column. Among the pixels PX positioned in the even-numbered columns, the pixels PX positioned in the same column may have the same polarity, and the polarity of the pixels PX may be inverted in each even-numbered column.

Referring to FIG. 4B, the polarity of the first and second data voltages VD1 and VD2 is inverted in a different way in the second frame FRM2 when compared to that of the first and second data voltages VD1 and V2 in the first frame FRM1. In the second frame FRM2, the first and second DEMUX signals DMS1 and DMS2 respectively have the same phase as that of the first and second DEMUX signals DMS1 and DMS2 in the first frame FRM1.

Thus, the first data voltages VD1 are applied to the pixels PX coupled to the first data lines DLj, DLj+2, DLj+4, and DLj+6. In addition, the second data voltages VD2 are applied to the pixels PX coupled to the second data lines DLj+1, DLj+3, DLj+5, and DLj+7.

The polarity of the voltages charged in the pixels PX during the second frame FRM2 may be opposite to that of the voltages charged in the pixels PX during the first frame FRM1 as shown in FIG. 4B.

Referring to FIG. 4C, the first and second data voltages VD1 and VD2 in the third frame FRM3 respectively have the same polarity as that of the first and second data voltages VD1 and VD2 in the second frame FRM2. In the third frame FRM3, the phase of the first and second DEMUX signals DMS1 and DMS2 is inverted in a different way from that of the first and second DEMUX signals DMS1 and DMS2 in the second frame FRM2.

The second switching device SW2 may be configured to receive the first data voltages VD1 in response to the second DEMUX signal DMS2, to apply the first data voltages VD1 to the pixels PX coupled to the second data lines DLj+1, DLj+3, DLj+5, and DLj+7.

For example, the second switching devices SW2 of the first DEMUX units 10_*i* to 10_*i*+3 couple the first signal lines SL1_*i* to SL1_*i*+3 to the second data lines DLj+1, DLj+3, DLj+5, and DLj+7, in response to the second DEMUX signal DMS2 having the high level H. Accordingly, the positive and negative first data voltages +VD1 and −VD1 are applied to the pixels PX coupled to (e.g., connected to) the second data lines DLj+1, DLj+3, DLj+5, and DLj+7.

The third switching devices SW3 may be configured to receive the second data voltages VD2 in response to the second DEMUX signal DMS2, to apply the second data voltages VD2 to the pixels PX coupled to the first data lines DLj, DLj+2, DLj+4, and DLj+6.

For example, the third switching devices SW3 of the second DEMUX units 20_*i* to 20_*i*+3 couple the second signal lines SL2_*i* to SL2_*i*+3 to the first data lines DLj, DLj+2, DLj+4, and DLj+6, in response to the second DEMUX signal DMS2 having the high level H. That is, the second signal lines SL2_*i* to SL2_*i*+3 are coupled to the first data lines DLj, DLj+2, DLj+4, and DLj+6 that are not coupled to the first signal lines SL1_*i* to SL1_*i*+3. Therefore, the positive and negative second data voltages −VD2 and +VD2 are applied to the pixels PX coupled to the first data lines DLj, DLj+2, DLj+4, and DLj+6.

The polarity of the voltages charged in the pixels PX during the third frame FRM3 may be opposite to that of the voltages charged in the pixels PX during the second frame FRM2 as shown in FIG. 4C.

Referring to FIG. 4D, the polarity of the first and second data voltages VD1 and VD2 is inverted in a different way during the fourth frame FRM4 when compared to that of the first and second data voltages VD1 and V2 in the third frame FRM3. In the fourth frame FRM4, the first and second DEMUX signals DMS1 and DMS2 respectively have the same phase as that of first and second DEMUX signals DMS1 and DMS2 in the third frame FRM3.

The positive and negative first data voltages +VD1 and −VD1 may be applied to the pixels PX coupled to the second data lines DLj+1, DLj+3, DLj+5, and DLj+7 by the second switching device SW2. In addition, the negative and positive second data voltages −VD2 and +VD2 may be applied to the pixels PX coupled to the first data lines DLj, DLj+2, DLj+4, and DLj+6 by the third switching device SW3.

The polarity of the voltages charged in the pixels PX during the fourth frame FRM4 may be opposite to that of the voltages charged in the pixels PX during the third frame FRM3 as shown in FIG. 4D.

When the data voltages having the same polarity are applied to the pixels PX during each frame, the display panel may be degraded. However, because the display apparatus 100 according to an embodiment of the present invention inverts the polarity of the pixels PX during each frame, the display panel 110 may be substantially prevented from being degraded.

Figure 5A:
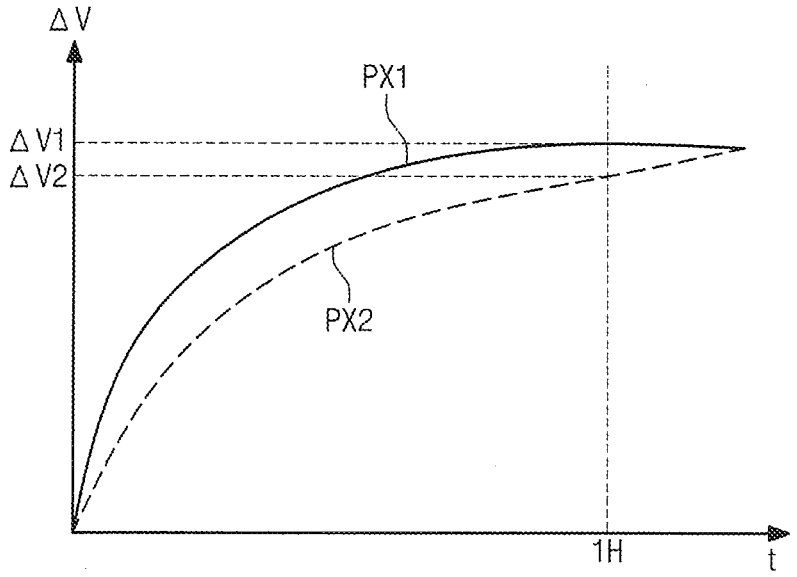
FIG. 5A is a graph showing a charge voltage of first and second pixels shown in FIG. 4A.
Figure 5B:
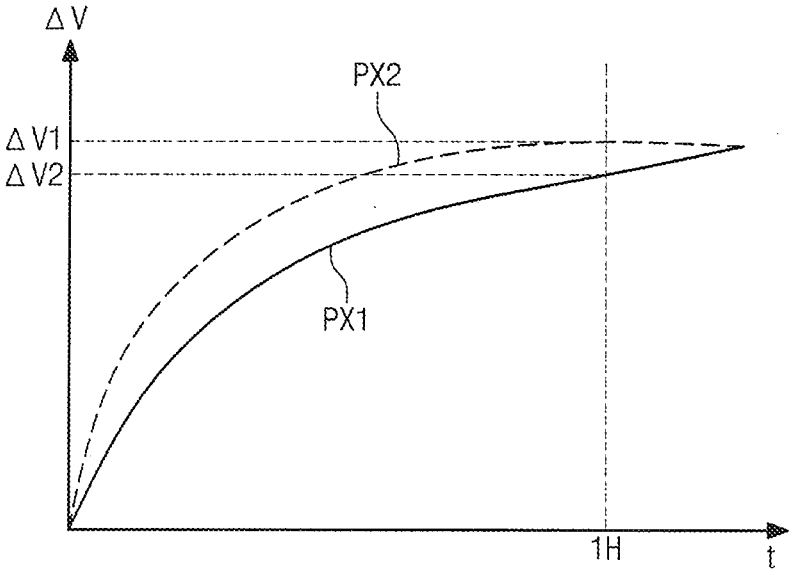
FIG. 5B is a graph showing a charge voltage of first and second pixels shown in FIG. 4C.

FIG. 5A is a graph showing the charge voltage of the first and second pixels shown in FIG. 4A, and FIG. 5B is a graph showing the charge voltage of the first and second pixels shown in FIG. 4C.

Referring to FIG. 5A, the positive first data voltage +VD1 is applied to the first pixel PX1 from the upper portion of the first data line DLj through the first data line DLj. In addition, the negative second data voltage −VD2 is applied to the second pixel PX2 from the lower portion of the second data line DLj+1 through the second data line DLj+1.

A first voltage ΔV1 is defined by a level (or an absolute value) of the positive first data voltage +VD1 and the negative second data voltage −VD2. A second voltage ΔV2 indicates the absolute value of a voltage having a level less than that of the first voltage ΔV1.

The data lines DLj to DLj+7 may have a resistance component. Due to the resistance component, a signal delay may occur in the data fines. As the distance between a position at which the data voltage is applied and the position of the pixels PX increases, the signal delay in the data line may be intensified. That is, the signal delay in the data lines may intensify as the signal travels to the upper portion of the second data line DLj+1.

In this case, the first pixel PX1 is charged with the first voltage ΔV1 in the first frame FRM1. The second pixel PX2 is charged with the second voltage ΔV2 having the level smaller than that of the first voltage ΔV1 due to the signal delay in the data lines.

During the second frame FRM2, the first pixel PX1 may be charged with the first voltage ΔV1, and the second pixel PX2 may be charged with the second voltage ΔV2. Although the charge voltage of the first and second pixels PX1 and PX2 has been described as an example, other pixels may be charged with the voltage having the level different from that of the first voltage ΔV1 due to the signal delay in the data lines.

Referring to FIG. 5B, the negative first data voltage −VD1 is applied to the second pixel PX2 through the second data line DLj+1 from the upper portion of the second data line DLj+1. In addition, the positive second data voltage +VD2 is applied to the first pixel PX1 through the first data line DLj from the lower portion of the first data line DLj.

In this case, the first pixel PX1 is charged with the second voltage ΔV2 during the third frame FRM3 due to the signal delay in the data line. The second pixel PX2 is charged with the first voltage ΔV1 during the third frame FRM3. During the fourth frame FRM4, the first pixel PX1 is charged with the second voltage ΔV2 and the second pixel PX2 is charged with the first voltage ΔV1.

The first pixel PX1 and the second pixel PX2 may be repeatedly (e.g., continuously) charged with the first voltage ΔV1 and the second voltage ΔV2, respectively, in each frame without using (e.g., utilizing) the first and second DEMUX parts 150 and 170. The image provided to a viewer runs at 60 frames per second, and thus the viewer may recognize a difference in brightness between the first and second pixel PX1 and PX2 adjacent to each other. Due to the signal delay in the data lines, this phenomenon is recognized by the viewer in the unit of a column. Consequently, a vertical line, which may be visible to the viewer, may occur.

In the display apparatus 100 according to an embodiment of the present invention, however, the first and second pixels PX1 and PX2 are alternately charged with the first and second voltages ΔV1 and ΔV2 in every two frames. Thus, when the image provided to the viewer runs at 60 frames per second, the viewer may recognize the brightness corresponding to an intermediate value (or an average value) between the first and second voltages ΔV1 and ΔV2 in the first pixel PX1. In addition, the viewer may recognize the brightness corresponding to an intermediate value (or an average value) between the first and second voltages ΔV1 and ΔV2 in the second pixel PX2.

That is, when the image corresponding to two or more frames is provided to the viewer, the viewer may recognize the brightness corresponding to the average value between the first and second voltages ΔV1 and ΔV2 in the first and second pixels PX1 and PX2. As a result, the difference in brightness between the first pixel PX1 and the second pixel PX2 is reduced, and thus, the vertical line, which may be recognized by the viewer, may be substantially prevented from occurring.

In the present embodiment, the brightness of the first and second pixels PX1 and PX2 has been described as an example, but embodiments of the present invention are not limited thereto, and the brightness difference may be reduced in other pixels PX. Accordingly, the vertical line which may be recognized by the viewer may be substantially prevented from occurring.

Consequently, the display apparatus 100 according to the first embodiment of the present invention may substantially prevent the vertical line from occurring.

Figure 6:
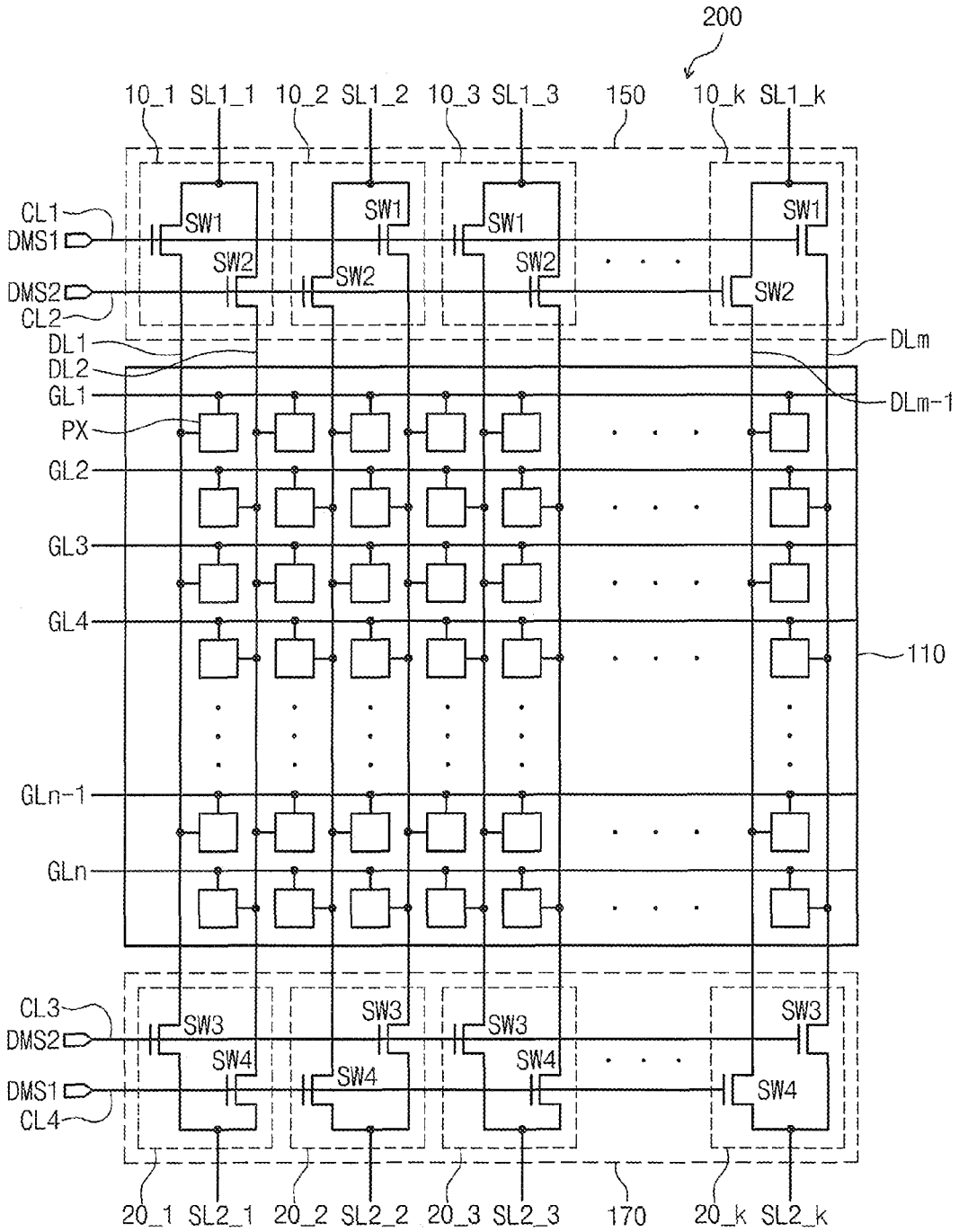
FIG. 6 is a circuit diagram showing a display apparatus according to a second embodiment of the present disclosure.

FIG. 6 is a circuit diagram showing a display apparatus 200 according to a second embodiment of the present disclosure. The display apparatus 200 has a substantially similar configuration and function as those of the display apparatus 100 shown in FIGS. 1 and 2, except for the first and second DEMUX parts. Therefore, the description of the substantially similar portions thereof have been omitted.

Referring to FIG. 6, each of the first DEMUX units 10_1 to **10_*k* includes a first switching device SW1 coupled to (e.g., connected to) a first control line CL1, and a second switching device SW2 coupled to a second control line CL2. Each of second DEMUX units 20_1 to 20_*k* includes a third switching device SW3 coupled to a third control line CL3 and a fourth switching device SW4 coupled to a fourth control line CL4**.

The first and fourth switching devices SW1 and SW4 are switched in response to the first DEMUX signal DMS1 provided through the first and fourth control lines CL1 and CL4. The second and third switching devices SW2 and SW3 are switched in response to the second DEMUX signal DMS2 provided through the second and third control lines CL2 and CL3.

The first switching devices SW1 may selectively and alternately couple the first signal lines SL1_1 to SL**1_*k* to odd-numbered first data lines DL1, DL5, . . . , DLm−3 of the first data lines DL1, DL3, . . . , DLm−1, and to even-numbered second data lines DL4, DL8, . . . , DLm of the second data lines DL2, DL4, . . . , DLm, in response to the first DEMUX signal DMS1**.

For example, the first switching devices SW1 of odd-numbered first DEMUX units 10_1, 10_3, . . . , **10_*k*−1 couple the odd-numbered first signal lines SL1_1, SL1_3, . . . , SL1_*k*−1 to the odd-numbered first data lines DL1, DL5, . . . , DLm−3 of the first data lines DL1, DL3, . . . , DLm−1, in response to the first DEMUX signal DMS1**.

The first switching devices SW1 of even-numbered first DEMUX units 10_2, 10_4, . . . , **10_*k* couple the even-numbered first signal lines SL1_2, SL1_4, . . . , SL1_*k* to the even-numbered second data lines DL4, DL8, . . . , DLm of the second data lines DL2, DL4, . . . , DLm, in response to the first DEMUX signal DMS1**.

The second switching devices SW2 may selectively and alternately couple the first signal lines SL1_1 to SL**1_*k* to odd-numbered second data lines DL2, DL6, . . . , DLm−2 of the second data lines DL2, DL4, . . . , DLm, and to even-numbered first data lines DL3, DL7, . . . , DLm−1 of the first data lines DL1, DL3, . . . , DLm−1, in response to the second DEMUX signal DMS2**.

For example, the second switching devices SW2 of odd-numbered first DEMUX units 10_1, 10_3, . . . , **10_*k*−1 couple the odd-numbered first signal lines SL1_1, SL1_3, . . . , SL1_*k*−1 to the odd-numbered second data lines DL2, DL6, . . . , DLm−2 of the second data lines DL2, DL4, . . . , DLm, in response to the second DEMUX signal DMS2**.

The second switching devices SW2 of even-numbered first DEMUX units 10_2, 10_4, . . . , **10_*k* couple the even-numbered first signal lines SL1_2, SL1_4, . . . , SL1_*k* to the even-numbered first data lines DL3, DL7, . . . , DLm−1 of the first data lines DL1, DL3, . . . , DLm−1, in response to the second DEMUX signal DMS2**.

The third switching devices SW3 may selectively and alternately couple the second signal lines SL2_1 to SL**2_*k* to the odd-numbered first data lines DL1, DL5, . . . , DLm−3 of the first data lines DL1, DL3, . . . , DLm−1, and to the even-numbered second data lines DL4, DL8, . . . , DLm of the second data lines DL2, DL4, . . . , DLm, in response to the second DEMUX signal DMS2**.

For example, the third switching devices SW3 of odd-numbered second DEMUX units 20_1, 20_3, . . . , **20_*k*−1 couple the odd-numbered second signal lines SL2_1, SL2_3, . . . , SL2_*k*−1 to the odd-numbered first data lines DL1, DL5, . . . , DLm−3 of the first data lines DL1, DL3, . . . , DLm−1, in response to the second DEMUX signal DMS2**.

The third switching devices SW3 of even-numbered second DEMUX units 20_2, 20_4, . . . , **20_*k* couple the even-numbered second signal lines SL2_2, SL2_4, . . . , SL2_*k* to the even-numbered second data lines DL4, DL8, . . . , DLm of the second data lines DL2, DL4, . . . , DLm, in response to the second DEMUX signal DMS2**.

The fourth switching devices SW4 may selectively and alternately couple the second signal lines SL2_1 to SL**2_*k* to odd-numbered second data lines DL2, DL6, . . . , DLm−2 of the second data lines DL2, DL4, . . . , DLm, and to even-numbered first data lines DL3, DL7, . . . , DLm−1 of the first data lines DL1, DL3, . . . , DLm−1, in response to the first DEMUX signal DMS1**.

For example, the fourth switching devices SW4 of odd-numbered second DEMUX units 20_1, 20_3, . . . , **20_*k*−1 couple the odd-numbered second signal lines SL2_1, SL2_3, . . . , SL2_*k*−1 to the odd-numbered second data lines DL2, DL6, . . . , DLm−2 of the second data lines DL2, DL4, . . . , DLm, in response to the first DEMUX signal DMS1**.

The fourth switching devices SW4 of even-numbered second DEMUX units 20_2, 20_4, . . . , **20_*k* couple the even-numbered second signal lines SL2_2, SL2_4, . . . , SL2_*k* to the even-numbered first data lines DL3, DL7, . . . , DLm−1 of the first data lines DL1, DL3, DLm−1, in response to the first DEMUX signal DMS1**.

Figure 7:
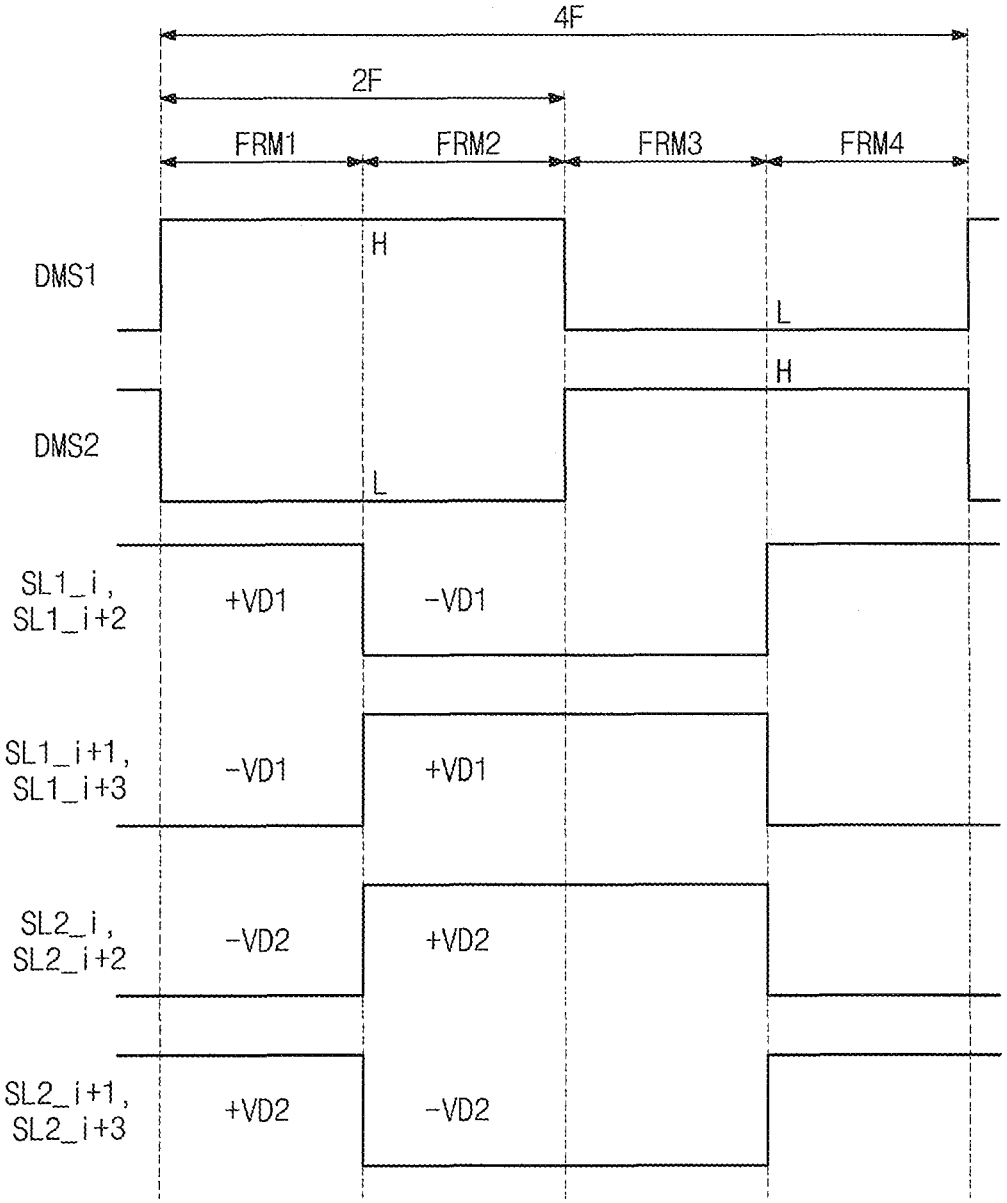
FIG. 7 is a timing diagram showing an operation of pixels shown in FIG. 6.

FIG. 7 is a timing diagram showing the operation of the pixels shown in FIG. 6.

The timing diagram shown in FIG. 7 is substantially similar to the timing diagram shown in FIG. 3. Thus, the description of the timing diagram shown in FIG. 7 will be omitted.

Figure 8A:
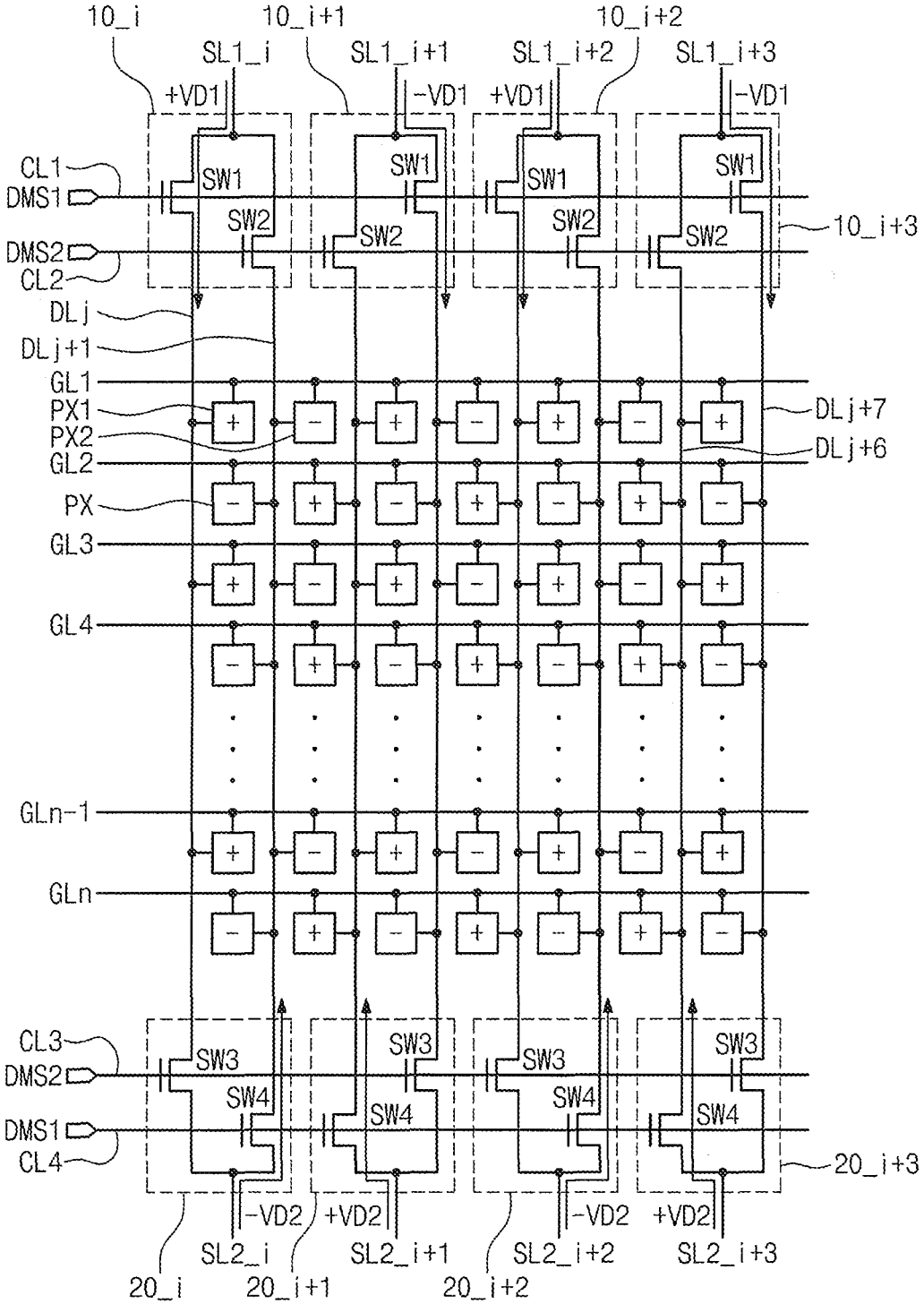
FIG. 8A is a circuit diagram showing an operation state of the pixels in a first frame shown in FIG. 7.
Figure 8B:
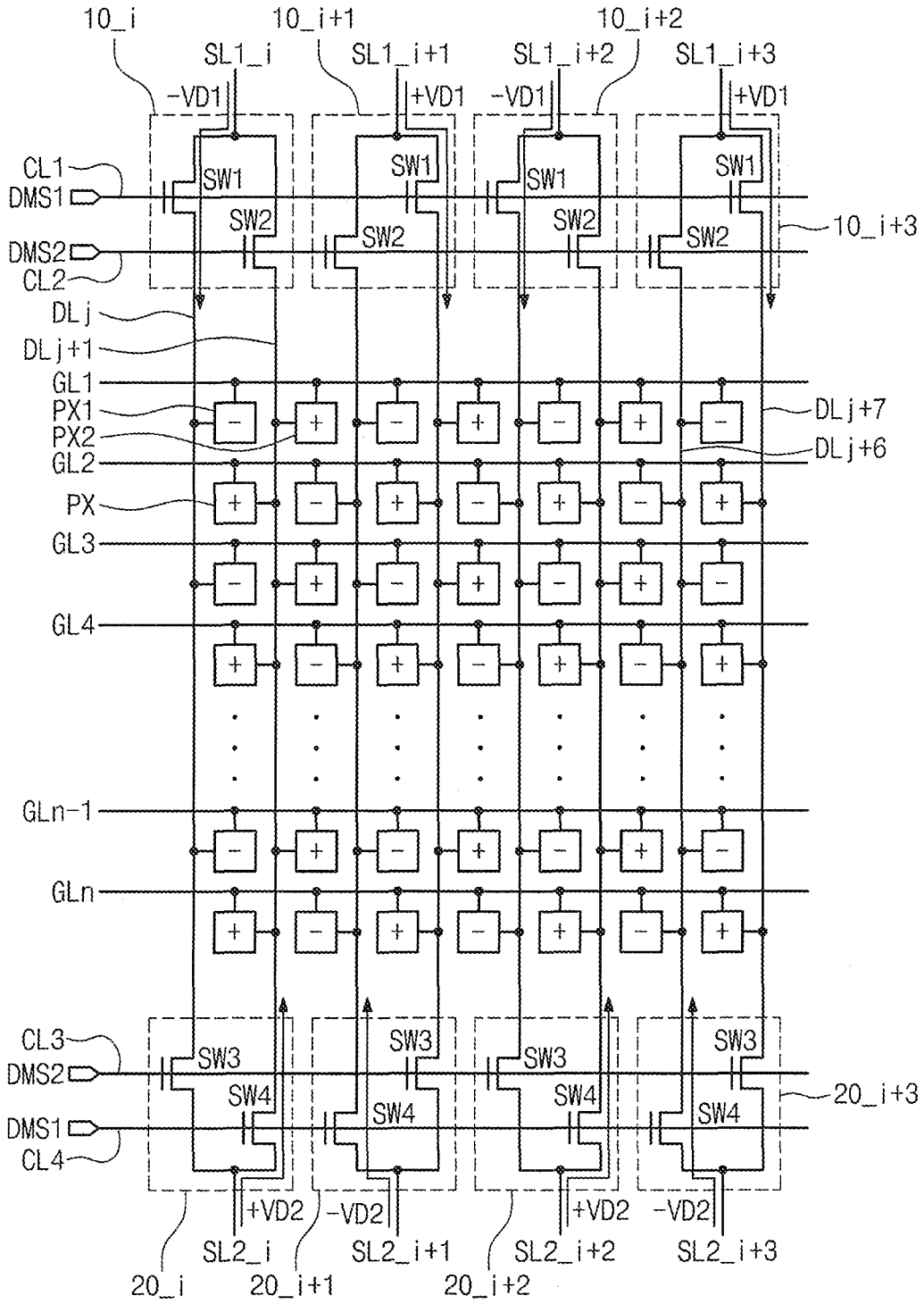
FIG. 8B is a circuit diagram showing an operation state of the pixels in a second frame shown in FIG. 7.
Figure 8C:
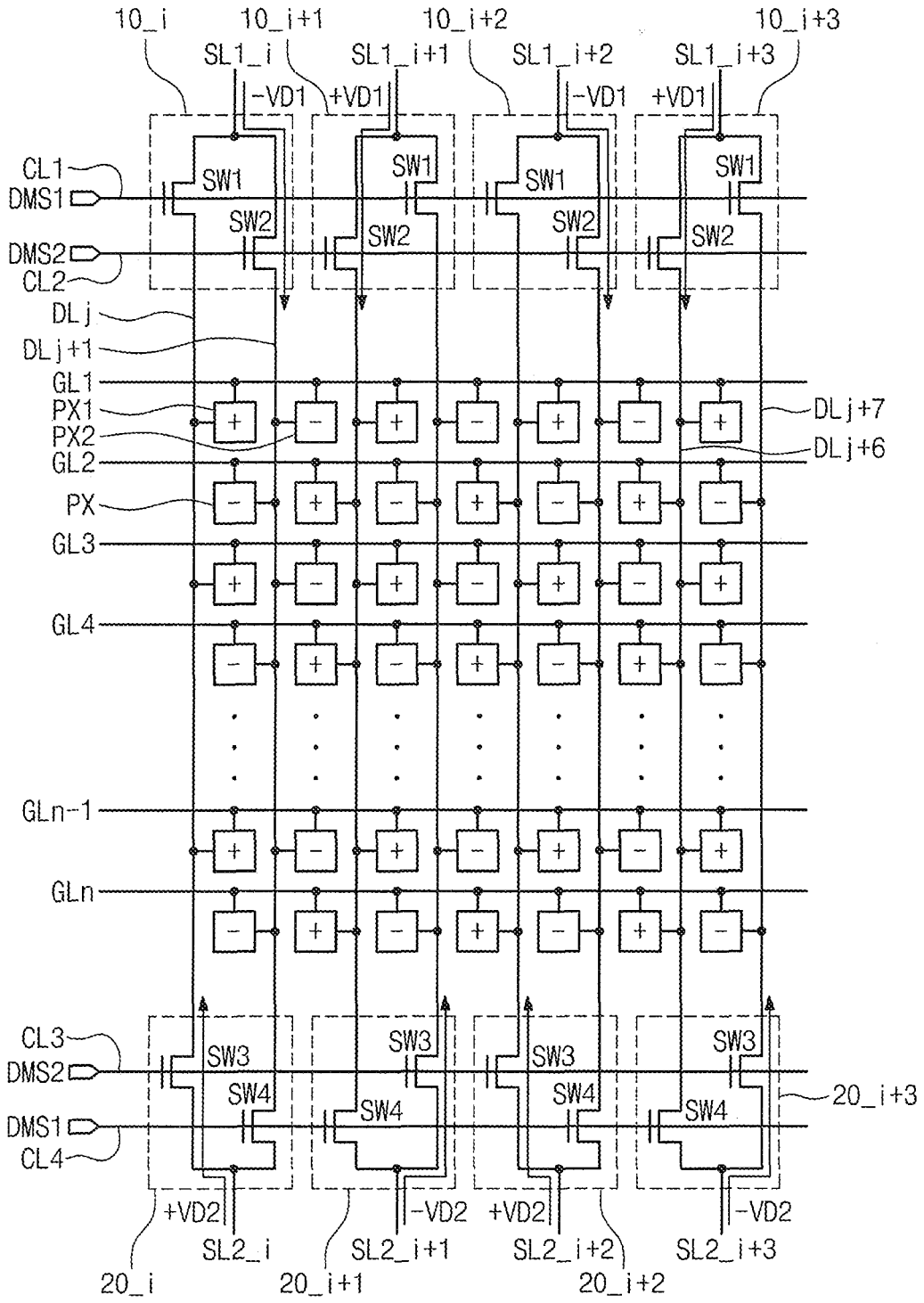
FIG. 8C is a circuit diagram showing an operation state of the pixels in a third frame shown in FIG. 7.
Figure 8D:
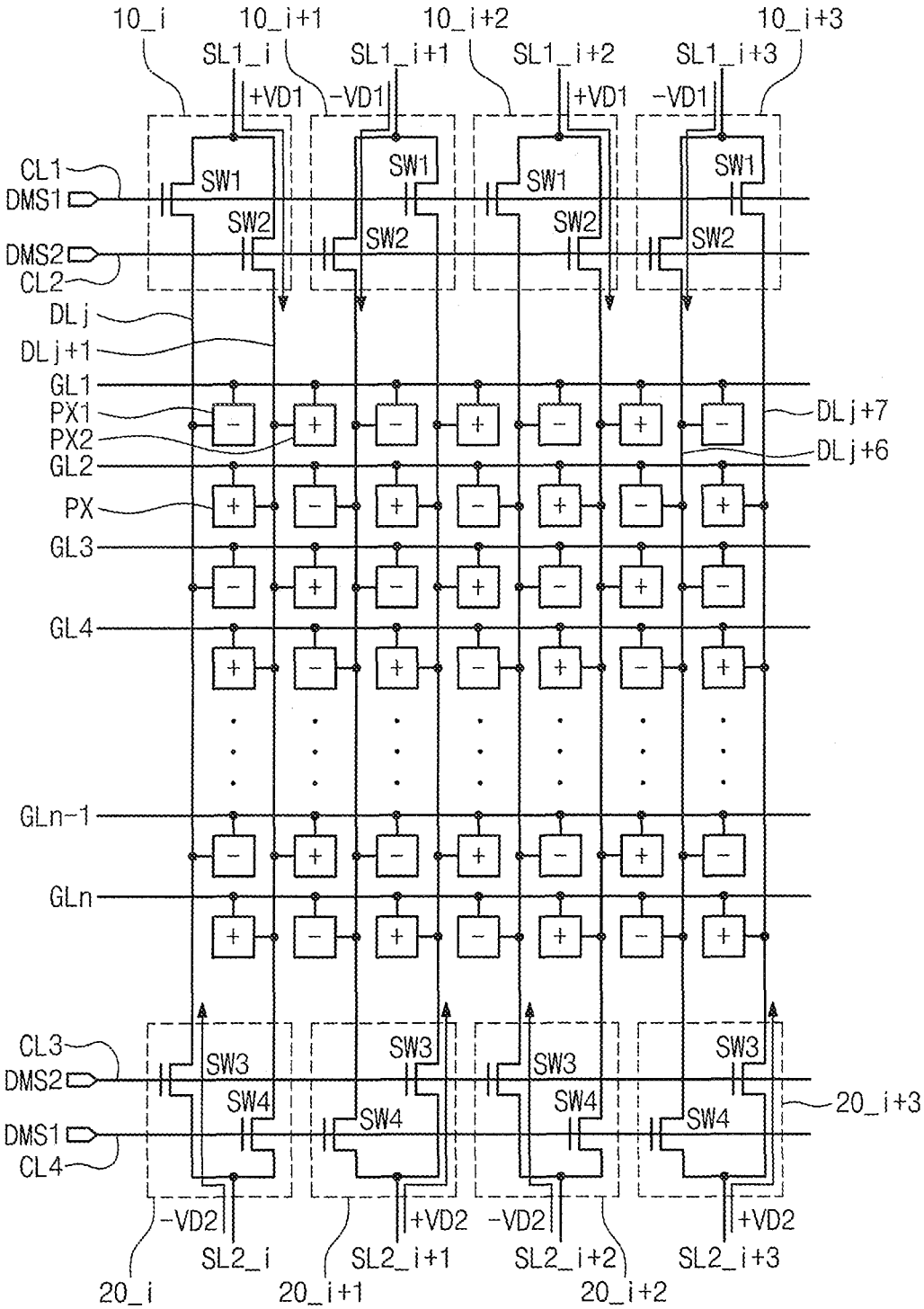
FIG. 8D is a circuit diagram showing an operation state of the pixels in a fourth frame shown in FIG. 7.

FIG. 8A is a circuit diagram showing the operation state of the pixels in the first frame shown in FIG. 7, FIG. 8B is a circuit diagram showing the operation state of the pixels in the second frame shown in FIG. 7, FIG. 8C is a circuit diagram showing the operation state of the pixels in the third frame shown in FIG. 7, and FIG. 8D is a circuit diagram showing the operation state of the pixels in the fourth frame shown in FIG. 7.

For convenience of explanation, FIGS. 8A to 8D show pixels PX arranged in seven columns. However, embodiments of the present invention are not limited thereto, for example, there may be more or less columns.

Referring to FIG. 8A, the odd-numbered first signal lines SL1_*i* and SL1_*i*+2 receive the positive first data voltages +VD1 in the first frame FRM1, and the even-numbered first signal lines SL1_*i*+1 and SL1_*i*+3 receive the negative first data voltages −VD1 in the first frame FRM1.

During the first frame FRM1, the odd-numbered second signal lines SL2_*i* and SL2_*i*+2 receive the negative second data voltages −VD2, and the even-numbered second signal lines SL2_*i*+1 and SL2_*i*+3 receive the positive second data voltages +VD2.

The first switching devices SW1 may selectively and alternately couple (e.g., connect) the first signal lines SL1_*i* to SL1_*i*+3 to the odd-numbered first data lines DLj and DLj+4, and to the even-numbered second data lines DLj+3 and DLj+7, in response to the first DEMUX signal DMS1. Accordingly, the positive and negative first data voltages +VD1 and −VD1 are applied to the pixels PX coupled to (e.g., connected to) the odd-numbered first data lines DLj and DLj+4 and the even-numbered second data lines DLj+3 and DLj+7.

The fourth switching devices SW4 may be configured to couple the second signal lines SL2_*i* to SL2_*i*+3 to the odd-numbered second data lines DLj+1 and DLj+5, and to the even-numbered first data lines DLj+2 and DLj+6, which are not coupled to the first signal lines SL1_*i* to SL1_*i*+3, in response to the first DEMUX signal DMS1. Therefore, the negative and positive second data voltages −VD2 and +VD2 are applied to the pixels PX coupled to the odd-numbered second data lines DLj+1 and DLj+5, and to the even-numbered first data lines DLj+2 and DLj+6.

The positive (+) and negative (−) voltages may be alternately charged in the pixels PX in the row and column directions as shown in FIG. 8A. That is, the pixels PX may be driven by the one-dot inversion driving method (e.g., +, −, +, −).

Referring to FIG. 8B, the negative and positive first data voltages −VD1 and +VD1 are applied to the pixels PX coupled to the odd-numbered first data lines DLj and DLj+4 and the even-numbered second data lines DLj+3 and DLj+7 by the first switching devices SW1.

The positive and negative second data voltages +VD2 and −VD2 may be applied to the pixels PX coupled to the odd-numbered second data lines DLj+1 and DLj+5 and the even-numbered first data lines DLj+2 and DLj+6 by the fourth switching devices SW4.

The polarity of the voltages charged in the pixels PX during the second frame FRM2 may be opposite to that of the voltages charged in the pixels PX during the first frame FRM1 as shown in FIG. 8B.

Referring to FIG. 8C, the second switching devices SW2 selectively and alternately couple the first signal lines SL1_*i* to SL1_*i*+3 to the odd-numbered second data lines DLj+1 and DLj+5 and the even-numbered first data lines DLj+2 and DLj+6, in response to the second DEMUX signal DMS2. Thus, the negative and positive first data voltages −VD1 and +VD1 are applied to the pixels PX coupled to the odd-numbered second data lines DLj+1 and DLj+5 and the even-numbered first data lines DLj+2 and DLj+6.

The third switching devices SW3 couples the second signal lines SL2_*i* to SL2_*i*+3 to the odd-numbered first data lines DLj and DLj+4 and the even-numbered second data lines DLj+3 and DLj+7, which are not coupled to the first signal lines SL1_*i* to SL1_*i*+3, in response to the second DEMUX signal DMS2. Accordingly, the positive and negative second data voltages +VD2 and −VD2 are applied to the pixels PX coupled to the odd-numbered first data lines DLj and DLj+4 and the even-numbered second data lines DLj+3 and DLj+7.

The polarity of the voltages charged in the pixels PX during the third frame FRM3 may be opposite to that of the voltages charged in the pixels PX during the second frame FRM2 as shown in FIG. 8C.

Referring to FIG. 8D, the positive and negative first data voltages +VD1 and −VD1 are applied to the pixels PX coupled to the odd-numbered second data lines DLj+1 and DLj+5 and the even-numbered first data lines DLj+2 and DLj+6 by the second switching devices SW2.

The negative and positive second data voltages −VD2 and +VD2 are applied to the pixels PX coupled to the odd-numbered first data lines DLj and DLj+4 and the even-numbered second data lines DLj+3 and DLj+7 by the third switching devices SW3.

The polarity of the voltages charged in the pixels PX during the fourth frame FRM4 may be opposite to that of the voltages charged in the pixels PX during the third frame FRM3 as shown in FIG. 8C.

As described above, the display apparatus 200 may invert the polarity of the pixels in each frame, and the display panel may be substantially prevented from being degraded. In addition, when the pixels are driven by the one-dot inversion driving method every frame, a flicker phenomenon may be substantially prevented from occurring.

A timing diagram of the charge voltage charged in the first and second pixels PX1 and PX2 shown in FIGS. 8A and 8C is substantially similar to the timing diagram of the charge voltage charged in the first and second pixels PX1 and PX2 shown in FIGS. 5A and 5B. Therefore, the difference in brightness between the pixels PX may be reduced and the vertical line, which may be caused by the signal delay in the data lines, may be substantially prevented.

Consequently, the display apparatus 200 according to the second embodiment of the present invention may substantially prevent the vertical line from occurring.

Figure 9:
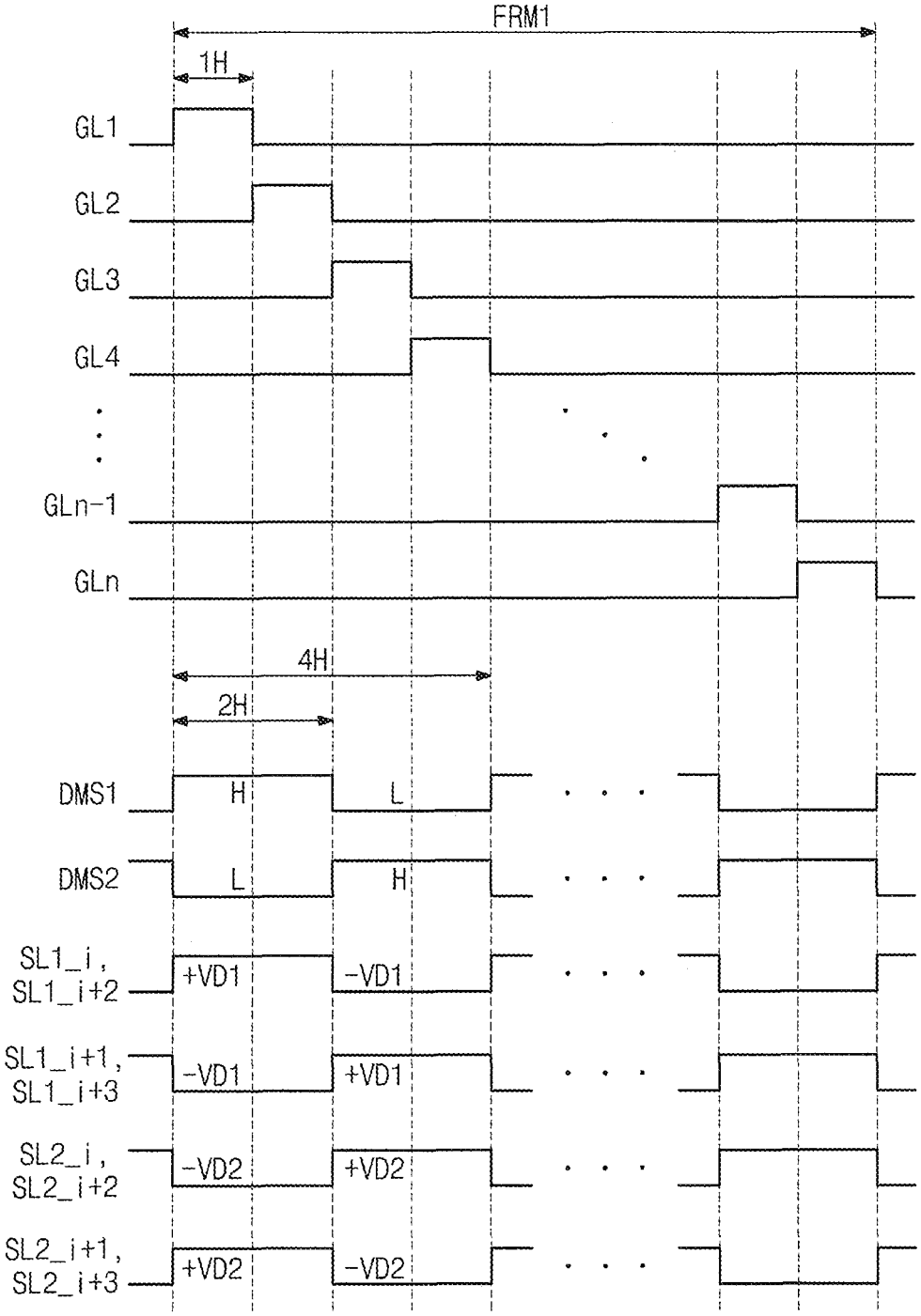
FIG. 9 is a signal timing diagram showing an operation of the pixels shown in FIG. 6 in the first frame according to another embodiment of the present disclosure.
Figure 10:
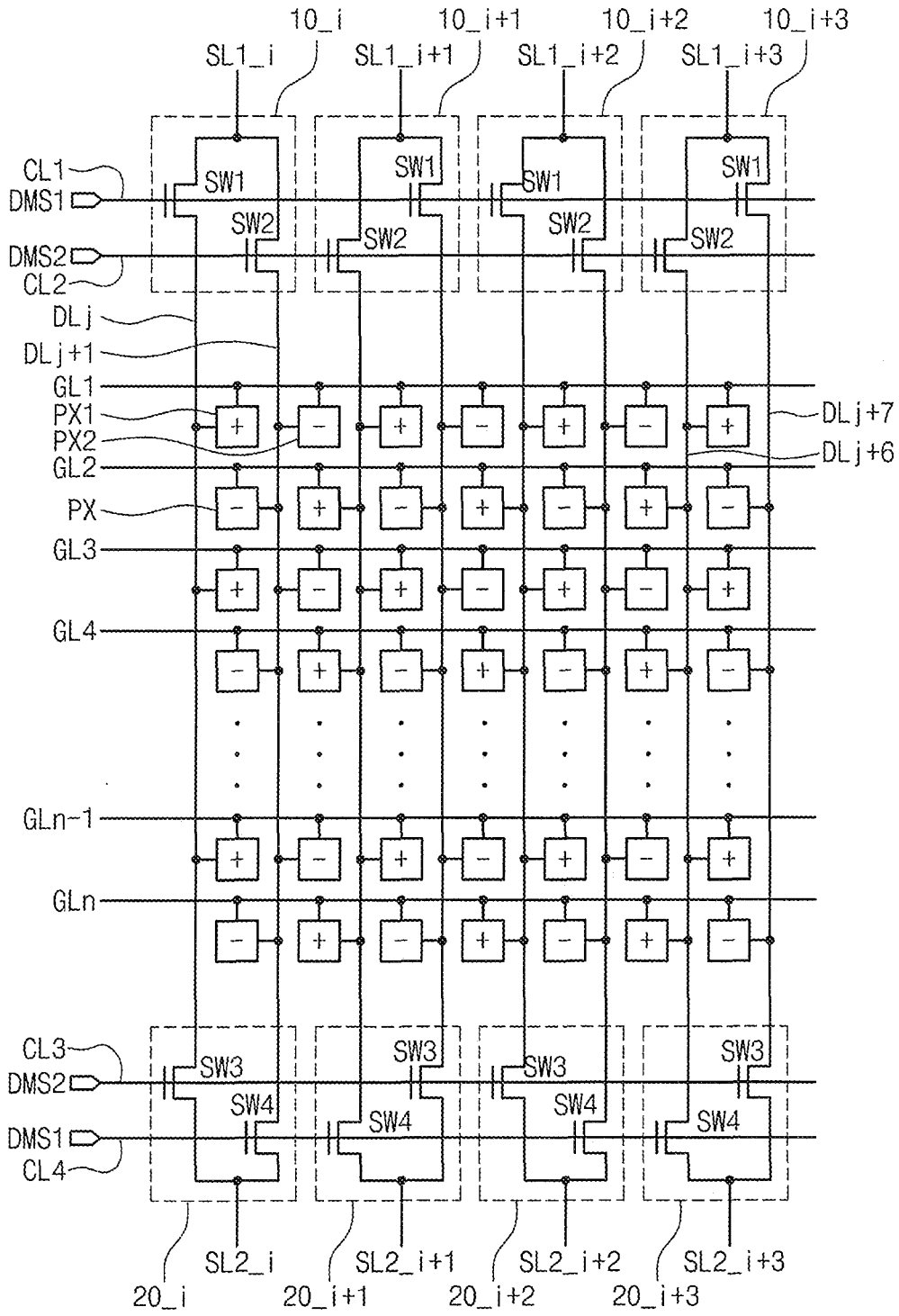
FIG. 10 is a circuit diagram showing an operation state of the pixels according to the signal timing diagram in the first frame shown in FIG. 9.

FIG. 9 is a signal timing diagram showing the operation of the pixels shown in FIG. 6 in the first frame according to another embodiment of the present disclosure, and FIG. 10 is a circuit diagram showing the operation state of the pixels according to the signal timing diagram in the first frame shown in FIG. 9.

Referring to FIG. 9, the gate signals are sequentially applied to the pixels PX coupled to (e.g., connected to) the gate lines GL1 to GLn through the gate lines GL1 to GLn. An activated period of each gate signal is referred to as one period 1H. The pixels PX receive the data voltages in response to the activated gate signals.

The first DEMUX signal DMS1 has a period corresponding to 4M times of the one period 1H, and is activated during a period 2M times greater than the one period 1H. Here, "M" is an integer greater than zero (0). For example, the first DEMUX signal DMS1 has a period corresponding to four times 4H of the one period 1H, and is activated during the period 2H corresponding to two times of the one period 1H.

For example, the first DEMUX signal DMS1 has an activated high level (H) when the first and second gate signals provided to the first and second gate lines GL1 and GL2 are applied to the pixels PX. In addition, the first DEMUX signal DMS1 has a low level (L) when the third and fourth gate signals provided to the third and fourth gate lines GL3 and GL4 are applied to the pixels PX. The second DEMUX signal DMS2 has the same period as the first DEMUXDEMUX signal DMS1, but with an opposite phase to the first DEMUX signal DMS1.

The first signal lines SL1_*i* to SL1_*i*+3 may be configured to receive the positive and negative first data voltages +VD1 and −VD1 in each first period (1H). In addition, the second signal lines SL2_*i* to SL2_*i*+3 may be configured to receive the positive and negative second data voltages +VD2 and −VD2 in each first period (1H).

For example, the polarity of the first data voltages VD1 is inverted every 2M-times period. The polarity of the first data voltages VD1 is inverted every two periods 2H. The odd-numbered first signal lines SL1_*i* and SL1_*i*+2 receive the positive first data voltages +VD1 when the first and second gate signals are applied to the pixels PX. The odd-numbered first signal lines SL1_*i* and SL1_*i*+2 receive the negative first data voltages −VD1 when the third and fourth gate signals are applied to the pixels PX.

The polarity of the even-numbered first signal lines SL1_*i*+1 and SL1_*i*+3 is inverted every two periods (2H). In addition, the first data voltages VD1 applied to the odd-numbered first signal lines SL1_*i* and SL1_*i*+2 have the opposite polarity to that of the first data voltages VD1 applied to the even-numbered first signal lines SL1_*i*+1 and SL1_*i*+3.

The polarity of the second data voltages VD2 is inverted every two periods (2H). In addition, the second data voltages VD2 have the opposite polarity to that of the first data voltages VD1 as shown in FIG. 9.

Referring to FIG. 10, when the first and second gate signals are applied to the pixels, the odd-numbered first signal lines SL1_*i* and SL1_*i*+2 receive the positive first data voltages +VD1, and the even-numbered first signal lines SL1_*i*+1 and SL1_*i*+3 receive the negative first data voltages −VD1.

In addition, the odd-numbered second signal lines SL2_*i* and SL2_*i*+2 receive the negative second data voltages −VD2 and the even-numbered second signal lines SL2_*i*+1 and SL2_*i*+3 receive the positive second data voltages +VD2.

The configuration that the first to fourth switching devices SW1 to SW4 couple the first and second signal lines SL1_*i* to SL1_*i*+3 and SL2_*i* to SL2_*i*+3 to the first and second data lines DLj to DLj+7, in response to the first and second DEMUX signals DMS1 and DMS2 is substantially similar to that of the embodiments described above.

When the first gate signal is applied to the pixels PX, the first switching devices SW1 apply the first data voltages VD1 to the pixels PX coupled to (e.g., connected to) the odd-numbered first data lines DLj and DLj+4 and the even-numbered second data lines DLj+3 and DLj+7 among the pixels PX coupled to the first gate line GL1 in response to the first DEMUX signal DMS1.

In addition, when the first gate signal is applied to the pixels PX, the fourth switching devices SW4 apply the second data voltages VD2 to the pixels PX coupled to the odd-numbered second data lines DLj+1 and DLj+5 and the even-numbered first data lines DLj+2 and DLj+6 among the pixels PX coupled to the first gate line GL1 in response to the first DEMUX signal DMS1.

The pixels PX receive the first and second data voltages VD1 and VD2 in response to the first gate signal. In this case, the positive (+) and negative (−) voltages are alternately charged in the pixels PX arranged in a first row as shown in FIG. 10.

When the second gate signal is applied to the pixels PX, the first switching devices SW1 apply the first data voltages VD1 to the pixels PX coupled to the odd-numbered first data lines DLj and DLj+4 and the even-numbered second data lines DLj+3 and DLj+7 among the pixels PX coupled to the second gate line GL2 in response to the first DEMUX signal DMS1.

In addition, when the second gate signal is applied to the pixels PX, the fourth switching devices SW4 apply the second data voltages VD2 to the pixels PX coupled to the odd-numbered second data lines DLj+1 and DLj+5 and the even-numbered first data lines DLj+2 and DLj+6 among the pixels PX coupled to the second gate line GL2 in response to the first DEMUX signal DMS1.

In this case, the negative (−) and positive (+) voltages are alternately charged in the pixels PX arranged in a second row as shown in FIG. 10.

When the third and fourth gate signals are applied to the pixels, the polarity of the first and second data voltages VD1 and VD2 are respectively opposite to that of the first and second data voltages VD1 and VD2 when the first and second gate signals are applied to the pixels.

When the third gate signal is applied to the pixels PX, the second switching devices SW2 apply the first data voltages VD1 to the pixels PX coupled to the odd-numbered second data lines DLj+1 and DLj+5 and the even-numbered first data lines DLj+2 and DLj+6 among the pixels PX coupled to the third gate line GL3 in response to the second DEMUX signal DMS2.

In addition, when the third gate signal is applied to the pixels PX, the third switching devices SW3 apply the second data voltages VD2 to the pixels PX coupled to the odd-numbered first data lines DLj and DLj+4 and the even-numbered second data lines DLj+3 and DLj+7 among the pixels PX coupled to the third gate line GL3 in response to the second DEMUX signal DMS2.

In this case, the positive (+) and negative (−) voltages are alternately charged in the pixels PX arranged in a third row as shown in FIG. 10.

When the fourth gate signal is applied to the pixels PX, the second switching devices SW2 apply the first data voltages VD1 to the pixels PX coupled to the odd-numbered second data lines DLj+1 and DLj+5 and the even-numbered first data lines DLj+2 and DLj+6 among the pixels PX coupled to the fourth gate line GL4 in response to the second DEMUX signal DMS2.

In addition, when the fourth gate signal is applied to the pixels PX, the third switching devices SW3 apply the second data voltages VD2 to the pixels PX coupled to the odd-numbered first data lines DLj and DLj+4 and the even-numbered second data lines DLj+3 and DLj+7 among the pixels PX coupled to the fourth gate line GL4 in response to the second DEMUX signal DMS2.

In this case, the negative (−) and positive (+) voltages are alternately charged in the pixels PX arranged in a fourth row as shown in FIG. 10.

According to the above-described operation repeatedly performed, the pixels PX may be driven by the one-dot inversion driving method (e.g., +, −, +, −) as shown in FIG. 10.

Figure 11:
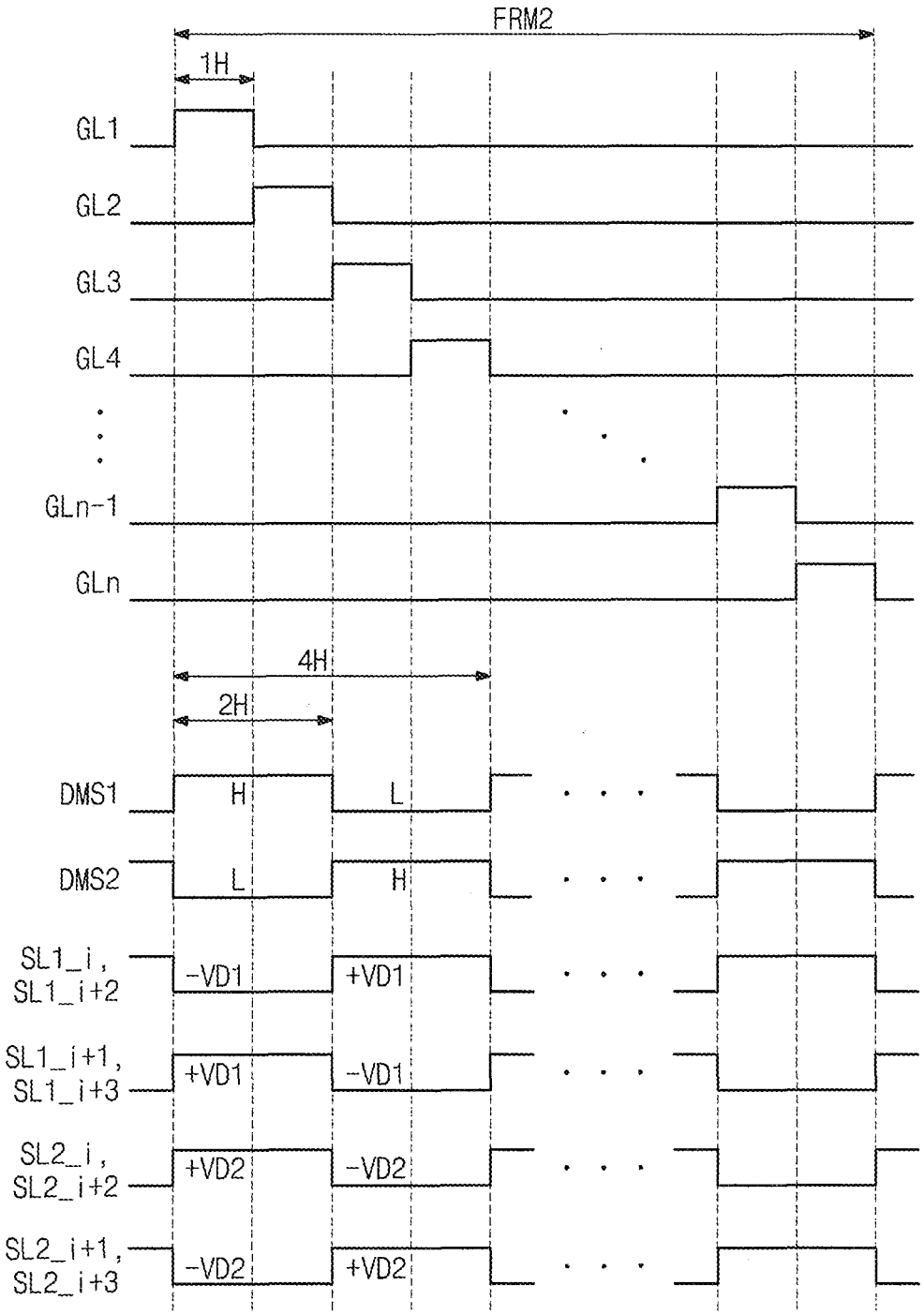
FIG. 11 is a signal timing diagram showing an operation of the pixels shown in FIG. 6 in the second frame according to another embodiment of the present disclosure.
Figure 12:
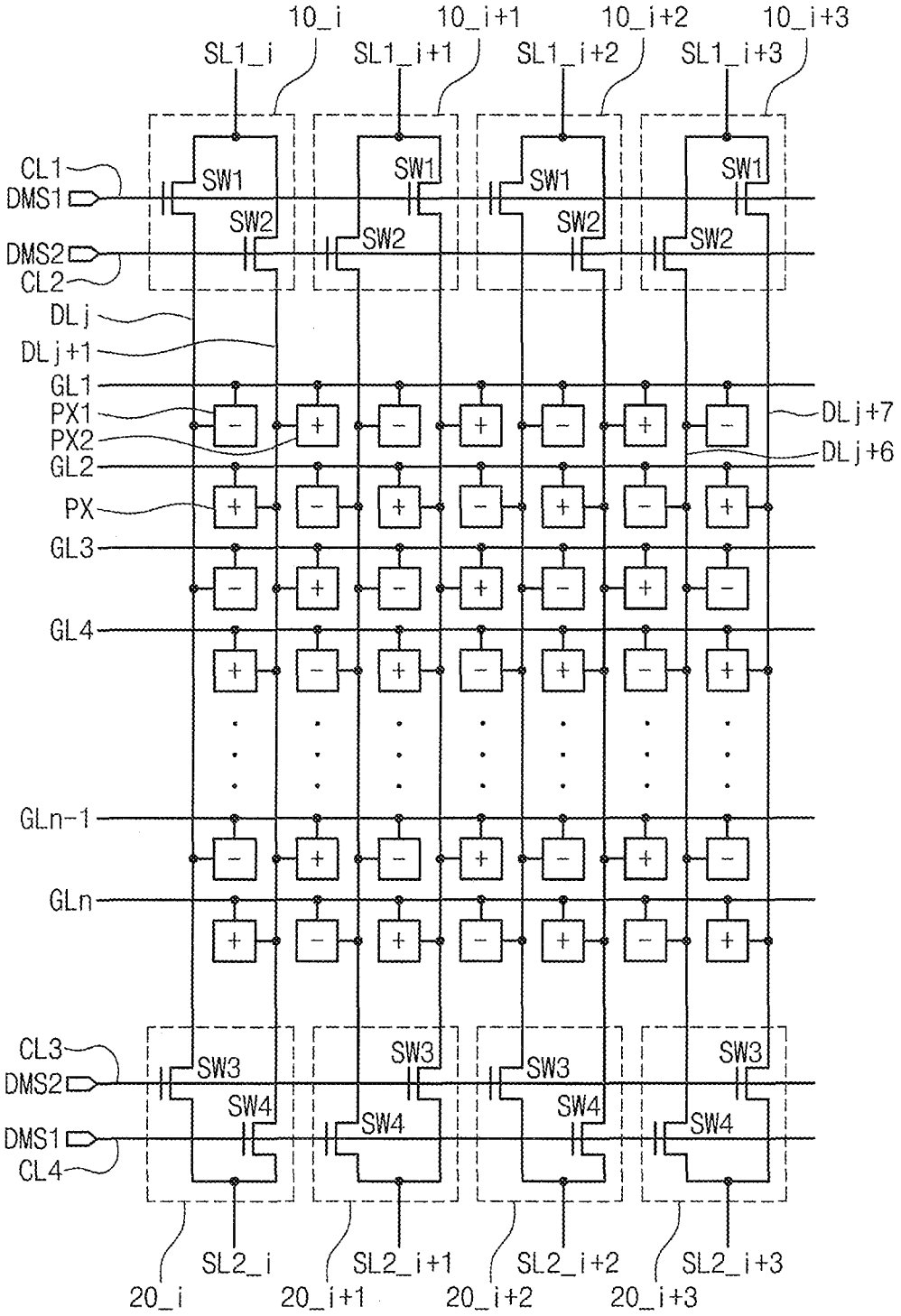
FIG. 12 is a circuit diagram showing an operation state of the pixels according to the signal timing diagram in the second frame shown in FIG. 9.

FIG. 11 is a signal timing diagram showing the operation of the pixels shown in FIG. 6 in the second frame according to another embodiment of the present disclosure, and FIG. 12 is a circuit diagram showing the operation state of the pixels according to the signal timing diagram in the second frame shown in FIG. 9.

Referring to FIGS. 11 and 12, the polarity of the first data voltages VD1 in the second frame FRM2 is opposite to the polarity of the first data voltages VD1 in the first frame FRM1 shown in FIG. 9. In addition, the polarity of the second data voltages VD2 in the second frame FRM2 is opposite to the polarity of the second data voltages VD2 in the first frame FRM1 shown in FIG. 9.

Because the polarity of the first and second data voltages VD1 and VD2 is inverted in the second frame FRM2, the polarity of the voltages charged in the pixels PX is inverted in the second frame FRM2. That is, the polarity of the pixels PX in the first frame FRM1 is inverted in the second frame FRM2 as shown in FIGS. 10 and 12.

When the signals of the first and second frames FRM1 and FRM2 shown in FIGS. 9 and 11 are repeatedly applied to the pixels PX, the polarity of the pixels PX is inverted each frame, and the pixels PX are driven by the one-dot inversion driving method.

In addition, a timing diagram of the charge voltage charged in the first and second pixels PX1 and PX2 shown in FIGS. 10 and 12 is substantially similar to the timing diagram of the charge voltage charged in the first and second pixels PX1 and PX2 shown in FIGS. 5A and 5B. Therefore, the difference in brightness between the pixels PX may be reduced and the vertical line, which may be caused by the signal delay in the data lines, may be substantially prevented.

Consequently, the display apparatus 200 according to the second embodiment of the present invention may substantially prevent the vertical line from occurring.

Figure 13:
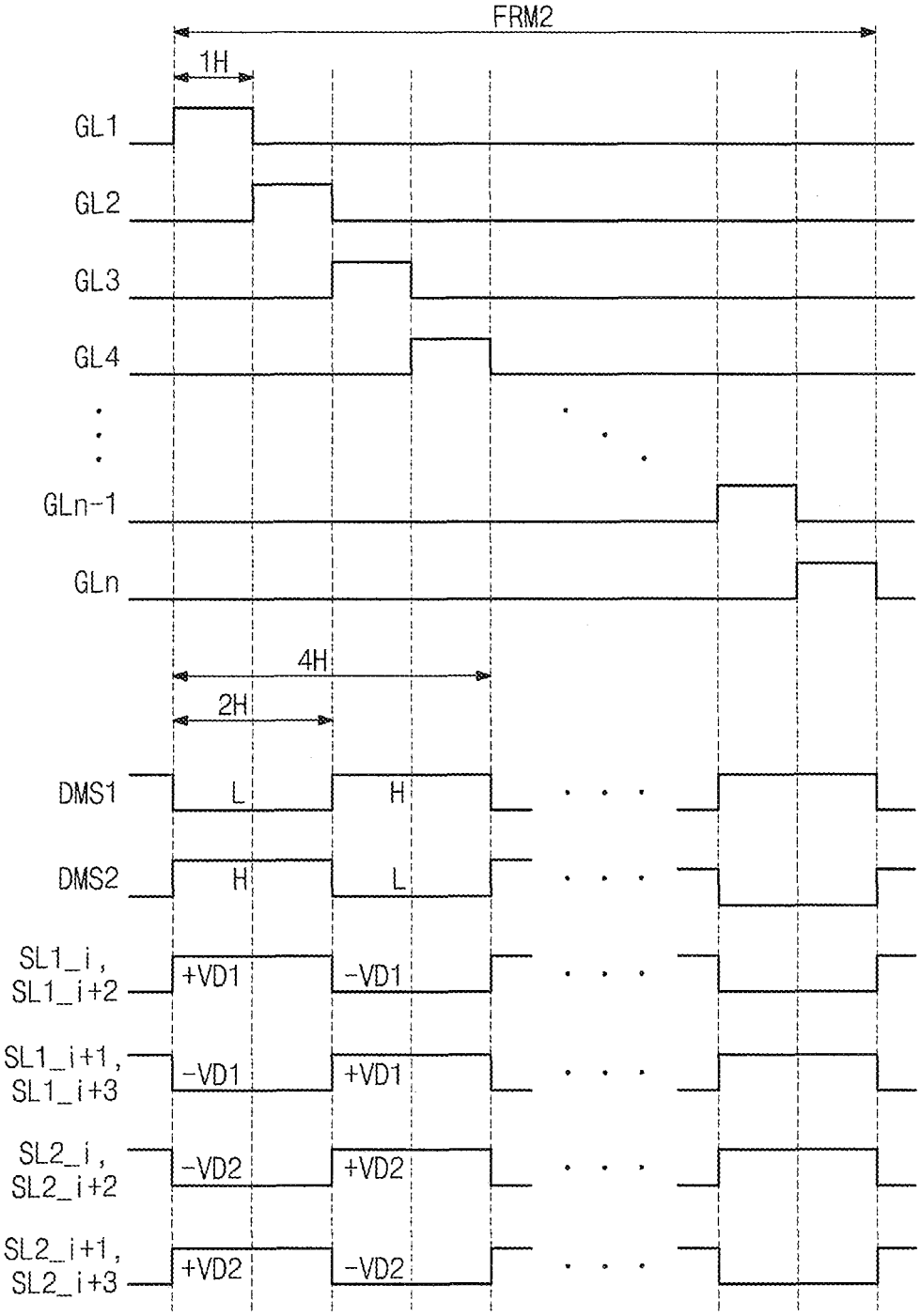
FIG. 13 is a signal timing diagram showing an operation of the pixels shown in FIG. 6 in the second frame according to another embodiment of the present disclosure.
Figure 14:
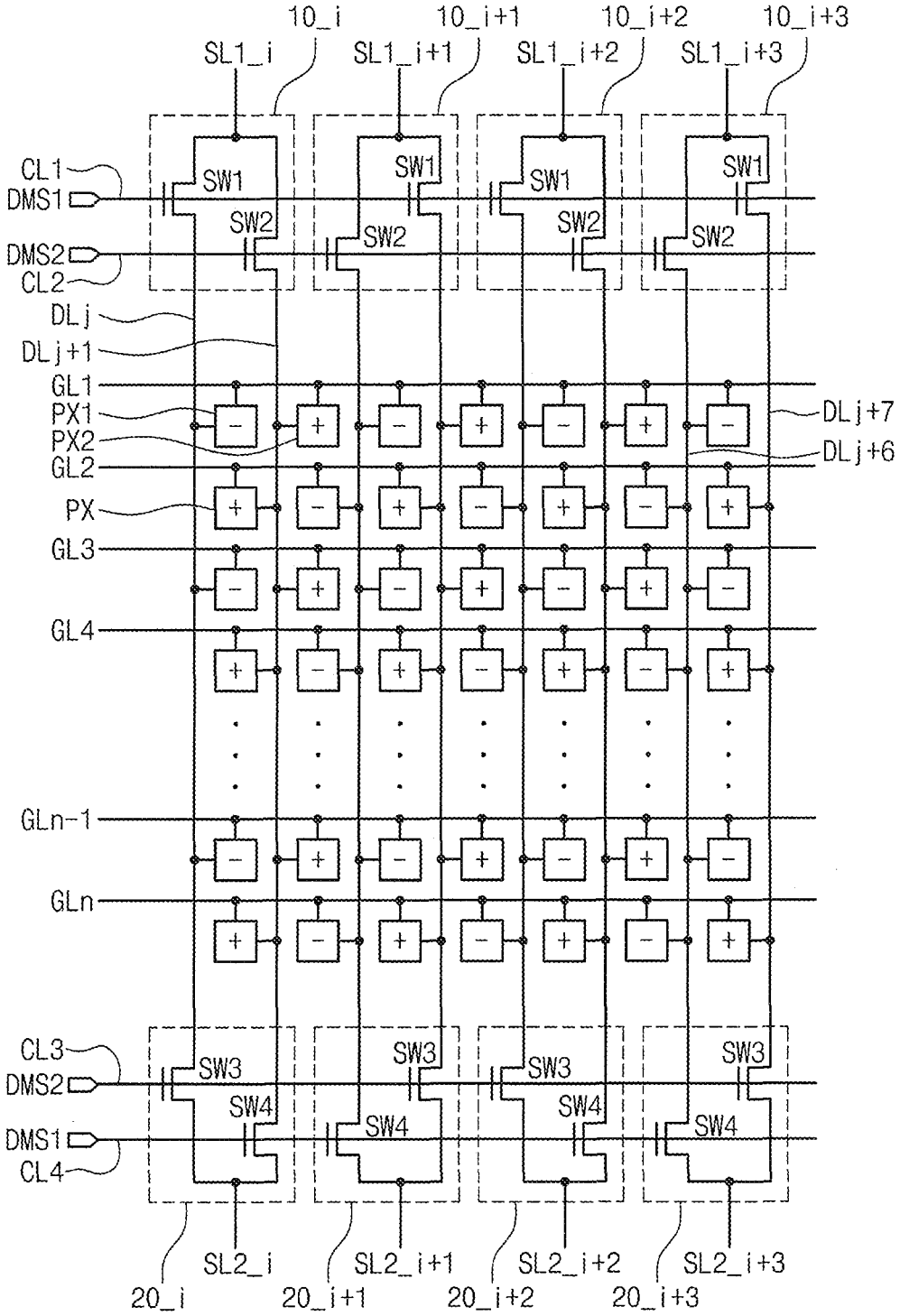
FIG. 14 is a circuit diagram showing an operation state of the pixels according to the signal timing diagram in the second frame shown in FIG. 9.

FIG. 13 is a signal timing diagram showing the operation of the pixels shown in FIG. 6 in the second frame according to another embodiment of the present disclosure, and FIG. 14 is a circuit diagram showing the operation state of the pixels according to the signal timing diagram in the second frame shown in FIG. 9.

Referring to FIGS. 13 and 14, the polarity of the first and second data voltages VD1 and VD2 of the second frame FRM2 is the same as the polarity of the first and second data voltages VD1 and VD2 of the first frame FRM1, respectively, shown in FIG. 9.

The phase of the first and second DEMUX signals DMS1 and DMS2 of the second frame FRM2 is different from the phase of the first and second DEMUX signals DMS1 and DMS2 of the first frame FRM1 shown in FIG. 9.

Thus, the order that the first to fourth switching devices SW1 to SW4 couple (e.g., connect) the first and second signal lines SL1_*i* to SL1_*i*+3 and SL2_*i* to SL2_*i*+3 to the first and second data lines DLj to DLj+7 in response to the first and second DEMUX signals DMS1 and DMS2 in the second frame FRM2 is opposite to the order in the first frame FRM1 shown in FIG. 9.

In this case, when the first gate signal is applied to the pixels PX in the second frame FRM2, the pixels PX arranged in the first row are alternately charged with the negative (−) and positive (+) voltages. In addition, when the second gate signal is applied to the pixels PX in the second frame FRM2, the pixels PX arranged in the second row are alternately charged with the positive (+) and negative (−) voltages.

Due to the above-described operation, the polarity of the pixels PX in the first frame FRM1 is inverted in the second frame FRM2 as shown in FIGS. 10 and 14.

When the signals of the first and second frames FRM1 and FRM2 shown in FIGS. 9 and 13 are repeatedly applied to the pixels PX, the polarity of the pixels PX is inverted in each frame, and the pixels PX are driven by the one-dot inversion driving method.

In addition, a timing diagram of the charge voltage charged in the first and second pixels PX1 and PX2 shown in FIGS. 10 and 14 is substantially similar to the timing diagram of the charge voltage charged in the first and second pixels PX1 and PX2 shown in FIGS. 5A and 5B. Therefore, the difference in brightness between the pixels PX may be reduced and the vertical line, which is caused by the signal delay in the data lines, may be substantially prevented.

Consequently, the display apparatus 200 according to the second embodiment of the present invention may substantially prevent the vertical line from occurring.

Figure 15:
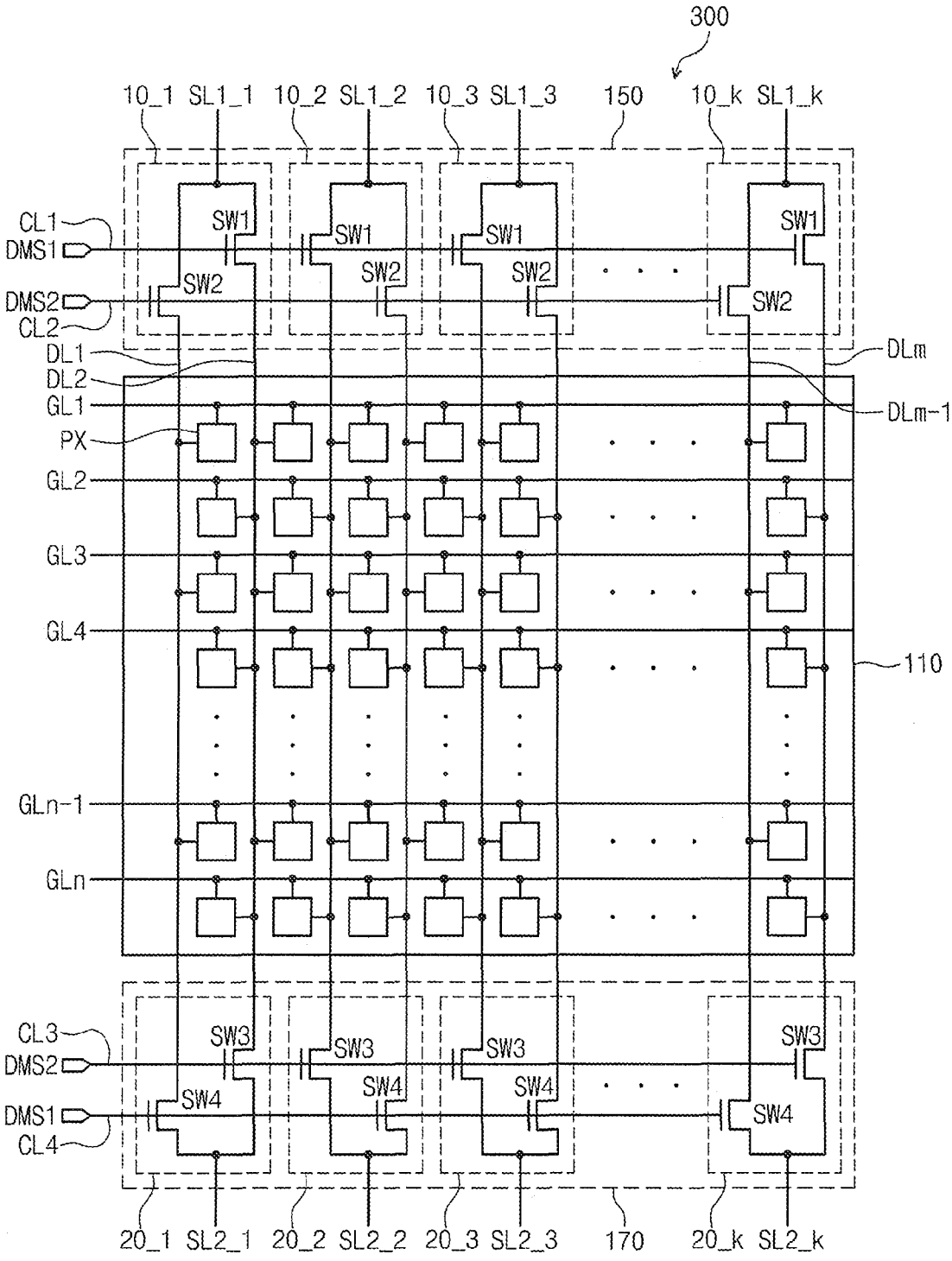
FIG. 15 is a circuit diagram showing a display apparatus according to a third embodiment of the present disclosure.

FIG. 15 is a circuit diagram showing a display apparatus according to a third embodiment of the present disclosure.

Referring to FIG. 15, each of first DEMUX units 10_1 to 10_*k* includes a first switching device SW1 coupled to a first control line CL1, and a second switching device SW2 coupled to a second control line CL2. Each of second DEMUX units 20_1 to 20_*k* includes a third switching device SW3 coupled to a third control line CL3, and a fourth switching device SW4 coupled to a fourth control line CL4.

The first and fourth switching devices SW1 and SW4 are switched in response to the first DEMUX signal DMS1 provided through the first and fourth control lines CL1 and CL4. The second and third switching devices SW2 and SW3 are switched in response to the second DEMUX signal DMS2 provided through the second and third control lines CL2 and CL3.

The first and second switching devices SW1 and SW2 couple first signal lines SL1_1 to SL1_*k* to corresponding first and second data lines DL1 to DLm. The third and fourth switching devices SW3 and SW4 couple second signal lines SL2_1 to SL2_*k* to first and second data lines DL1 to DLm not coupled to the first signal lines SL1_1 to SL1_*k*.

The connection structure of the first and second signal lines SL1_1 to SL1_*k* and SL2_1 to SL2_*k* coupled to the first and second data lines DL1 to DLm by the first to fourth switching devices SW1 to SW4 will be described further below.

Figure 16:
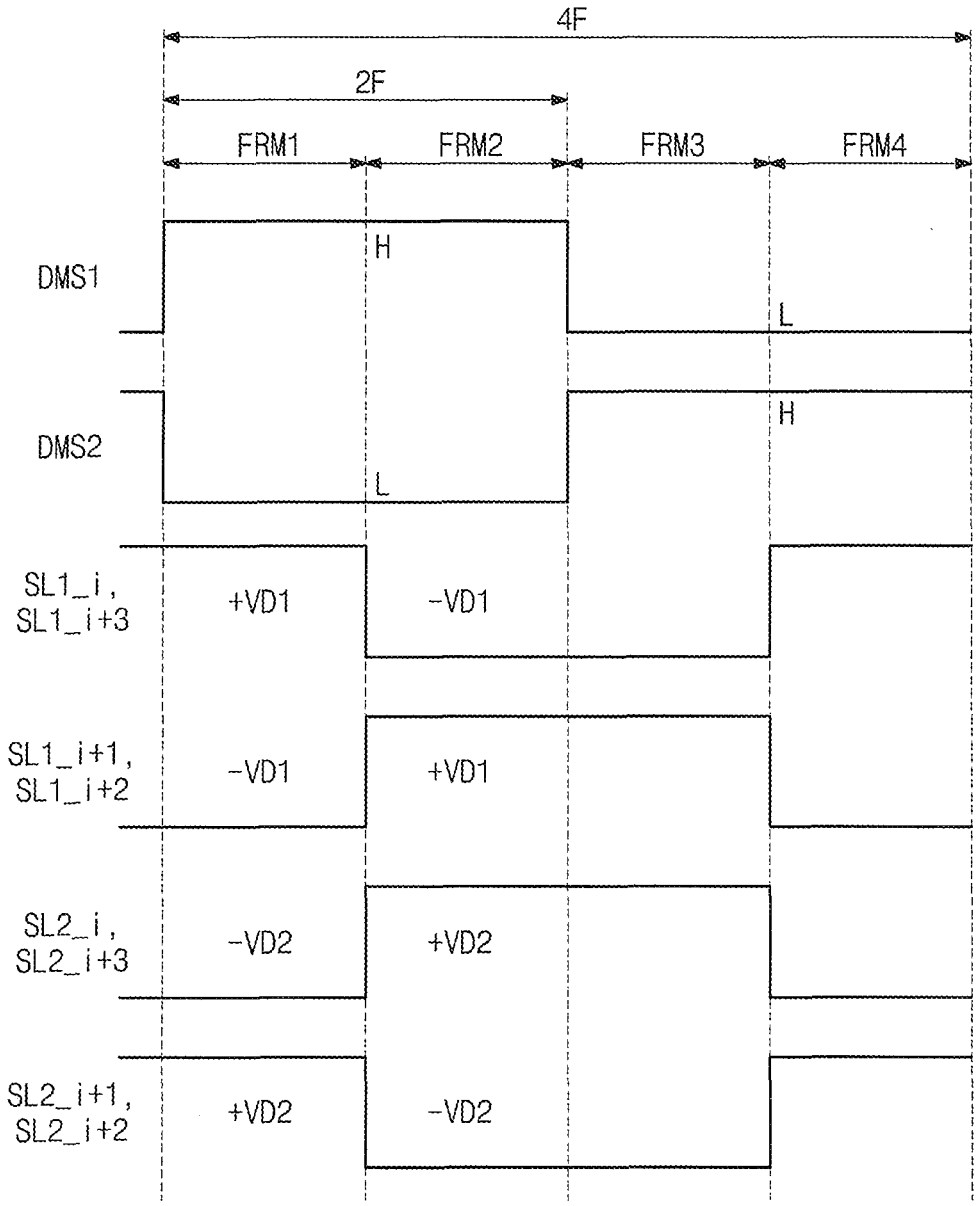
FIG. 16 is a signal timing diagram showing an operation of pixels shown in FIG. 15.

FIG. 16 is a signal timing diagram showing the operation of the pixels shown in the embodiment of FIG. 15.

Referring to FIG. 16, the timing diagram of the first and second DEMUX signals DMS1 and DMS2 is substantially similar to the timing diagram of the first and second DEMUX signals DMS1 and DMS2 shown in FIG. 3. Thus, the description of the first and second DEMUX signals DMS1 and DMS2 will be omitted.

Hereinafter, the first signal lines SL1_*i* to SL1_*i*+3 shown in FIG. 16 are respectively referred to as first to fourth sub-signal lines SL1_*i* to SL1_*i*+3. In addition, the second signal lines SL2_*i* to SL2_*i*+3 shown in FIG. 16 are respectively referred to as fifth to eighth sub-signal lines SL2_*i* to SL2_*i*+3.

The first data voltages VD1 applied to the first and fourth sub-signal lines SL1_*i* and SL1_*i*+3 in the first and fourth frames FRM1 and FRM4 have a polarity opposite to that of the first data voltages VD1 applied to the first and fourth sub-signal lines SL1_*i* and SL1_*i*+3 in the second and third frames FRM2 and FRM3.

In each frame FRM1, FRM2, FRM3, and FRM4, the first data voltages VD1 applied to the first and fourth sub-signal lines SL1_*i* and SL1_*i*+3 have the polarity opposite to that of the first data voltages VD1 applied to the second and third sub-signal lines SL1_*i*+1 and SL1_*i*+2.

In each frame FRM1, FRM2, FRM3, and FRM4, the first data voltages VD1 applied to the first to fourth sub-signal lines SL1_*i* to SL1_*i*+3 have the polarity opposite to that of the second data voltages VD2 applied to the fifth to eighth sub-signal lines SL2_*i* and SL2_*i*+3 respectively corresponding to the first to fourth sub-signal lines SL1_*i* to SL1_*i*+3.

Figure 17A:
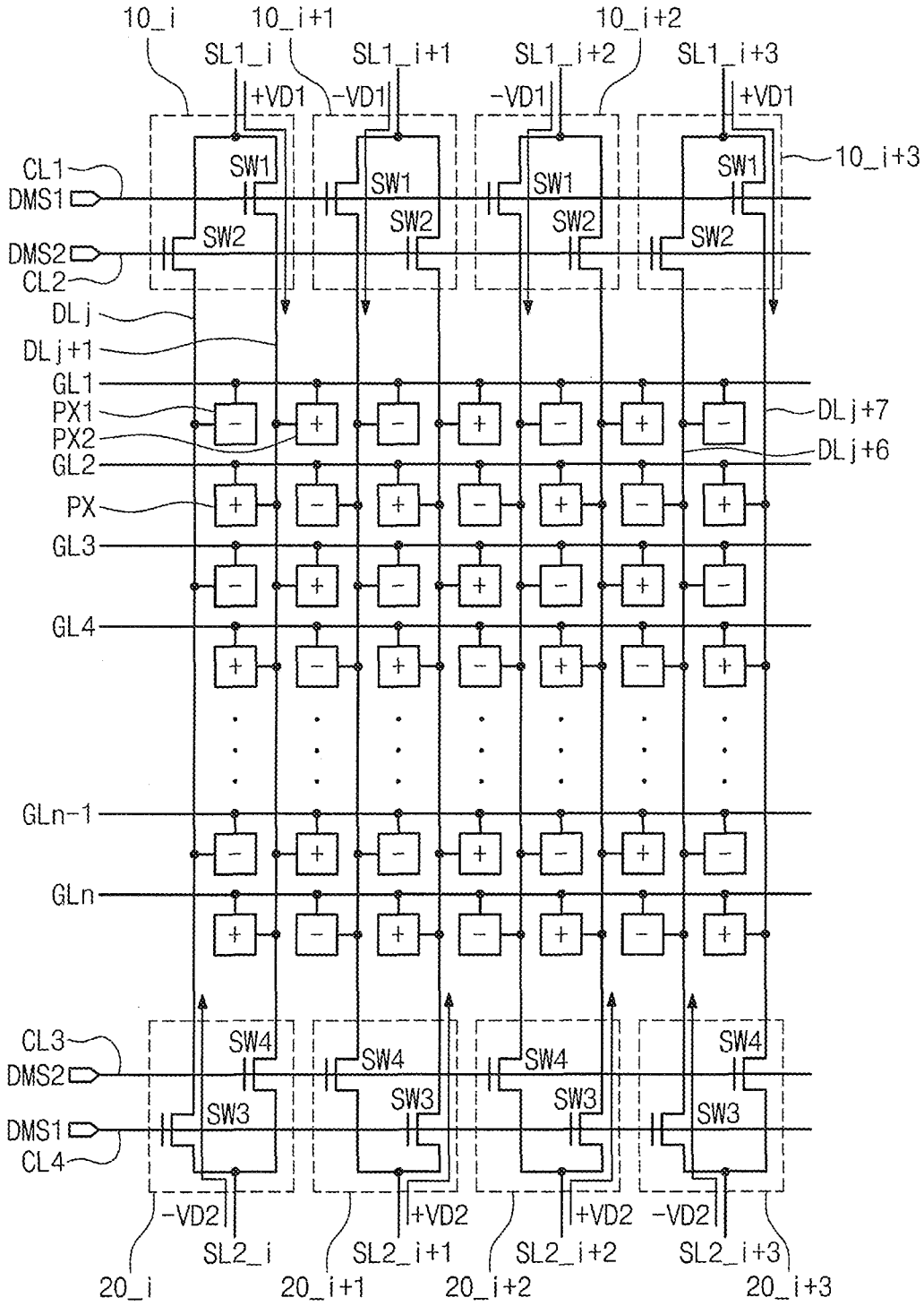
FIG. 17A is a circuit diagram showing an operation state of the pixels in a first frame shown in FIG. 16.
Figure 17B:
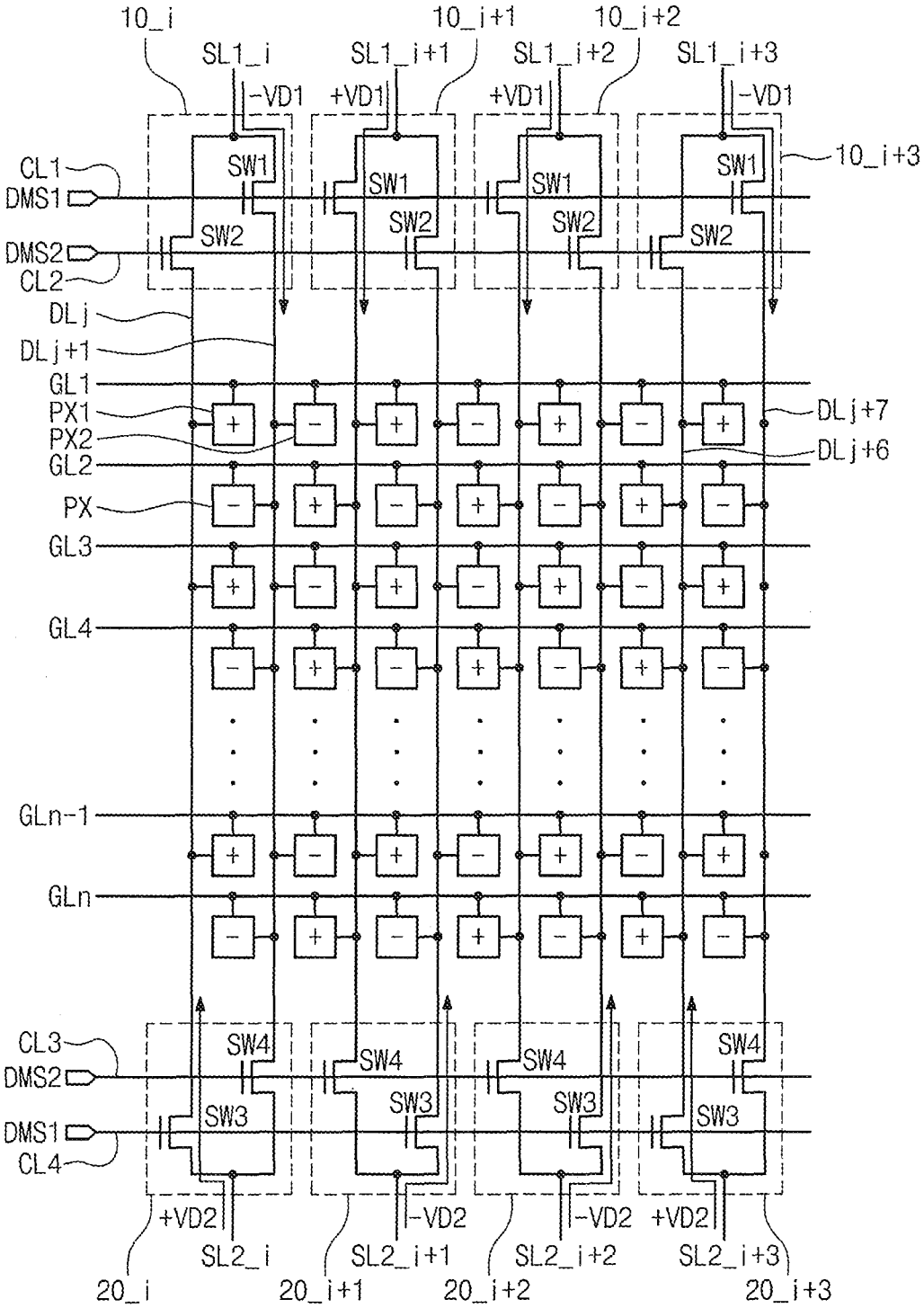
FIG. 17B is a circuit diagram showing an operation state of the pixels in a second frame shown in FIG. 16.
Figure 17C:
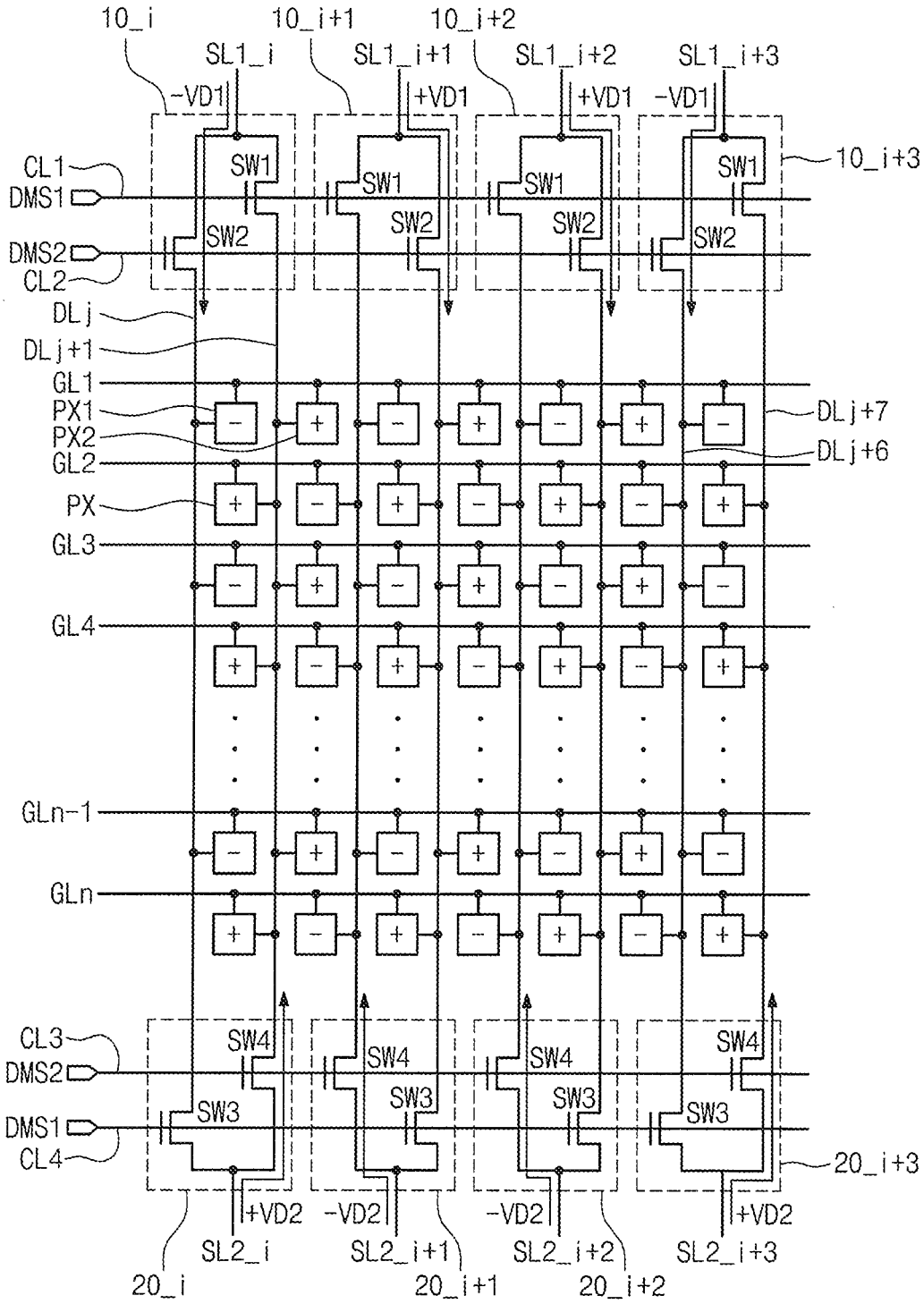
FIG. 17C is a circuit diagram showing an operation state of the pixels in a third frame shown in FIG. 16.
Figure 17D:
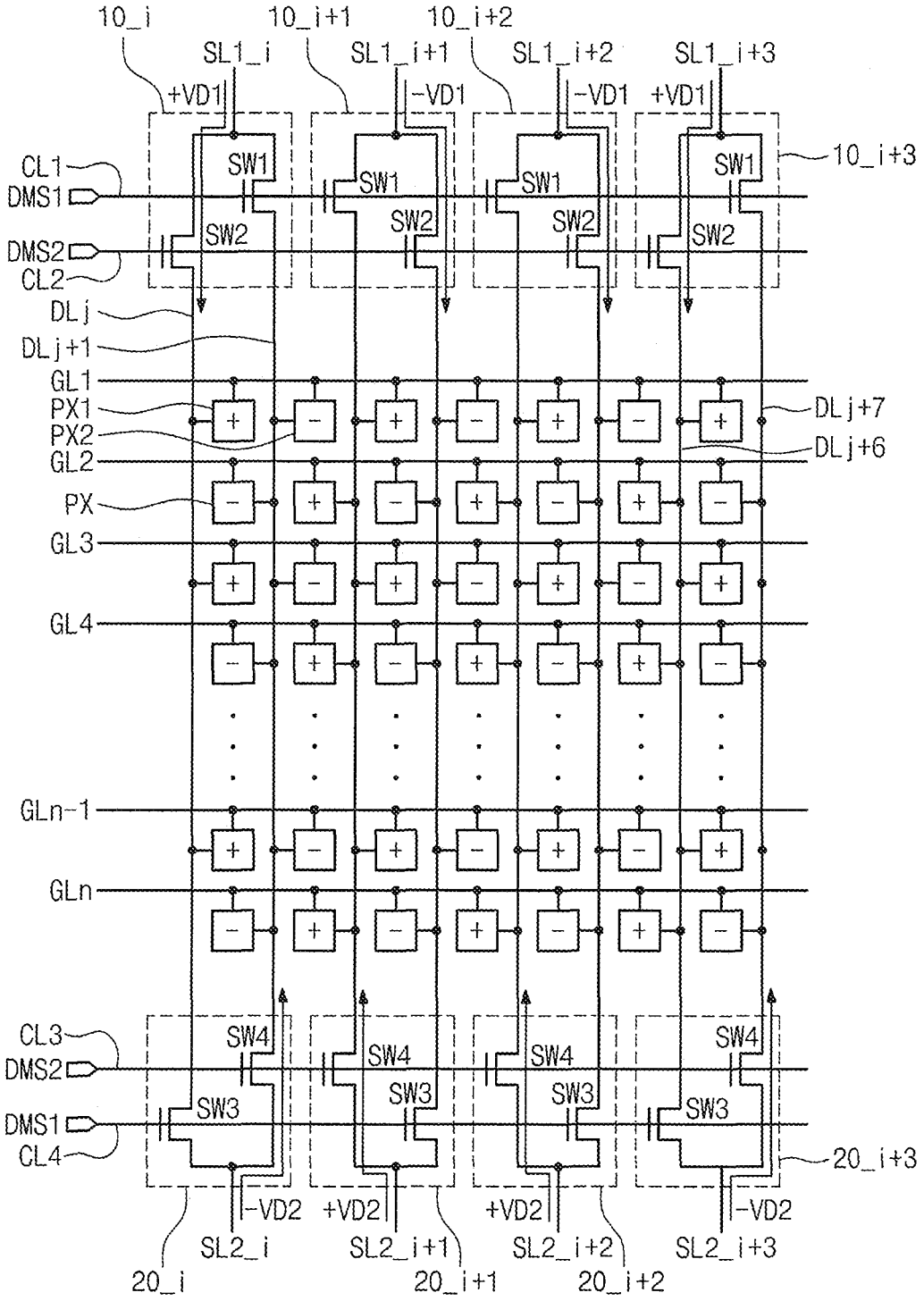
FIG. 17D is a circuit diagram showing an operation state of the pixels in a fourth frame shown in FIG. 16.

FIG. 17A is a circuit diagram showing the operation state of the pixels in the first frame shown in FIG. 16, FIG. 17B is a circuit diagram showing the operation state of the pixels in the second frame shown in FIG. 16, FIG. 17C is a circuit diagram showing the operation state of the pixels in the third frame shown in FIG. 16, and FIG. 17D is a circuit diagram showing the operation state of the pixels in the fourth frame shown in FIG. 16.

The first to fourth sub-signal lines SL1_*i* to SL1_*i*+3 may be repeatedly arranged as the first signal lines SL1_1 to SL1_*k*. In addition, the fifth to eighth sub-signal lines SL2_*i* to SL2_*i*+3 may be repeatedly arranged as the second signal lines SL2_1 to SL2_*k*.

Hereinafter, the first DEMUX units 10_*i* to 10_*i*+3 shown in FIGS. 17A to 17D are respectively referred to as first to fourth sub-DEMUX units 10_*i* to 10_*i*+3. In addition, the second DEMUX units 20_*i* to 20_*i*+3 shown in FIGS. 17A to 17D are respectively referred to as fifth to eighth sub-DEMUX units 20_*i* to 20_*i*+3. Further, the first data lines DL1, DLj+2, DLj+4, and DLj+6 shown in FIGS. 17A to 17D may be respectively referred to as first, third, fifth, and seventh sub-data lines. In addition, the second data lines DLj+1, DLj+3, DLj+5, and DLj+7 may be respectively referred to as second, fourth, sixth, and eighth sub-data lines.

The first to fourth sub-DEMUX units 10_*i* to 10_*i*+3 may be repeatedly arranged as the first DEMUX units 10_1 to 10_*k*. In addition, the fifth to eighth sub-DEMUX units 20_*i* to 20_*i*+3 may be repeatedly arranged as the second DEMUX units 20_1 to 20_*k*.

Referring to FIG. 17A, the first and fourth sub-signal lines SL1_*i* and SL1_*i*+3 receive the positive first data voltages +VD1 during the first frame FRM1. The second and third sub-signal lines SL1_*i*+1 and SL1_*i*+2 receive the negative first data voltages −VD1 during the first frame FRM1.

The polarity of the second data voltages VD2 respectively applied to the fifth to eighth sub-signal lines SL2_*i* to SL2_*i*+3 is opposite to that of the first data voltages VD1 respectively applied to the first to fourth sub-signal lines SL1_*i* to SL1_*i*+3. For example, the fifth and eighth sub-signal lines SL2_*i* and SL2_*i*+3 receive the negative second data voltages −VD2 during the first frame FRM1. The sixth and seventh sub-signal lines SL2_*i*+1 and SL2_*i*+2 receive the positive second data voltages +VD2 during the first frame FRM1.

During the first frame FRM1, the first DEMUX signal DMS1 is applied to the first switching devices SW1 of the first to fourth sub-DEMUX units 10_*i* to 10_*i*+3 through the first control line CL1.

Responsive to the first DEMUX signal DMS1, the first switching devices SW1 may selectively and alternately couple the first to fourth sub-signal lines SL1_*i* to SL1_*i*+3 to the second and first data lines DLj+1 and DLj+2, which are adjacent to each other, and to the first and second data lines DLj+4 and DLj+7, which are not adjacent to each other, in a unit of two lines.

For example, the first switching devices SW1 of the first and second sub-DEMUX units 10_*i* and 10_*i*+1 respectively couple the first and second sub-signal lines SL1_*i* and SL1_*i*+1 to the second sub-data line DLj+1 of the second data lines and the third sub-data line DLj+2 of the first data lines, which are adjacent to each other, in response to the first DEMUX signal DMS1. The first switching devices SW1 of the third and fourth sub-DEMUX units 10_*i*+2 and 10_*i*+3 respectively couple the third and fourth sub-signal lines SL1_*i*+2 and SL1_*i*+3 to the fifth sub-data line DLj+4 of the first data lines and the eighth sub-data line DLj+7 of the second data lines, which are not adjacent to each other, in response to the first DEMUX signal DMS1.

Accordingly, the positive first data voltages +VD1 are applied to the pixels PX coupled to the second data lines DLj+1 and DLj+7, and the negative first data voltages −VD1 are applied to the pixels PX coupled to the first data lines DLj+2 and DLj+4.

During the first frame FRM1, the first DEMUX signal DMS1 is applied to the fourth switching devices SW4 of the fifth to eighth sub-DEMUX units 20_*i* to 20_*i*+3 through the fourth control line CL4.

Responsive to the first DEMUX signal DMS1, the fourth switching devices SW4 may selectively and alternately couple the fifth to eighth sub-signal lines SL2_*i* to SL2_*i*+3 to the first and second data lines DLj and DLj+3, which are not adjacent to each other, and to the second and first data lines DLj+5 and DLj+6, which are adjacent to each other, in the unit of two lines.

For example, the fourth switching devices SW4 of the fifth and sixth sub-DEMUX units 20_*i* and 20_*i*+1 respectively couple the fifth and sixth sub-signal lines SL2_*i* and SL2_*i*+1 to the first sub-data line DLj of the first data lines and the fourth sub-data line DLj+3 of the second data lines, which are not adjacent to each other, in response to the first DEMUX signal DMS1. The fourth switching devices SW4 of the seventh and eighth sub-DEMUX units 20_*i*+2 and 20_*i*+3 respectively couple the seventh and eighth sub-signal lines SL2_*i*+2 and SL2_*i*+3 to the sixth sub-data line DLj+5 of the second data lines and seventh sub-data line DLj+6 of the first data lines, which are adjacent to each other, in response to the first DEMUX signal DMS1.

Therefore, the negative second data voltages −VD2 are applied to the pixels PX coupled to the first data lines DLj and DLj+6, and the positive second data voltages +VD2 are applied to the pixels PX coupled to (e.g., connected to) the second data lines DLj+3 and DLj+5.

In this case, the negative (−) and positive (+) voltages are alternately charged in the pixels PX in the row and column directions as shown in FIG. 17A. Thus, the pixels PX are driven by the one-dot inversion driving method (e.g., −, +, −, +).

Referring to FIG. 17B, during the second frame FRM2, the first and fourth sub-signal lines SL1_*i* and SL1_*i*+3 receive the negative first data voltages −VD1, and the second and third sub-signal lines SL1_*i*+1 and SL1_*i*+2 receive the positive first data voltages +VD1. The polarity of the second data voltages VD2 applied to the fifth to eighth sub-signal lines SL2_*i* to SL2_*i*+3 is opposite to the polarity of the corresponding first data voltages VD1 applied to the first to fourth sub-signal lines SL1_*i* to SL1_*i*+3.

In the second frame FRM2, the phase of the first and second DEMUX signals DMS1 and DMS2 is the same as the phase of the first and second DEMUX signals DMS1 and DMS2 in the first frame FRM1. Therefore, the connection structure between the first to eighth sub-signal lines SL1_*i* to SL1_*i*+3 and SL2_*i* to SL2_*i*+3 and the first and second data lines DLj to DLj+7 in the second frame FRM2 is substantially similar to that of the first frame FRM1.

However, the polarity of the first and second data voltages VD1 and VD2 applied to the pixels PX in the second frame FRM2 is different from the first frame FRM1 in that the polarity is inverted from the polarity of the first and second data voltages VD1 and VD2 in the first frame FRM1.

In this case, the polarity of the voltages charged in the pixels PX during the second frame FRM2 is opposite to the polarity of the voltages charged in the pixels PX during the first frame FRM1 as shown in FIG. 17B.

Referring to FIG. 17C, the polarity of the first and second data voltages VD1 and VD2 in the third frame FRM3 is the same as the polarity of the first and second data voltages VD1 and VD2 in the second frame FRM2. The phase of the first and second DEMUX signals DMS1 and DMS2 in the third frame FRM3 is opposite to that of the first and second DEMUX signals DMS1 and DMS2 in the second frame FRM2.

During the third frame FRM3, the second DEMUX signal DMS2 is applied to the second switching devices SW2 of the first to fourth sub-DEMUX units 10_*i* to 10_*i*+3 through the second control line CL2.

Responsive to the second DEMUX signal DMS2, the second switching devices SW2 may selectively and alternately couple the first to fourth sub-signal lines SL1_*i* to SL1_*i*+3 to the first and second data lines DLj and DLj+3, which are not adjacent to each other, and the second and first data lines DLj+5 and DLj+6, which are adjacent to each other, in the unit of two lines.

For example, the second switching devices SW2 of the first and second sub-DEMUX units 10_*i* and 10_*i*+1 respectively couple the first and second sub-signal lines SL1_*i* and SL1_*i*+1 to the first sub-data line DLj of the first data lines and the fourth sub-data line DLj+3 of the second data lines, which are not adjacent to each other, in response to the second DEMUX signal DMS2. The second switching devices SW2 of the third and fourth sub-DEMUX units 10_*i*+2 and 10_*i*+3 respectively couple the third and fourth sub-signal lines SL1_*i*+2 and SL1_*i*+3 to the sixth sub-data line DLj+5 of the second data lines and seventh sub-data line DLj+6 of the first data lines, which are adjacent to each other, in response to the first DEMUX signal DMS1.

Thus, the negative first data voltages −VD1 are applied to the pixels PX coupled to the first data lines DLj and DLj+6, and the positive first data voltages +VD1 are applied to the pixels PX coupled to the second data lines DLj+3 and DLj+5.

During the third frame FRM3, the second DEMUX signal DMS2 is applied to the third switching devices SW3 of the fifth to eighth sub-DEMUX units 20_*i* to 20_*i*+3 through the third control lines CL3.

Responsive to the second DEMUX signal DMS2, the third switching devices SW3 may selectively and alternately couple the fifth to eighth sub-signal lines SL2_*i* to SL2_*i*+3 to the second and first data lines DLj+1 and DLj+2, which are adjacent to each other, and first and second data lines DLj+4 and DLj+7, which are not adjacent to each other, in the unit of two lines.

For example, the third switching devices SW3 of the fifth and sixth sub-DEMUX units 20_*i* and 20_*i*+1 respectively couple the fifth and sixth sub-signal lines SL2_*i* and SL2_*i*+1 to the second sub-data line DLj+1 of the second data lines and the third sub-data line DLj+2 of the first data lines, which are adjacent to each other, in response to the second DEMUX signal DMS2. The third switching devices SW3 of the seventh and eighth sub-DEMUX units 20_*i*+2 and 20_*i*+3 respectively couple the seventh and eighth sub-signal lines SL2_*i*+2 and SL2_*i*+3 to the fifth sub-data line DLj+4 of the first data lines and the eighth sub-data line DLj+7 of the second data lines, which are not adjacent to each other, in response to the second DEMUX signal DMS2.

Accordingly, the positive second data voltages +VD2 are applied to the pixels PX coupled to the second data lines DLj+1 and DLj+7, and the negative second data voltages −VD2 are applied to the pixels PX coupled to the first data lines DLj+2 and DLj+4.

In this case, the polarity of the voltages charged in the pixels PX in the third frame FRM3 is opposite to the polarity of the voltages charged in the pixels PX in the second frame FRM2 as shown in FIG. 17C.

Referring to FIG. 17D, during the fourth frame FRM4, the first and fourth sub-signal lines SL1_*i* and SL1_*i*+3 receive the positive first data voltages +VD1, and the second and third sub-signal lines SL1_*i*+1 and SL1_*i*+2 receive the negative first data voltages −VD1. The polarity of the second data voltages VD2 applied to the fifth to eighth sub-signal lines SL2_*i* to SL2_*i*+3 is opposite to the polarity of corresponding first data voltages VD1 applied to the first to fourth sub-signal lines SL1_*i* to SL1_*i*+3.

In the fourth frame FRM4, the phase of the first and second DEMUX signals DMS1 and DMS2 is the same as the phase of the first and second DEMUX signals DMS1 and DMS2 in the third frame FRM3. Therefore, the connection structure between the first to eighth sub-signal lines SL1_*i* to SL1_*i*+3 and SL2_*i* to SL2_*i*+3 and the first and second data lines DLj to DLj+7 in the fourth frame FRM4 is substantially similar to that of the third frame FRM3.

However, the polarity of the first and second data voltages VD1 and VD2 applied to the pixels PX in the fourth frame FRM4 is different from the third frame FRM3 in that the polarity is inverted from the polarity of the first and second data voltages VD1 and VD2 in the third frame FRM3.

In this case, the polarity of the voltages charged in the pixels PX during the fourth frame FRM4 is opposite to the polarity of the voltages charged in the pixels PX during the third frame FRM3 as shown in FIG. 17D.

Due to the above-described operation, the polarity of the pixels PX is inverted during each frame, and the pixels PX are driven by the one-dot inversion driving method.

A timing diagram of the charge voltage charged in the first and second pixels PX1 and PX2 shown in FIGS. 17A and 17C is substantially similar to the timing diagram of the charge voltage charged in the first and second pixels PX1 and PX2 shown in FIGS. 5A and 5B. Therefore, the difference in brightness between the pixels PX may be reduced and the vertical line, which is caused by the signal delay in the data lines, may be substantially prevented.

Consequently, the display apparatus 300 according to the third embodiment of the present invention may substantially prevent the vertical line from occurring.

Figure 18:
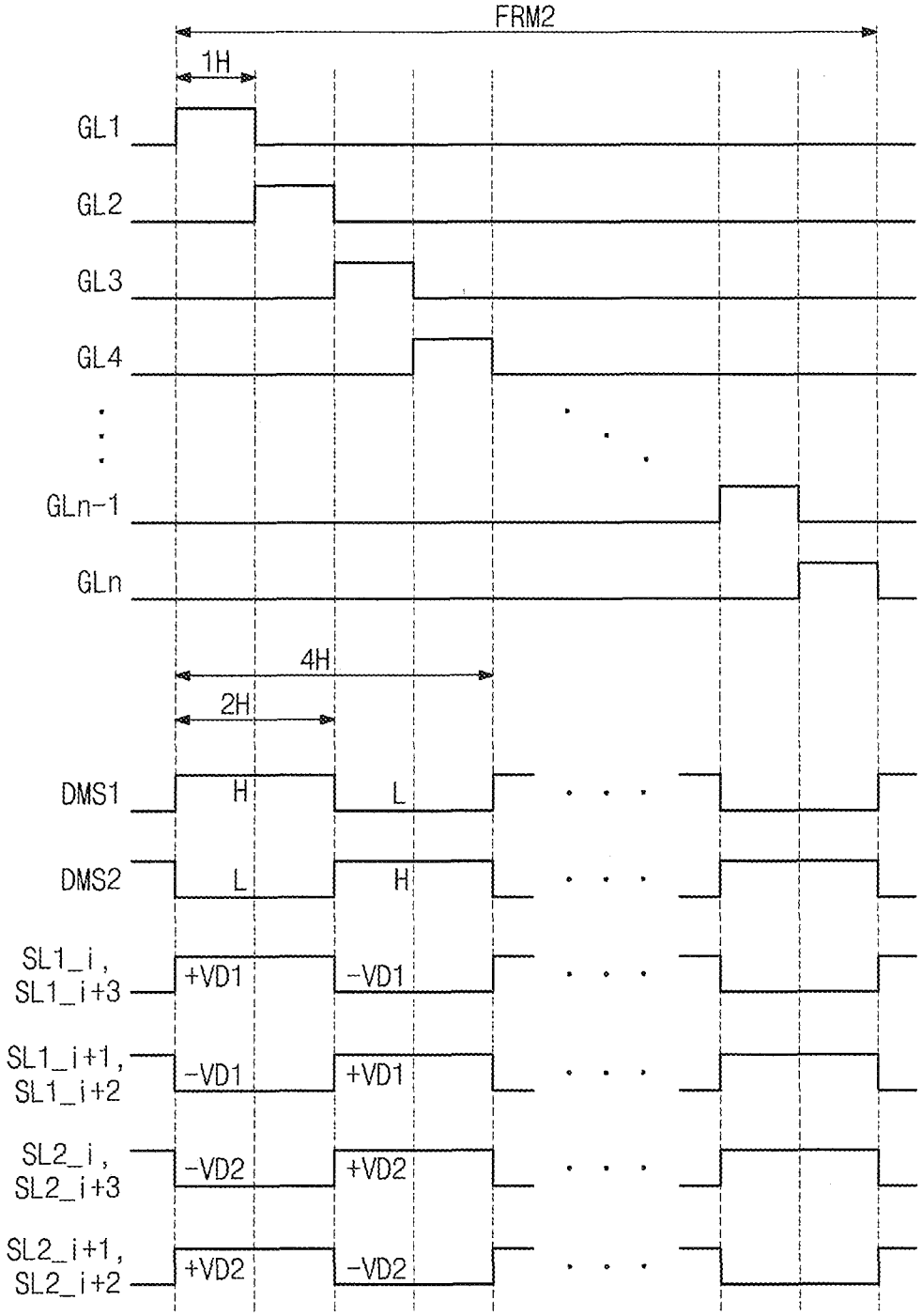
FIG. 18 is a signal timing diagram showing an operation of the pixels shown in FIG. 15 in the first frame according to another embodiment of the present disclosure.
Figure 19:
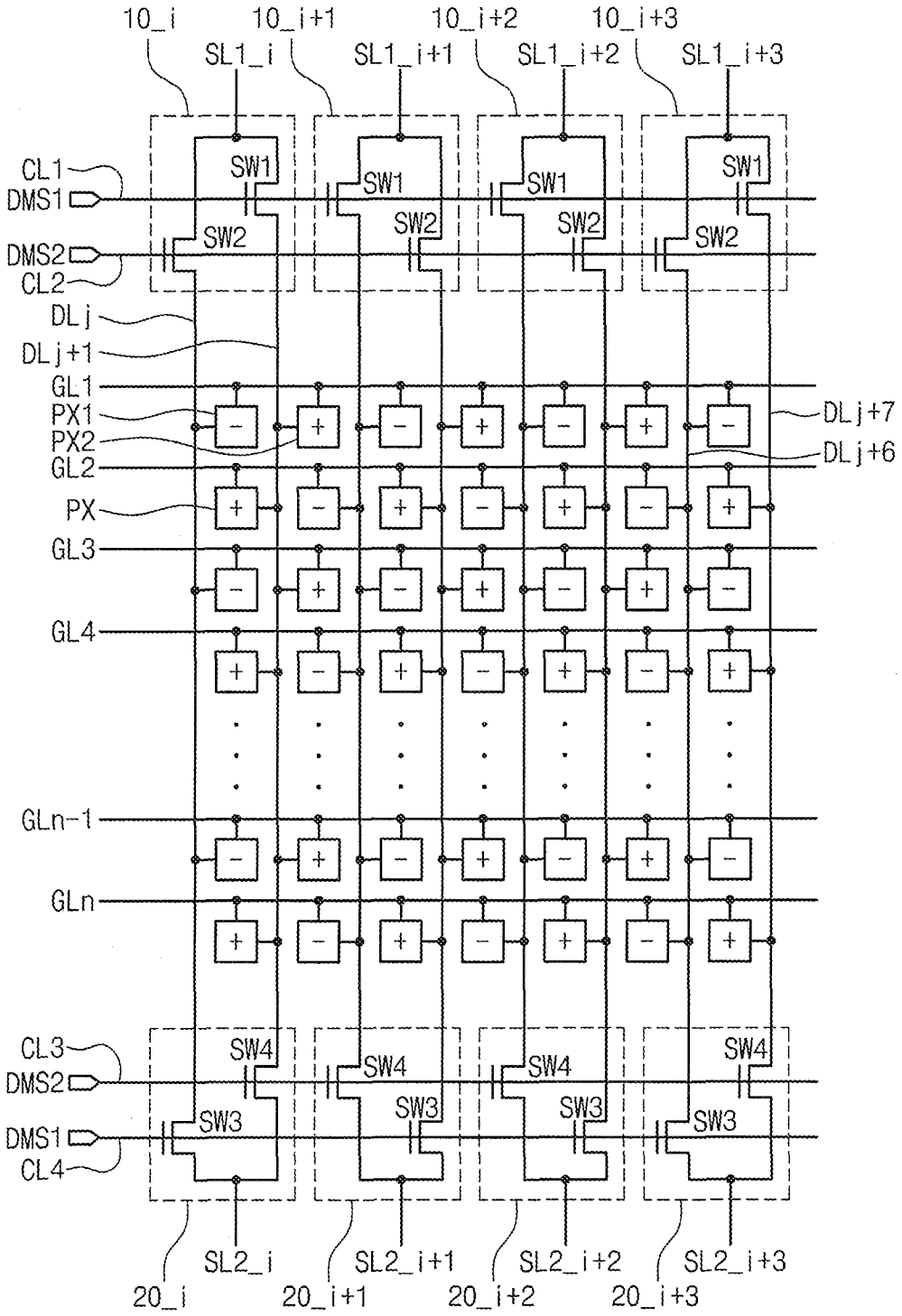
FIG. 19 is a circuit diagram showing an operation state of the pixels according to the signal timing diagram in the first frame shown in FIG. 18.

FIG. 18 is a signal timing diagram showing the operation of the pixels shown in the embodiment of FIG. 15 in the first frame according to another embodiment of the present disclosure, and FIG. 19 is a circuit diagram showing the operation state of the pixels according to the signal timing diagram in the first frame shown in FIG. 18.

The timing diagram of the gate signals and the first and second DEMUX signals DMS1 and DMS2 shown in FIG. 18 is substantially similar to the timing diagram of the gate signals and the first and second DEMUX signals DMS1 and DMS2 shown in FIG. 9. Thus, hereinafter, the timing diagram of the first and second data voltages VD1 and VD2 applied to the first and second signal lines SL1-*i* to SL1_*i*+3 and SL2_*i* to SL2_*i*+3 will be described.

Referring to FIG. 18, the positive and negative first data voltages +VD1 and −VD1 may be repeatedly applied to the first signal lines SL1_*i* to SL1_*i*+3.

For example, when the first and second gate signals are applied to the pixels PX, the first and fourth sub-signal lines SL1_*i* and SL1_*i*+3 receive the positive first data voltages +VD1, and the second and third sub-signal lines SL1_*i*+1 and SL1_*i*+2 receive the negative first data voltages −VD1.

The polarity of the first data voltages VD1 is inverted every two periods (2H). Therefore, when the third and fourth gate signals are applied to the pixels PX, the first and fourth sub-signal lines SL1_*i* and SL1_*i*+3 receive the negative first data voltages −VD1, and the second and third sub-signal lines SL1_*i*+1 and SL1_*i*+2 receive the positive first data voltages +VD1.

As shown in FIG. 18, the polarity of the second data voltages VD2 is opposite to that of corresponding first data voltages VD1, and inverted every two periods (2H).

Referring to FIG. 19, when the first and second gate signals are applied to the pixels PX, the first and fourth sub-signal lines SL1_*i* and SL1_*i*+3 receive the positive first data voltage +VD1, and the second and third sub-signal lines SL1_*i*+1 and SL1_*i*+2 receive the negative first data voltage −VD1. In addition, the polarity of the second data voltages VD2 is opposite to that of the corresponding first data voltages VD1.

The connection structure of the first to fourth switching devices SW1 to SW4 coupling the first and second signal lines SL1_*i* to SL1_*i*+3 and SL2_*i* to SL2_*i*+3 to the first and second data lines DLj to DLj+7 in response to the first and second DEMUX signals DMS1 and DMS2 is substantially similar to that described earlier with reference to FIGS. 17A to 17D, and thus the description of the connection structure will be omitted.

When the first gate signal is applied to the pixels PX, the first switching devices SW1 apply the first data voltages VD1 to the pixels PX coupled to (e.g., connected to) the first and second data lines DLj+1, DLj+2, DLj+4, and DLj+7 among the pixels PX coupled to the first gate line GL1, in response to the first DEMUX signal DMS1.

In addition, when the first gate signal is applied to the pixels PX, the fourth switching devices SW4 apply the second data voltages VD2 to the pixels PX coupled to the first and second data lines DLj, DLj+3, DLj+5, and DLj+6 among the pixels PX coupled to the first gate line GL1, in response to the first DEMUX signal DMS1.

In this case, the negative (−) and positive (+) voltages are alternately charged in the pixels PX arranged in the first row as shown in FIG. 19.

When the second gate signal is applied to the pixels PX, the first switching devices SW1 apply the first data voltages VD1 to the pixels PX coupled to the first and second data lines DLj+1, DLj+2, DLj+4, and DLj+7 among the pixels PX coupled to the second gate line GL2, in response to the first DEMUX signal DMS1.

In addition, when the second gate signal is applied to the pixels PX, the fourth switching devices SW4 apply the second data voltages VD2 to the pixels PX coupled to the first and second data lines DLj, DLj+5, and DLj+6 among the pixels PX coupled to the second gate line GL2, in response to the first DEMUX signal DMS1.

In this case, the positive (+) and negative (−) voltages are alternately charged in the pixels PX positioned in the second row as shown in FIG. 19.

When the third and fourth gate signals are applied to the pixels, the polarity of the first and second data voltages VD1 and VD2 is opposite to the polarity of the first and second data voltages VD1 and VD2 when the first and second gate signals are applied to the pixels.

When the third gate signal is applied to the pixels PX, the second switching devices SW2 apply the first data voltages VD1 to the pixels PX coupled to the first and second data lines DLj, DLj+3, DLj+5, and DLj+6 among the pixels PX coupled to the third gate line GL3, in response to the second DEMUX signal DMS2.

In addition, when the third gate signal is applied to the pixels PX, the third switching devices SW3 apply the second data voltages VD2 to the pixels PX coupled to the first and second data lines DLj+1, DLj+2, DLj+4, and DLj+7 among the pixels PX coupled to the third gate line GL3, in response to the second DEMUX signal DMS2.

In this case, the negative (−) and positive (+) voltages are alternately charged in the pixels PX positioned in the third row as shown in FIG. 19.

When the fourth gate signal is applied to the pixels PX, the second switching devices SW2 apply the first data voltages VD1 to the pixels PX coupled to the first and second data lines DLj, DLj+3, DLj+5, and DLj+6 among the pixels PX coupled to the fourth gate line GL4, in response to the second DEMUX signal DMS2.

In addition, when the fourth gate signal is applied to the pixels PX, the third switching devices SW3 apply the second data voltages VD2 to the pixels PX coupled to the first and second data lines DLj+1, DLj+2, DLj+4, and DLj+7 among the pixels PX coupled to the fourth gate line GL4, in response to the second DEMUX signal DMS2.

In this case, the positive (+) and negative (−) voltages are alternately charged in the pixels PX positioned in the fourth row as shown in FIG. 19.

Figure 20:
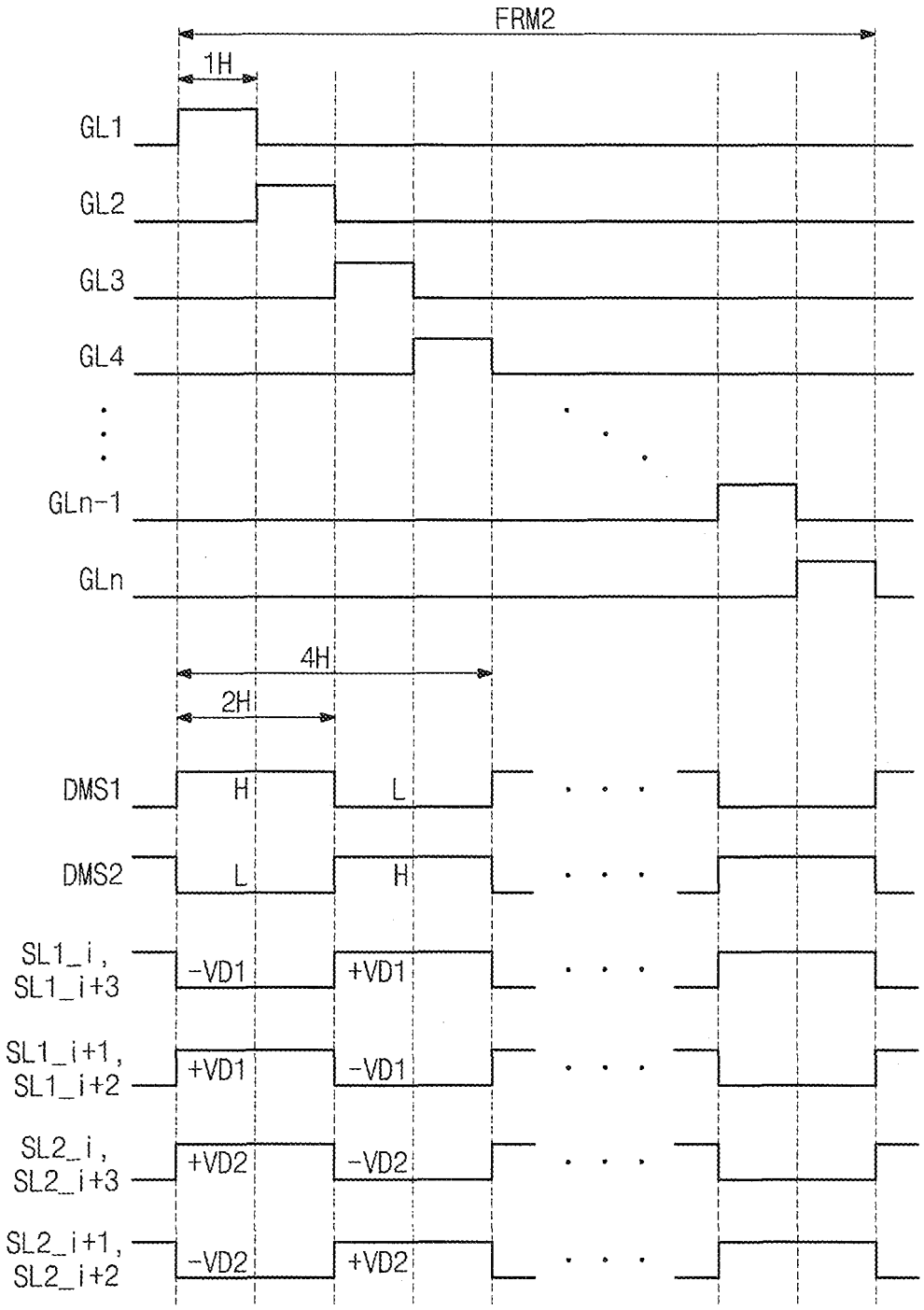
FIG. 20 is a signal timing diagram showing an operation of the pixels shown in FIG. 15 in the second frame according to another embodiment of the present disclosure.
Figure 21:
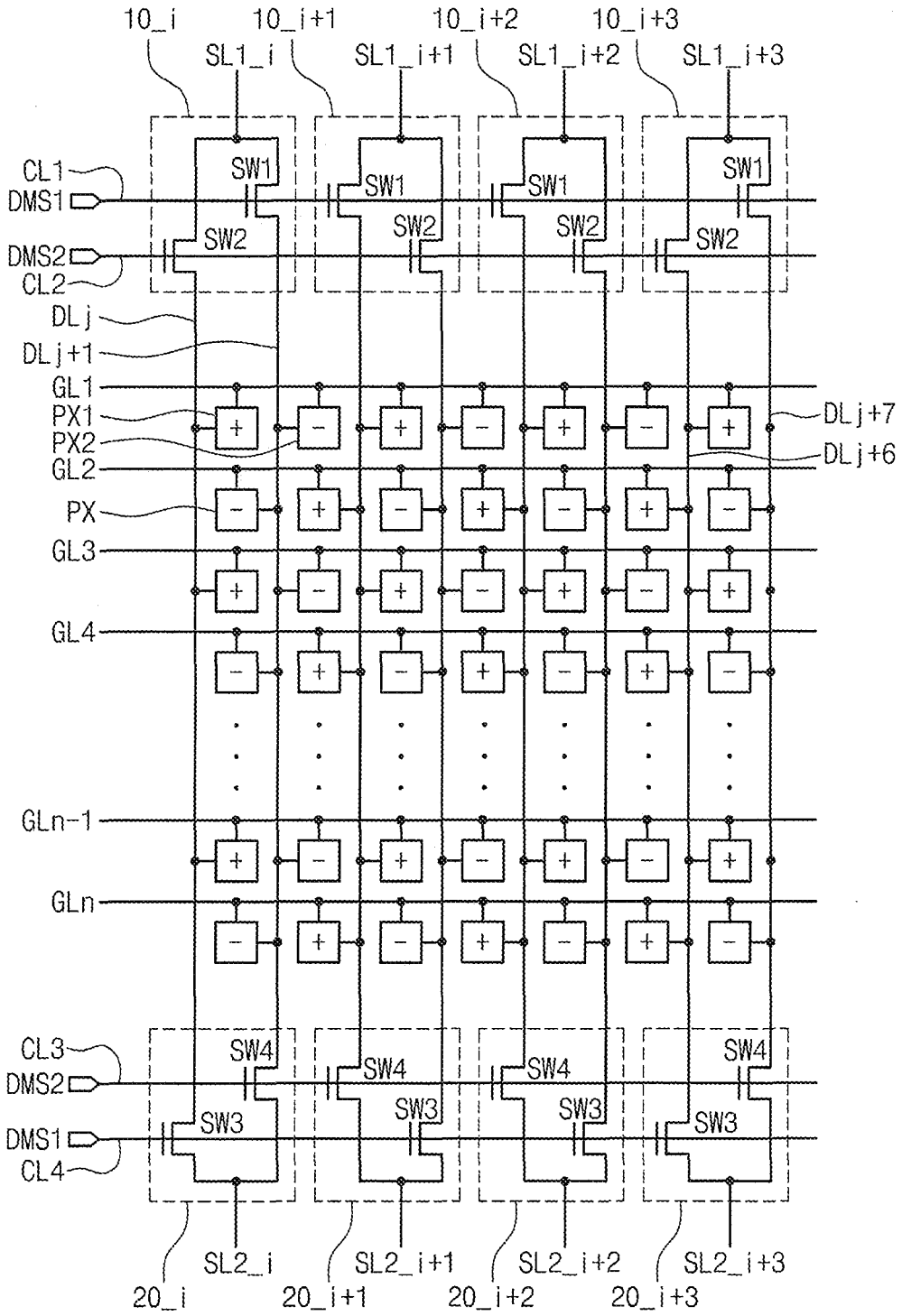
FIG. 21 is a circuit diagram showing an operation state of the pixels according to the signal timing diagram in the second frame shown in FIG. 20.

FIG. 20 is a signal timing diagram showing the operation of the pixels shown in the embodiment of FIG. 15 in the second frame according to another embodiment of the present disclosure, and FIG. 21 is a circuit diagram showing the operation state of the pixels according to the signal timing diagram in the second frame shown in FIG. 20.

Referring to FIGS. 20 and 21, the polarity of the first data voltages VD1 of the second frame FRM2 is opposite to the polarity of the first data voltages VD1 of the first frame FRM1 shown in FIG. 18. In addition, the polarity of the second data voltages VD2 of the second frame FRM2 is opposite to the polarity of the second data voltages VD2 of the first frame FRM1 shown in FIG. 18.

Because the polarity of the first and second data voltages VD1 and VD2 is inverted in the second frame FRM2, the polarity of the voltages charged in the pixels PX is inverted in the second frame FRM2 in a different polarity from that of the first frame FRM1. That is, the polarity of the pixels PX in the first frame FRM1 is inverted in the second frame FRM2 as shown in FIGS. 19 and 21.

The polarity of the first and second data voltages VD1 and VD2 of the second frame FRM2 may be set to the same polarity as that of the first and second data voltages VD1 and VD2 of the first frame FRM1. In addition, the phase of the first and second DEMUX signals DMS1 and DMS2 in the second frame FRM2 may be opposite to the phase of the first and second DEMUX signals DMS1 and DMS2 in the first frame FRM1.

When the signals of the first and second frames FRM1 and FRM2 shown in FIGS. 18 and 20 are repeatedly applied to the pixels PX, the polarity of the pixels PX may be inverted during each frame, and the pixels PX may be driven by the one-dot inversion driving method.

In addition, a timing diagram of the charge voltage charged in the first and second pixels PX1 and PX2 shown in FIGS. 19 and 21 is substantially similar to the timing diagram of the charge voltage charged in the first and second pixels PX1 and PX2 shown in FIGS. 5A and 5B. Therefore, the difference in brightness between the pixels PX may be reduced, and the vertical line, which is caused by the signal delay in the data lines, may be substantially prevented.

Consequently, the display apparatus 300 according to the third embodiment may substantially prevent the vertical line from occurring.

Figure 22:
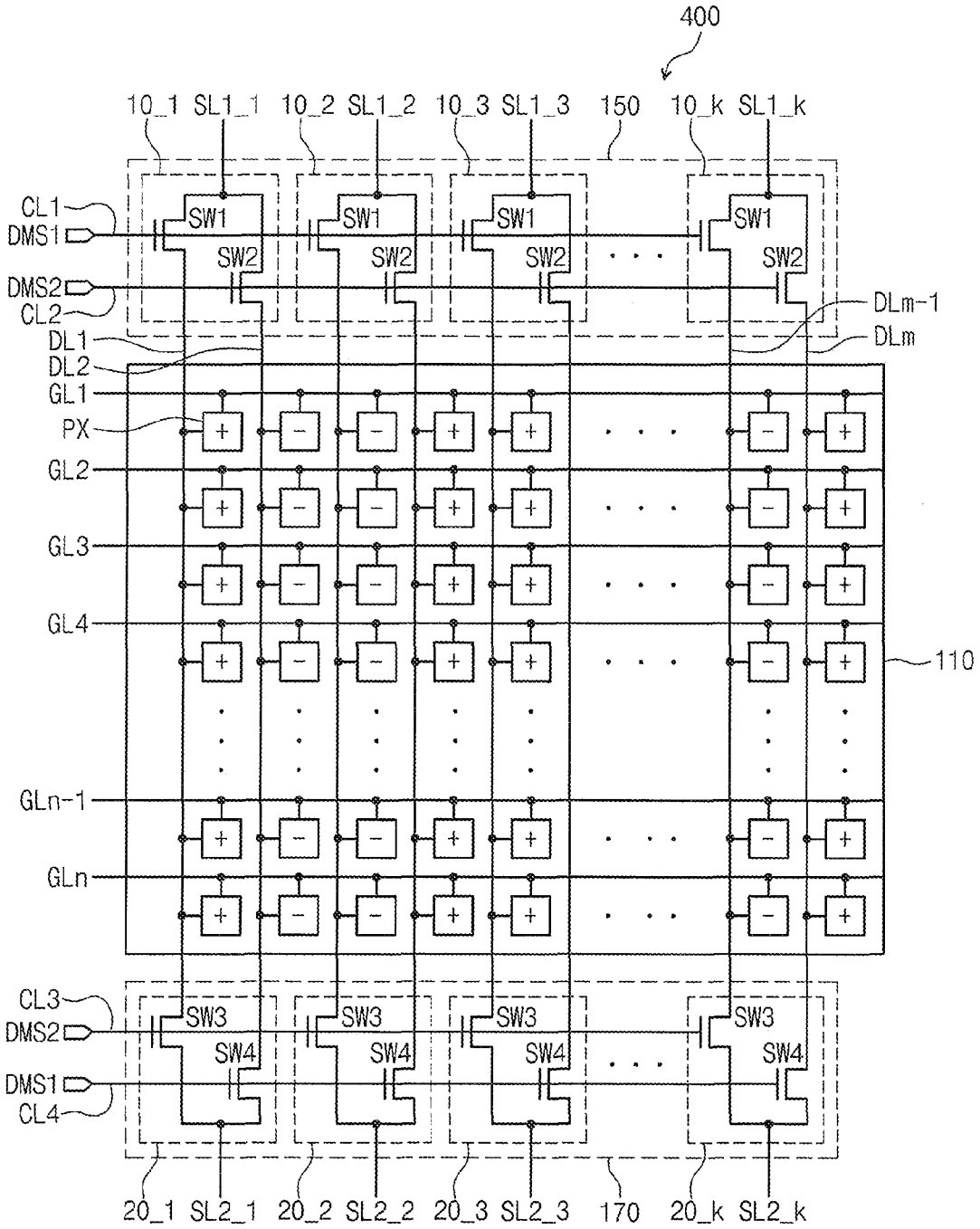
FIG. 22 is a circuit diagram showing a display apparatus according to a fourth embodiment of the present disclosure.

FIG. 22 is a circuit diagram showing a display apparatus 400 according to a fourth embodiment of the present disclosure.

The display apparatus 400 shown in FIG. 22 has a substantially similar structure and function as those of the display apparatus 100 shown in the embodiments of FIGS. 1 and 2, except for a connection structure between the pixels PX and the data lines DL1 to DLm. Accordingly, hereinafter, the different portions of the fourth embodiment will be described with reference to FIG. 22.

Referring to FIG. 22, pixels PX positioned in a matrix form are coupled to (e.g., connected to) corresponding gate lines GL1 to GLn and corresponding data lines DL1 to DLm.

The pixels PX receive data voltages provided through the corresponding data lines DL1 to DLm in response to gate signals provided through the corresponding gate lines GL1 to GLn.

First and second DEMUX parts 150 and 170 shown in FIG. 22 have a substantially similar structure and function as those of the first and second DEMUX parts 150 and 170 shown in the embodiment of FIG. 2. In addition, the timing diagram to drive the pixels PX may be substantially similar to the timing diagram shown in FIG. 3.

For example, the polarity of the voltages charged in the pixels PX during a first frame shown in FIG. 22, may be obtained by using (e.g., utilizing) the timing diagram shown in FIG. 3. When the timing diagram shown in FIG. 3 is applied, the pixels PX are driven by the two-dot inversion driving method in the column direction.

The polarity of the voltages charged in the pixels PX shown in FIG. 22 may be inverted during each frame as the above-described display apparatuses.

The first and second DEMUX parts 150 and 170 of the display apparatuses 200 and 300 according to the second and third embodiments of the present invention may be applied to the display apparatus 400 according to the fourth embodiment of the present invention.

Due to the above-described structure, the difference in brightness between the pixels PX may be reduced, and the vertical line, which is caused by the signal delay in the data lines, may be substantially prevented.

Consequently, the display apparatus 400 according to the fourth embodiment of the present invention may substantially prevent the vertical line from occurring.

Figure 23:
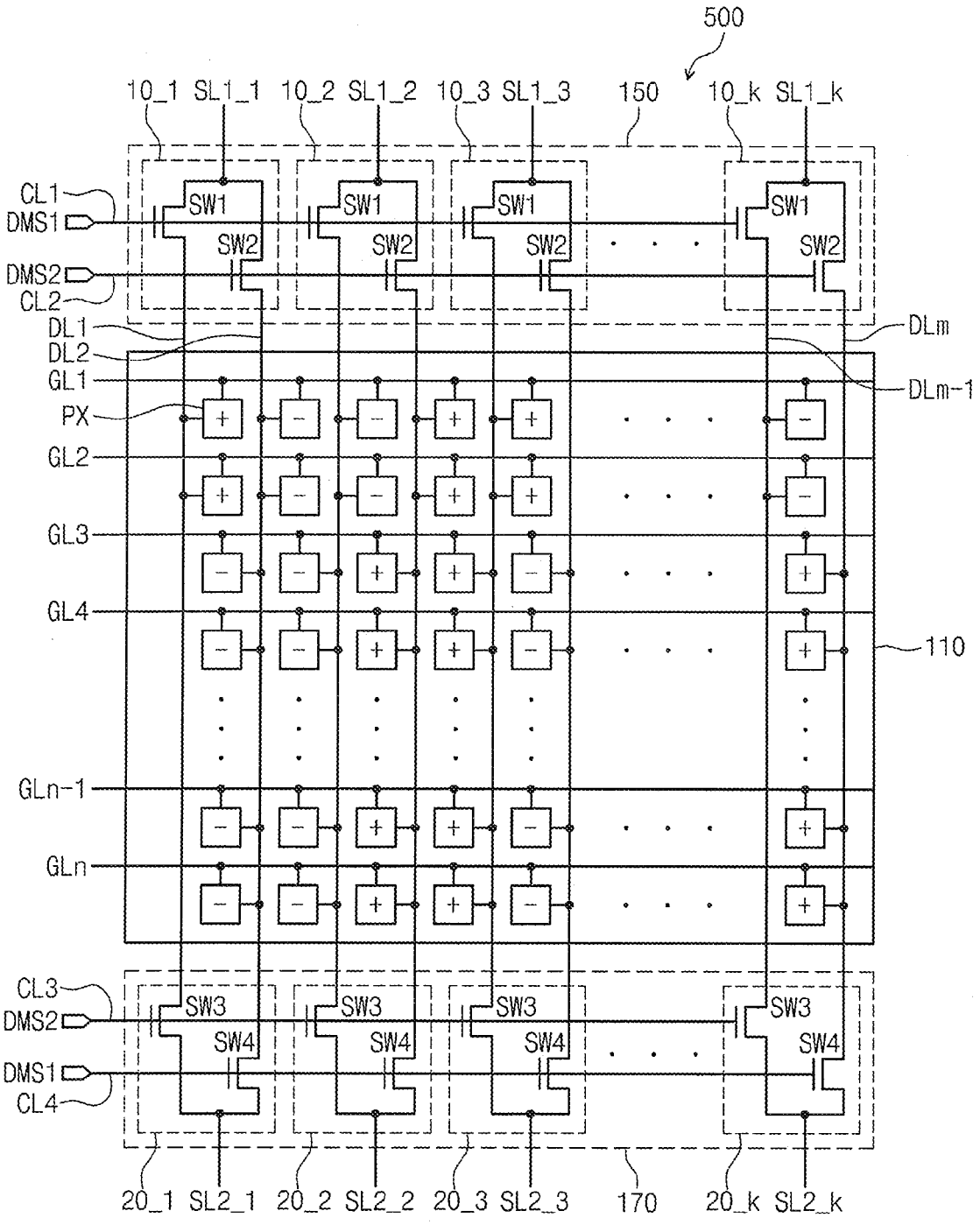
FIG. 23 is a circuit diagram showing a display apparatus according to a fifth embodiment of the present disclosure.

FIG. 23 is a circuit diagram showing a display apparatus 500 according to a fifth embodiment of the present disclosure.

The display apparatus 500 shown in FIG. 23 has a substantially similar structure and function as those of the display apparatus 100 shown in the embodiments of FIGS. 1 and 2, except for a connection structure between the pixels PX and the data lines DL1 to DLm. Accordingly, hereinafter, different portions of the fifth embodiment will be described with reference to FIG. 23.

Referring to FIG. 23, the pixels PX positioned in a matrix form are coupled to corresponding gate lines GL1 to GLn. In addition, the pixels PX are alternately coupled to the data lines DL1 to DLm in the unit of two rows.

For example, the pixels PX positioned in the first and second rows are coupled to the data lines DL1 to DLm adjacent to a left side thereof. The pixels PX positioned in the third and fourth rows are coupled to the data lines DL1 to DLm adjacent to a right side thereof.

This connection structure may be called a two-line staggered structure. That is, the pixels PX may be positioned to be alternately coupled to the data lines DL1 to DLm in the unit of two rows, but they are not limited thereto. For example, in another embodiment, the pixels PX may be positioned to be alternately coupled to the data lines DL1 to DLm in the unit of three or more rows.

For example, the pixels PX positioned in the first to third rows are coupled to the data lines DL1 to DLm adjacent to the left side thereof, and the pixels PX positioned in the fourth to sixth rows are coupled to the data lines DL1 to DLm adjacent to the right side thereof.

The pixels PX receive the data voltages provided through the data lines DL1 to DLm in response to the gate signals provided through the gate lines GL1 to GLn.

First and second DEMUX units 150 and 170 have a substantially similar configuration and function as those of the first and second DEMUX units 150 and 170 shown in the embodiment of FIG. 2. In addition, the timing diagram to drive the pixels PX may be substantially similar to the timing diagram shown in FIG. 3.

For example, the polarity of the voltages charged in the pixels PX during a first frame as shown in FIG. 23, may be obtained by using (e.g., utilizing) the timing diagram shown in FIG. 3. When the timing diagram shown in FIG. 3 is applied, the pixels PX are driven by the two-dot inversion driving method in the row direction. In addition, the pixels PX are driven in the same dot pattern in the unit of two rows.

In addition, the pixels PX positioned in the odd-numbered columns are driven by the two-dot inversion driving method in the column direction, and the polarity of the pixels PX is inverted every odd-numbered column. The pixels PX positioned in the same even-numbered column have the same polarity, and the polarity of the pixels is inverted every even-numbered column.

The polarity of the voltages charged in the pixels PX shown in FIG. 23 may be inverted during each frame as the above-described display apparatuses.

According to the polarity pattern of the pixels PX shown in FIG. 4A, the polarity pattern shown in FIG. 4A is repeated every two rows in FIG. 23. Because a one-line staggered arrangement is changed to the two-line staggered arrangement, the polarity pattern may be predicted.

The number of the staggered lines, however, is not limited to two, and the polarity pattern may be predicted even though the number of the staggered lines increases.

The first and second DEMUX parts 150 and 170 of the display apparatuses 200 and 300 according to the second and third embodiments of the present invention may be applied to the display apparatus 500 according to the fifth embodiment.

Due to the above-described structure, the difference in brightness between the pixels PX may be reduced, and the vertical line, which is caused by the signal delay in the data lines, may be substantially prevented.

Consequently, the display apparatus 500 according to the fifth embodiment of the present invention may substantially prevent the vertical line from occurring.

Although the embodiments of the present invention have been described, it is understood by a person having ordinary skill in the art that various modifications may be made without departing from the spirit and scope of the present invention as defined by the appended claims and equivalents thereof.

What is claimed is:

1. A display apparatus comprising:

a plurality of pixels coupled to gate lines and to data lines configured to cross the gate lines;

a gate driver configured to apply gate signals to the gate lines;

a first data driver configured to apply first data voltages to first signal lines;

a first DEMUX part configured to selectively couple the first signal lines to the data lines;

a second data driver configured to apply second data voltages to second signal lines positioned to correspond to the first signal lines; and a second DEMUX part positioned to face the first DEMUX part such that the pixels are positioned between the first and second DEMUX parts, the second DEMUX part configured to couple the second signal lines to the data lines, which are not coupled to the first signal lines, wherein each of the first data voltages has a polarity opposite to a polarity of a corresponding second data voltage of the second data voltages, wherein the data lines comprise odd-numbered data lines and even-numbered data lines, and wherein the pixels arranged in a same column are alternately coupled to a corresponding one of the odd-numbered data lines and a corresponding one of the even-numbered data lines along a column direction to be alternately coupled to the first and second DEMUX parts along the column direction.

2. The display apparatus of claim 1, wherein the data lines comprise:

first data lines corresponding to the odd-numbered data lines of the data lines; and second data lines corresponding to the even-numbered data lines of the data lines, wherein the first DEMUX part comprises a plurality of first DEMUX units configured to selectively couple the first signal lines to the first and second data lines in response to first and second DEMUX signals, and the second DEMUX part comprises a plurality of second DEMUX units configured to couple the second signal lines to the first and second data lines, which are not coupled to the first signal lines, in response to the first and second DEMUX signals.

3. The display apparatus of claim 2, wherein the first DEMUX units comprise:

first switching devices configured to couple the first signal lines to the first data lines in response to the first DEMUX signal; and second switching devices configured to couple the first signal lines to the second data lines in response to the second DEMUX signal.

4. The display apparatus of claim 3, wherein the second DEMUX units comprise:

third switching devices configured to couple the second signal lines to the first data lines in response to the second DEMUX signal; and fourth switching devices configured to couple the second signal lines to the second data lines in response to the first DEMUX signal.

5. The display apparatus of claim 4, wherein the first DEMUX signal has a period corresponding to 4N times of one frame, is activated during a period corresponding to 2N times of the one frame to switch the first and fourth switching devices, and has a phase opposite to a phase of the second DEMUX signal, where N is an integer number greater than 0.

6. The display apparatus of claim 5, wherein:

first, second, third, and fourth frames are sequentially repeated, the first data voltages applied to odd-numbered first signal lines in the first and fourth frames have a polarity opposite to a polarity of the first data voltages applied to the odd-numbered first signal lines in the second and third frames, and the first data voltages applied to the odd-numbered first signal lines have a polarity opposite to a polarity of the first data voltages applied to even-numbered first signal lines.

7. The display apparatus of claim 2, wherein the first DEMUX units comprise:

first switching devices configured to alternately couple the first signal lines to odd-numbered first data lines and even-numbered second data lines in response to the first DEMUX signal; and second switching devices configured to alternately couple the first signal lines to odd-numbered second data lines and even-numbered first data lines in response to the second DEMUX signal.

8. The display apparatus of claim 7, wherein the first switching devices of odd-numbered first DEMUX units are configured to couple odd-numbered first signal lines to the odd-numbered first data lines in response to the first DEMUX signal, and the first switching devices of even-numbered first DEMUX units are configured to couple even-numbered first signal lines to the even-numbered second data lines in response to the first DEMUX signal.

9. The display apparatus of claim 7, wherein the second switching devices of odd-numbered first DEMUX units are configured to couple odd-numbered first signal lines to the odd-numbered second data lines in response to the second DEMUX signal, and the second switching devices of even-numbered second DEMUX units are configured to couple even-numbered first signal lines to the even-numbered first data lines in response to the second DEMUX signal.

10. The display apparatus of claim 7, wherein the second DEMUX units comprise:

third switching devices configured to alternately couple the second signal lines to the odd-numbered first data lines and the even-numbered second data lines in response to the second DEMUX signal; and fourth switching devices configured to alternately couple the second signal lines to the odd-numbered second data lines and the even-numbered first data lines in response to the first DEMUX signal.

11. The display apparatus of claim 10, wherein the third switching devices of odd-numbered second DEMUX units are configured to couple odd-numbered second signal lines to the odd-numbered first data lines in response to the second DEMUX signal, and the third switching devices of even-numbered second DEMUX units are configured to couple even-numbered second signal lines to the even-numbered second data lines in response to the second DEMUX signal.

12. The display apparatus of claim 10, wherein the fourth switching devices of odd-numbered second DEMUX units are configured to couple odd-numbered second signal lines to the odd-numbered second data lines in response to the first DEMUX signal, and the fourth switching devices of even-numbered second DEMUX units are configured to couple even-numbered second signal lines to the even-numbered first data lines in response to the first DEMUX signal.

13. The display apparatus of claim 10, wherein the first DEMUX signal has a period corresponding to 4N times of one frame, is activated during a period corresponding to 2N times of the one frame to switch the first and fourth switching devices, and has a phase opposite to a phase of the second DEMUX signal, where N is an integer number greater than 0.

14. The display apparatus of claim 13, wherein, first, second, third, and fourth frames are sequentially repeated, the first data voltages applied to odd-numbered first signal lines in the first and fourth frames have a polarity opposite to a polarity of the first data voltages applied to the odd-numbered first signal lines in the second and third frames, and the first data voltages applied to the odd-numbered first signal lines have a polarity opposite to a polarity of the first data voltages applied to even-numbered first signal lines.

15. The display apparatus of claim 10, wherein the gate signals are sequentially applied to the gate lines, each of the gate signals has an activation period corresponding to one period, and the first DEMUX signal has a period corresponding to 4M times of one period, is activated during a period corresponding to 2M times of the one period to switch the first and fourth switching devices, and has a phase opposite to a phase of the second DEMUX signal, where M is an integer number greater than 0.

16. The display apparatus of claim 15, wherein the first data voltages applied to odd-numbered first signal lines have a polarity opposite to a polarity of the first data voltages applied to even-numbered first signal lines, and the polarity of the first data voltages is inverted every 2M time period.

17. The display apparatus of claim 2, wherein:

the first DEMUX units comprise first, second, third, and fourth sub-DEMUX units sequentially and repeatedly positioned, the second DEMUX units comprise fifth, sixth, seventh, and eighth sub-DEMUX units sequentially and repeatedly positioned, the first signal lines comprise first, second, third, and fourth sub-signal lines sequentially and repeatedly positioned and coupled to corresponding first, second, third, and fourth sub-DEMUX units, and the second signal lines comprise fifth, sixth, seventh, and eighth sub-signal lines sequentially and repeatedly positioned and coupled to corresponding fifth, sixth, seventh, and eighth sub-DEMUX units.

18. The display apparatus of claim 17, wherein the first to fourth sub-DEMUX units comprise:

first switching devices configured to alternately couple the first to fourth sub-signal lines to second and first data lines, which are adjacent to each other, and first and second data lines, which are not adjacent to each other, in a unit of two lines in response to the first DEMUX signal; and second switching devices configured to alternately couple the first to fourth sub-signal lines to first and second data lines, which are not adjacent to each other, and second and first data lines, which are adjacent to each other, in a unit of two lines in response to the second DEMUX signal.

19. The display apparatus of claim 18, wherein the fifth to eighth sub-DEMUX units comprise:

third switching devices configured to alternately couple the fifth to eighth sub-signal lines to second and first data lines, which are adjacent to each other, and first and second data lines, which are not adjacent to each other, in the unit of two lines in response to the second DEMUX signal; and fourth switching devices configured to alternately couple the fifth to eighth sub-signal lines to first and second data lines, which are not adjacent to each other, and second and first data lines, which are adjacent to each other, in the unit of two lines in response to the first DEMUX signal.

20. The display apparatus of claim 19, wherein the first DEMUX signal has a period corresponding to 4N times of one frame, is activated during a period corresponding to 2N times of the one frame to switch the first and fourth switching devices, and has a phase opposite to a phase of the second DEMUX signal, where N is an integer number greater than 0.

21. The display apparatus of claim 20, wherein, first, second, third, and fourth frames are sequentially repeated, the first data voltages applied to the first and fourth sub-signal lines in the first and fourth frames have a polarity opposite to a polarity of the first data voltages applied to the first and fourth sub-signal lines in the second and third frames, the first data voltages applied to the first and fourth sub-signal lines have a polarity opposite to a polarity of the first data voltages applied to the second and third sub-signal lines, and the second data voltages applied to the fifth to eighth sub-signal lines have a polarity of the first data voltages applied to the first to fourth sub-signal lines corresponding to the fifth to eighth sub-signal lines.

22. The display apparatus of claim 19, wherein the gate signals are sequentially applied to the gate lines, each of the gate signals has an activation period corresponding to one period, and the first DEMUX signal has a period corresponding to 4M times of one period, is activated during a period corresponding to 2M times of the one period to switch the first and fourth switching devices, and has a phase opposite to a phase of the second DEMUX signal, where M is an integer number greater than 0.

23. The display apparatus of claim 22, wherein the first data voltages applied to the first and fourth sub-signal lines have a polarity opposite to a polarity of the first data voltages applied to the second and third sub-signal lines, the polarity of the first data voltages is inverted every 2M time period, and the second data voltages applied to the fifth to eighth sub-signal lines have a polarity opposite to a polarity of the first data voltages applied to the first to fourth sub-signal lines corresponding to the fifth to eighth sub-signal lines.

24. The display apparatus of claim 1, wherein the pixels are coupled to corresponding gate lines of the gate lines and corresponding data lines of the data lines.

25. The display apparatus of claim 1, wherein the pixels are coupled to corresponding gate lines of the gate lines and alternately coupled to corresponding gate lines of the data lines in a unit of two rows.

* * * * *